US011596281B2

(12) United States Patent
Tamura et al.

(10) Patent No.: US 11,596,281 B2
(45) Date of Patent: Mar. 7, 2023

(54) TOILET DEVICE AND TOILET SEAT UNIT

(71) Applicant: LIXIL Corporation, Tokyo (JP)

(72) Inventors: Hideki Tamura, Tokyo (JP); Hiroshi Kobayashi, Tokyo (JP); Shinichi Gomita, Tokyo (JP); Kojiro Watari, Tokyo (JP); Keisuke Sakakibara, Tokyo (JP)

(73) Assignee: LIXIL Corporation, Tokyo (JP)

( * ) Notice: Subject to any disclaimer, the term of this patent is extended or adjusted under 35 U.S.C. 154(b) by 298 days.

(21) Appl. No.: 17/042,084

(22) PCT Filed: Jan. 31, 2019

(86) PCT No.: PCT/JP2019/003353
§ 371 (c)(1),
(2) Date: Sep. 25, 2020

(87) PCT Pub. No.: WO2019/187614
PCT Pub. Date: Oct. 3, 2019

(65) Prior Publication Data

US 2021/0093131 A1 Apr. 1, 2021

(30) Foreign Application Priority Data

Mar. 28, 2018 (JP) ..... JP2018-063352
Mar. 28, 2018 (JP) ..... JP2018-063353
(Continued)

(51) Int. Cl.
*A47K 13/30* (2006.01)
*E03D 9/00* (2006.01)

(52) U.S. Cl.
CPC ..... *A47K 13/302* (2013.01); *E03D 9/002* (2013.01); *E03D 9/005* (2013.01)

(58) Field of Classification Search
CPC ..... A47K 13/302; E03D 9/022; E03D 9/005; E03D 9/08
See application file for complete search history.

(56) References Cited

U.S. PATENT DOCUMENTS 2,559,019 A * 7/1951 Kulhavy ..... E03D 11/13 4/430
2,853,713 A * 9/1958 Mello ..... E03D 11/02 4/300.3
(Continued)

FOREIGN PATENT DOCUMENTS

EP 3315677 * 5/2018 ..... E03D 9/005
JP 2001-81844 A 3/2001
(Continued)

*Primary Examiner* — David P Angwin
*Assistant Examiner* — Nicholas A Ros
(74) *Attorney, Agent, or Firm* — Morrison & Foerster LLP

(57) ABSTRACT

A toilet device includes a toilet body that has a toilet bowl, a toilet seat that is attached to the toilet body and has a bowl facing surface facing an inner surface of the toilet bowl in the up-and-down direction and provided on a back surface thereof, a discharge part that can discharge a cleaning liquid so that the cleaning liquid runs along a bowl facing surface, and a guide that can guide a part of the cleaning liquid so that the cleaning liquid runs along an inner peripheral side portion of the bowl facing surface.

24 Claims, 42 Drawing Sheets

(30) Foreign Application Priority Data

Mar. 28, 2018 (JP) ..... JP2018-063354
Mar. 28, 2018 (JP) ..... JP2018-063355
Mar. 28, 2018 (JP) ..... JP2018-063357

(56) References Cited

U.S. PATENT DOCUMENTS

| | | | | |
|---|---|---|---|---|
| 10,584,469 | B2 * | 3/2020 | Nogoshi | E03D 9/08 |
| 11,304,575 | B2 * | 4/2022 | Dorra | A47K 13/302 |
| 11,419,464 | B2 * | 8/2022 | Thorne | E03D 9/005 |
| 2017/0298609 | A1 * | 10/2017 | Gupta | E03D 9/08 |

FOREIGN PATENT DOCUMENTS

| | | | | | |
|---|---|---|---|---|---|
| JP | 2002-54216 | A | | 2/2002 | |
| JP | 2008-61928 | A | | 3/2008 | |
| JP | 2008061928 | | * | 3/2008 | E03D 9/00 |
| JP | 2008-255769 | A | | 10/2008 | |
| JP | 2008255769 | | * | 10/2008 | E03D 11/00 |
| JP | 2010-174451 | A | | 8/2010 | |
| JP | 2016-125236 | A | | 7/2016 | |
| KR | 20-2010-0004169 | U | | 4/2010 | |
| TW | 201440714 | A | | 11/2014 | |

* cited by examiner

TOILET DEVICE AND TOILET SEAT UNIT

CROSS-REFERENCE TO RELATED APPLICATIONS

This application is a national stage application under 35 USC 371 of International Application No. PCT/JP2019/003353, filed Jan. 31, 2019, which claims the priority of Japanese Application No. 2018-063352, filed Mar. 28, 2018, Japanese Application No. 2018-063353, filed Mar. 28, 2018, Japanese Application No. 2018-063354, filed Mar. 28, 2018, Japanese Application No. 2018-063355, filed Mar. 28, 2018, and Japanese Application No. 2018-063357, filed Mar. 28, 2018, the entire contents of each of which are incorporated herein by reference.

FIELD OF THE DISCLOSURE

The present disclosure relates to a toilet device and a toilet seat unit used for the same.

BACKGROUND OF THE DISCLOSURE

Patent Document 1 describes a toilet device capable of cleaning a back surface of a toilet seat by discharging a cleaning liquid from a discharge part (water discharging means) to the back surface of the toilet seat.

Patent Document 1: JP 2002-54216

SUMMARY OF THE DISCLOSURE

In the toilet device of Patent Document 1, the discharge part is provided on the back surface of the toilet seat. Therefore, it is necessary to move the discharge part together while moving the toilet seat. Therefore, when the cleaning liquid remains inside the discharge part, there is a case where a load to be applied to move the toilet seat increases by a weight of the cleaning liquid. As a result, the usability of the toilet seat is impaired. This is a common problem not only in a case of cleaning the back surface of the toilet seat, but also in a case of discharging cleaning water for cleaning an inner surface of the toilet bowl of the toilet body from the discharge part.

Further, even when the toilet seat is detachably attached to a function device, a similar problem occurs when the toilet seat separated from the function device moves, which needs to be improved.

An aspect of the first disclosure is made in view of such problems, and an advantage of the first disclosure is to provide a technology capable of maintaining usability of a toilet seat while realizing cleaning of a back surface of the toilet seat or an inner surface of a toilet bowl of a toilet body.

In some known embodiments, the toilet device capable of cleaning the back surface of the toilet seat has been proposed. For example, Patent Document 1 describes the toilet device capable of cleaning the back surface of the toilet seat by discharging the cleaning liquid from the discharge part to the back surface of the toilet seat. In the toilet device of Patent Document 1, the cleaning liquid is discharged from the plurality of discharge parts to run along the back surface of the toilet seat toward the same side of the toilet seat in a circumferential direction.

Unlike the toilet device of Patent Document 1, there is a case where the cleaning liquid is discharged from the first discharge part to run along the back surface of the toilet seat toward one side of the toilet seat in the circumferential direction, and the cleaning liquid is discharged from the second discharge part to run along the back surface of the toilet seat toward the other side of the toilet seat in the circumferential direction. In such a case, the following newly acquired knowledge that there are the following issues is newly presented herein. Specifically, in such a case, the cleaning liquid discharged from the first discharge part and the cleaning liquid discharged from the second discharge part collide with each other in the process of running along the back surface of the toilet seat. When the cleaning liquids ran in opposite directions collide with each other in this manner, droplets of the cleaning liquids are likely to be generated, which needs to be improved.

An aspect of the present disclosure is made in view of such problems, and an advantage of the present disclosure is to provide a technology capable of suppressing droplets from occurring while realizing cleaning of a back surface of a toilet seat.

Patent Document 1 describes the toilet device capable of cleaning the back surface of the toilet seat by discharging the cleaning liquid from an discharge hole of the discharge part to the back surface of the toilet seat.

However, in the toilet device of Patent Document 1, the discharge hole is always exposed to an external space. Therefore, there is a possibility that dirt and droplets of a liquid such as a cleaning liquid enter an inside of the discharge part through the discharge hole, and there is room for improvement in hygiene. This is a common problem not only in the case of cleaning the back surface of the toilet seat, but also in a case of discharging the cleaning water for cleaning the inner surface of the toilet bowl of the toilet body from the water discharging hole, which needs to be improved.

An aspect of the third disclosure is made in view of such problems, and an advantage of the third disclosure is to provide a technology capable of obtaining good hygiene while realizing cleaning of a back surface of the toilet seat or an inner surface of a toilet bowl of a toilet body.

In some known embodiments, the toilet device capable of cleaning the back surface of the toilet seat has been proposed. For example, Patent Document 1 describes the toilet device capable of cleaning the back surface of the toilet seat by discharging the cleaning liquid from the discharge part to the back surface of the toilet seat.

However, the cleaning liquid runs along the back surface of the toilet seat while going straight from a location where the cleaning liquid starts to run along the back surface of the toilet seat. Therefore, at a location away from the location where the cleaning liquid starts to run along the back surface of the toilet seat, outside a region where the cleaning liquid can go straight from the location where the cleaning liquid starts to run, the cleaning liquid is difficult to run along an inner peripheral side portion (to be described later) of the back surface of the toilet seat. Unwashed portion is likely to occur at such a location. The disclosed technique of Patent Document 1 does not take any special measures for such a problem, which needs to be improved.

An aspect of the fourth disclosure is made in view of such problems, and an advantage of the fourth disclosure is to provide a technology capable of reaching a cleaning liquid over a wide range of a back surface of a toilet seat.

In some known embodiments, the toilet device capable of cleaning the back surface of the toilet seat has been proposed. For example, Patent Document 1 describes the toilet device capable of cleaning the back surface of the toilet seat by fixing the discharge part to the toilet seat and discharging the cleaning liquid from the discharge part.

However, when the back surface of the toilet seat is cleaned using the cleaning liquid which runs along the back surface of the toilet seat, the cleaning liquid drips down from the back surface of the toilet seat by its own weight. Therefore, there is a problem that it is difficult to reach the cleaning liquid over a wide range. The disclosed technique of Patent Document 1 does not take any special measures for such a problem, which needs to be improved.

An aspect of a fifth disclosure is made in view of such problems, and an advantage of the fifth disclosure is to provide a technology capable of easily reaching a cleaning liquid over a wide range of a back surface of a toilet seat.

A first aspect of the first disclosure for solving the above-mentioned problems is a toilet seat unit. The toilet seat unit of the first aspect includes a function device that is provided on a toilet body, a toilet seat that is movably or detachably attached to the function device, and a discharge part that can discharge a cleaning liquid for cleaning a back surface of the toilet seat or an inner surface of a toilet bowl of the toilet body, in which the discharge part is provided on the function device.

According to the first aspect, even when the cleaning liquid remains inside the discharge part, the case where the weight of the cleaning liquid is not added to the toilet seat, and the load to be applied for moving the toilet seat increases can be avoided. Therefore, the usability of the toilet seat can be maintained while realizing the cleaning of the back surface of the toilet seat and the inner surface of the toilet bowl of the toilet body.

A first aspect of the second disclosure for solving the above-mentioned problems is a toilet seat unit. The toilet seat unit of the first aspect includes a toilet seat that is attached to a toilet body, and a plurality of discharge parts that can discharge a cleaning liquid, in which the plurality of discharge parts include a first discharge part that can discharge the cleaning liquid so that the cleaning liquid runs along a back surface of the toilet seat toward one side of the toilet seat in a circumferential direction, and a second discharge part that can discharge the cleaning liquid so that the cleaning liquid runs along the back surface of the toilet seat toward the other side of the toilet seat in the circumferential direction, and the toilet seat unit is structured to end the operation of discharging, by the first discharge part, the cleaning liquid so that the cleaning liquid runs along the back surface, and then start an operation of discharging, by the second discharge part, the cleaning liquid so that the cleaning liquid runs along the back surface.

According to the first aspect, even if the cleaning liquid discharged from the first discharge part and the cleaning liquid discharged from the second discharge part collide with each other, the collision time can be shortened. Therefore, it is possible to suppress the occurrence of droplets due to the collision of the cleaning liquids discharged from the plurality of discharge parts.

A first aspect of the third disclosure for solving the above-mentioned problems is a toilet device. The toilet device of the first aspect includes a discharge part that can discharge a cleaning liquid for cleaning a back surface of a toilet seat or an inner surface of a toilet bowl of a toilet body from an discharge hole, and a shutter that can move between a concealed position where the discharge hole is concealed from the outside and an exposed position where the discharge hole is exposed to the outside.

According to the first aspect, it is possible to suppress the entry of droplets into the discharge hole and obtain good hygiene by concealing the discharge hole with the shutter.

A first aspect of the fourth disclosure for solving the above-mentioned problems is a toilet device. The toilet device of the first aspect includes a toilet body that has a toilet bowl, a toilet seat that is attached to the toilet body and has a bowl facing surface facing an inner surface of the toilet bowl in the up-and-down direction and provided on a back surface thereof, a discharge part that can discharge a cleaning liquid so that the cleaning liquid can run along the bowl facing surface, and a guide that can guide a part of the cleaning liquid so that the cleaning liquid runs along an inner peripheral side portion of the bowl facing surface.

According to the first aspect, at a location away from the location where the cleaning liquid starts to run along the bowl facing surface of the toilet seat, outside the region where the cleaning liquid can go straight from the location where the cleaning liquid starts to run, the cleaning liquid can easily run along the inner peripheral side portion of the bowl facing surface. Therefore, the cleaning liquid can reach the wide range of the bowl facing surface of the toilet seat, and the unwashed portion on the bowl facing surface can be suppressed.

A first aspect of the fifth disclosure for solving the above-mentioned problems is a toilet device. The toilet device of the first aspect includes a toilet body that has a toilet bowl, a toilet seat that is attached to the toilet body, and a first discharge part that can discharge a cleaning liquid so that the cleaning liquid runs along a back surface of the toilet seat toward one side of the toilet seat in a circumferential direction, in which the back surface of the toilet seat is provided with a first inclined surface which becomes a downward gradient toward one side of the toilet seat in the circumferential direction over at least a part of the range in which the cleaning liquid discharged from the first discharge part runs.

According to the first aspect, when the cleaning liquid runs along the first inclined surface of the toilet seat, it becomes easy to run the cleaning liquid in the direction in which the first inclined surface becomes a downward gradient by using gravity due to the own weight of the cleaning liquid. Therefore, compared with the case where the toilet seat does not have the first inclined surface, the cleaning liquid can easily reach the wide range of the back surface of the toilet seat.

BRIEF DESCRIPTION OF THE FIGURES

Some embodiments will now be described, by way of example only, with reference to the accompanying drawings which are meant to be exemplary, in which.

DETAILED DESCRIPTION OF THE DISCLOSURE

Figure 1:
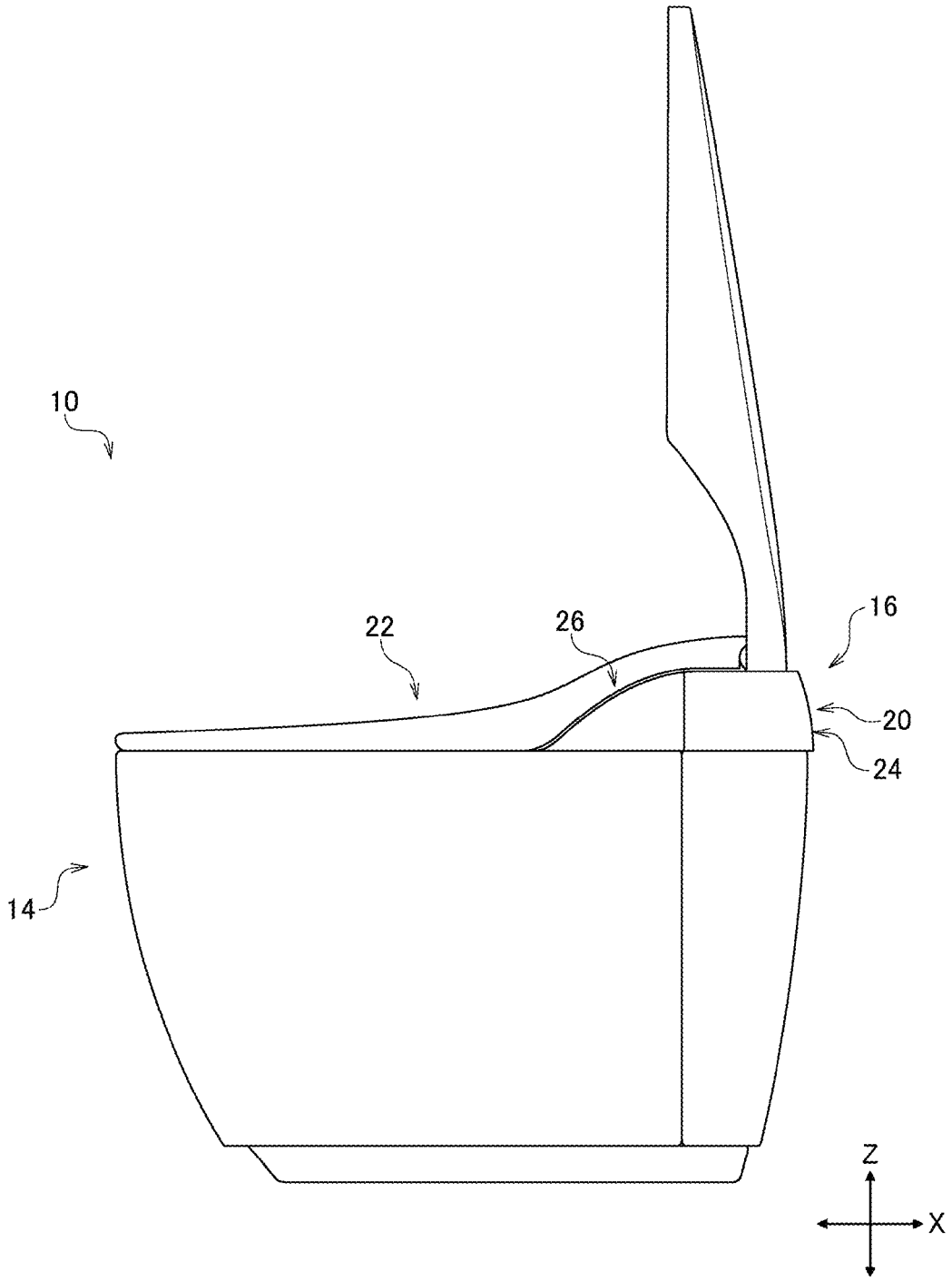
FIG. 1 is a side view of a toilet device according to a first embodiment.

Hereinafter, in some embodiments and the modifications, the same reference numerals are given to the same components, and duplicated description thereof will be omitted. Further, in each drawing, for convenience of description, some of the components are omitted as appropriate, and the dimensions of the components are appropriately enlarged or reduced.

First Embodiment

Figure 2:
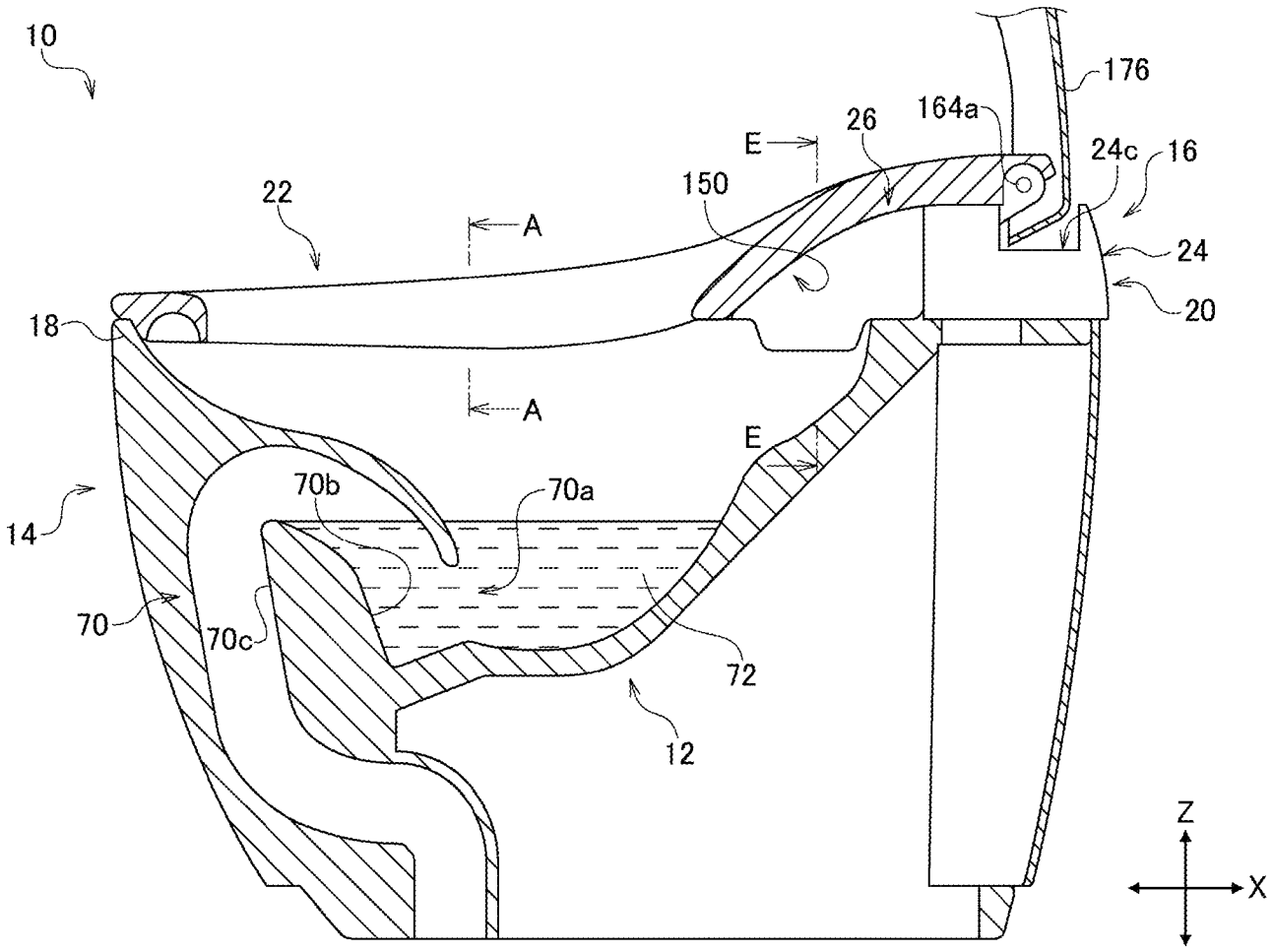
FIG. 2 is a side cross-sectional view of a part of the toilet device according to the first embodiment.

A toilet device 10 according to a first embodiment will be described. First, a first ingenuity of the toilet device 10 will be described. FIG. 1 is a side view of the toilet device 10, and FIG. 2 is a side cross-sectional view of a part thereof.

The toilet device 10 includes a toilet body 14 having a toilet bowl 12 provided on the front part thereof, and a toilet seat unit 16 attached to the toilet body 14. The toilet body 14 has a rim part 18 that forms a peripheral edge portion of an upper end opening of the toilet bowl 12, in addition to the toilet bowl 12. The toilet seat unit 16 mainly includes a function device 20 and a toilet seat 22. A positional relationship between components of the toilet device 10 will be described below using three directions orthogonal to each other. The direction is a front-and-rear direction X, a left-and-right direction Y, and an up-and-down direction Z of the toilet body 14. The front-and-rear direction X and the left-and-right direction Y are horizontal directions, and correspond to the front-and-rear direction and the left-and-right direction of a sitting person sitting on the toilet seat 22 in a normal posture. The up-and-down direction Z is a vertical direction.

The function device 20 has a first casing 24 provided on a rear part of the toilet body 14 and a second casing 26 arranged in front of the first casing. In FIG. 2, only the contours of cross sections of the first casing 24 and the second casing 26 are illustrated.

Figure 3:
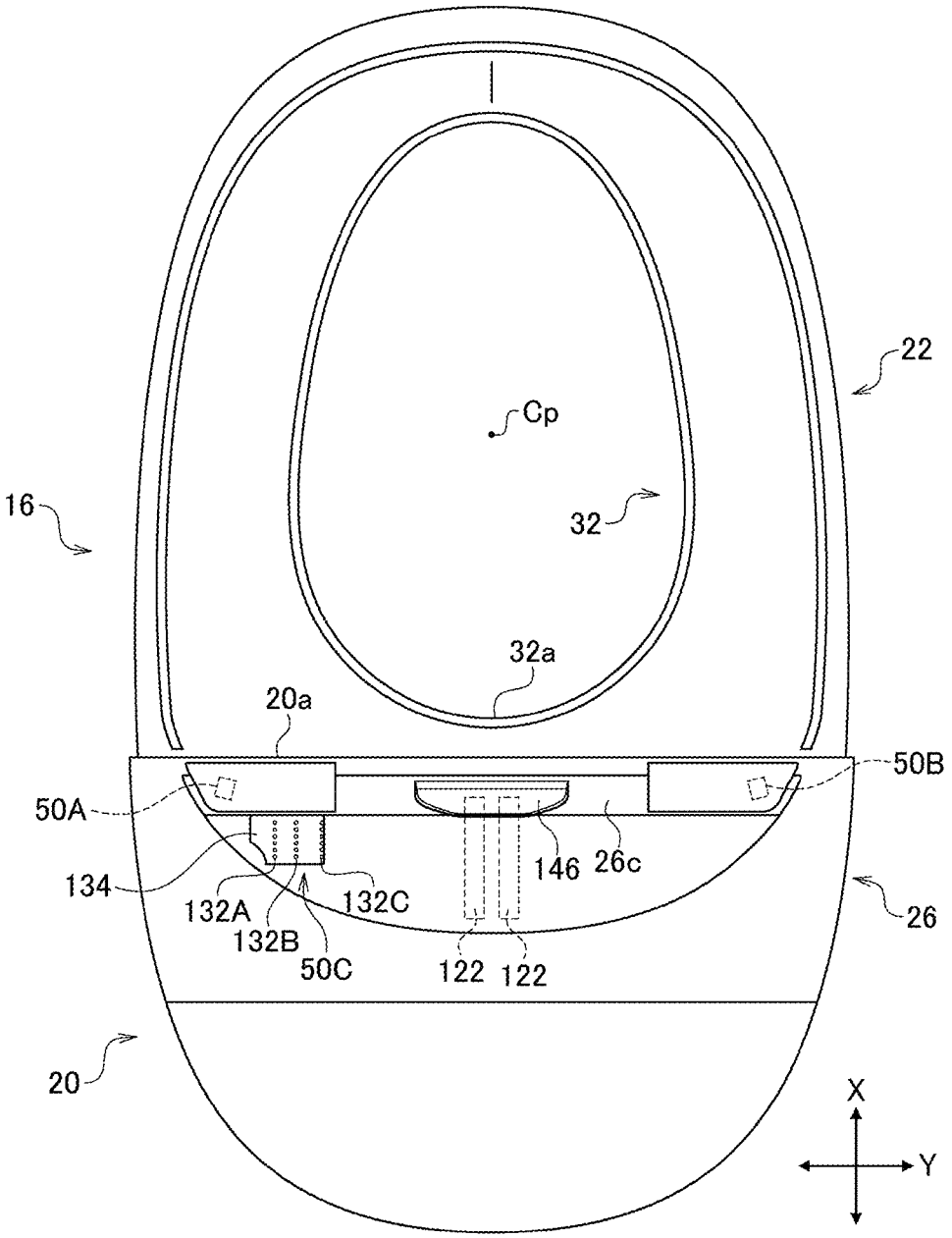
FIG. 3 is a diagram of a toilet seat unit according to the first embodiment as viewed from the bottom.

FIG. 3 is a diagram of the toilet seat unit 16 as viewed from the bottom. The toilet seat 22 has a central opening portion 32 provided in a central portion of the toilet seat 22, through which dirt excreted by the sitting person passes. In this specification, when viewing the toilet seat 22 from the up-and-down direction Z, a circumferential direction around a center Cp of the central opening portion 32 is simply referred to as "circumferential direction", and a radial direction centered on the center Cp is simply referred to as "radial direction". Hereinafter, the center Cp of the central opening portion 32 of the toilet seat 22 is simply referred to as the "center Cp of the toilet seat 22". Here, the center Cp means a geometric center of gravity of the central opening portion 32 of the toilet seat 22 when the toilet seat 22 is viewed from the up-and-down direction Z.

Figure 4:
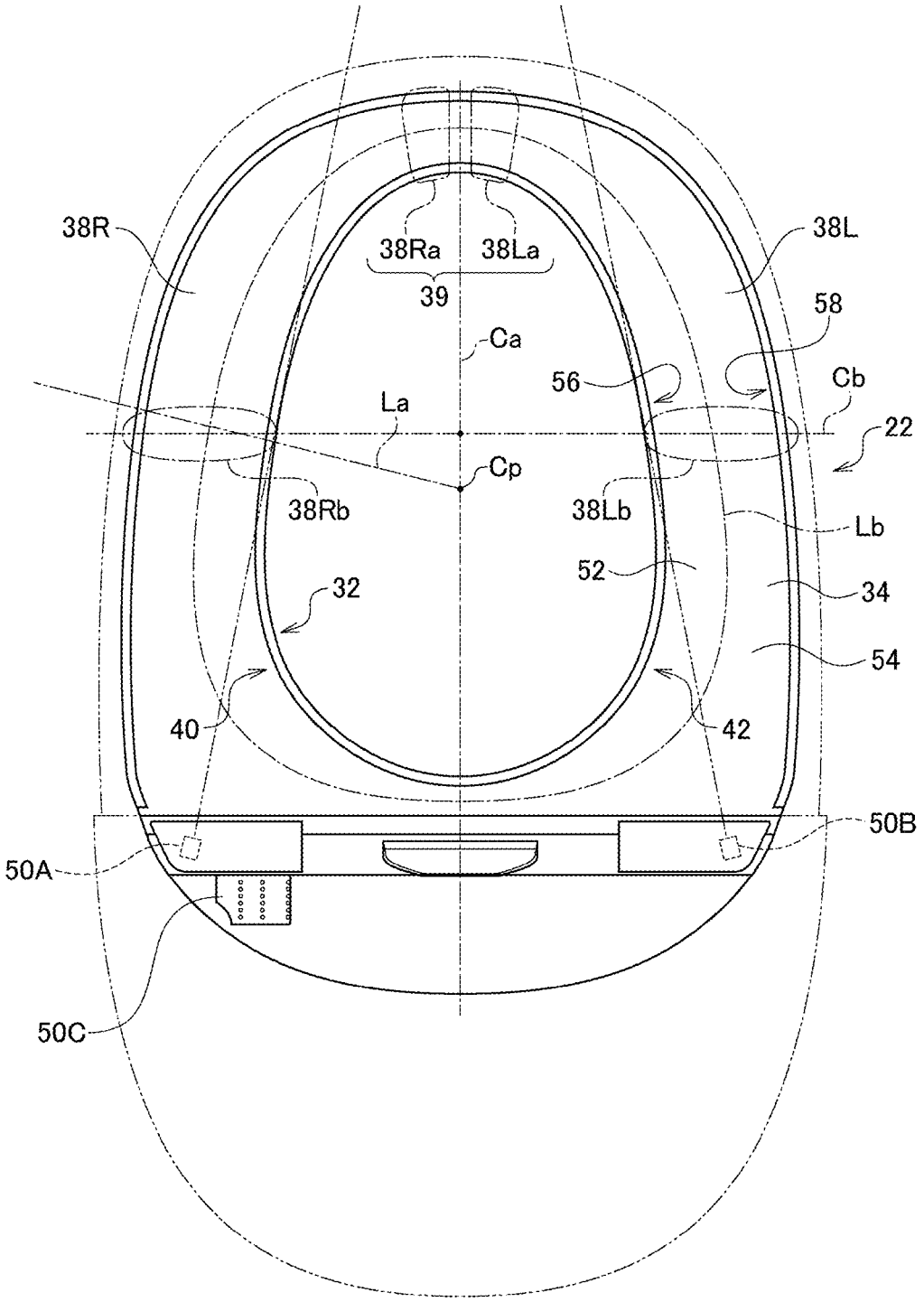
FIG. 4 is a diagram illustrating a positional relationship between the toilet seat unit and a toilet body according to the first embodiment.

FIG. 4 is a diagram illustrating a positional relationship between the toilet seat unit 16 and the toilet body 14. A location overlapping an inner surface of the toilet bowl 12 of the toilet body 14 in the up-and-down direction Z is illustrated by a solid line, and other locations are illustrated by a two-dot chain line. A back surface, which is an outer surface of the toilet seat 22, is provided with a first bowl facing surface 34 facing the inner surface of the toilet bowl 12 in the up-and-down direction Z. The first bowl facing surface 34 is exposed in an inner space of the toilet bowl 12, and is easily contaminated due to attachment of droplets of dirt or the like that are received by the toilet bowl 12. The first bowl facing surface 34 according to the present embodiment has an annular shape that is continuous in the circumferential direction.

The first bowl facing surface 34 is provided with a right half region 38R (first half region) that constitutes a half portion on the right side (left side of a space in the drawing) that is one side in a left-and-right direction Y of the first bowl facing surface 34, and a left half region 38L (second half region) that constitutes a half portion on the left side that is the other side. In the back surface view of the toilet seat 22, Ca is a left-and-right center line along the front-and-rear direction X that bisects an outer dimension of the first bowl facing surface 34 in the left-and-right direction Y. At this time, the right half region 38R is referred to as a region located on the right side with respect to the left-and-right center line Ca among the regions constituting the first bowl facing surface 34, and the left half region 38L is referred to as a region located on the left side with respect to the left-and-right center line Ca. Here, the back surface view is referred to as viewing the toilet seat 22 from the bottom in the up-and-down direction when the toilet seat 22 is in the lying position (described later). Hereinafter, a peripheral end portion 38Ra on a front side of the right half region 38R and a peripheral end portion 38La on a front side of the left half region 38L collectively is referred to as a front end region 39.

Figure 5:
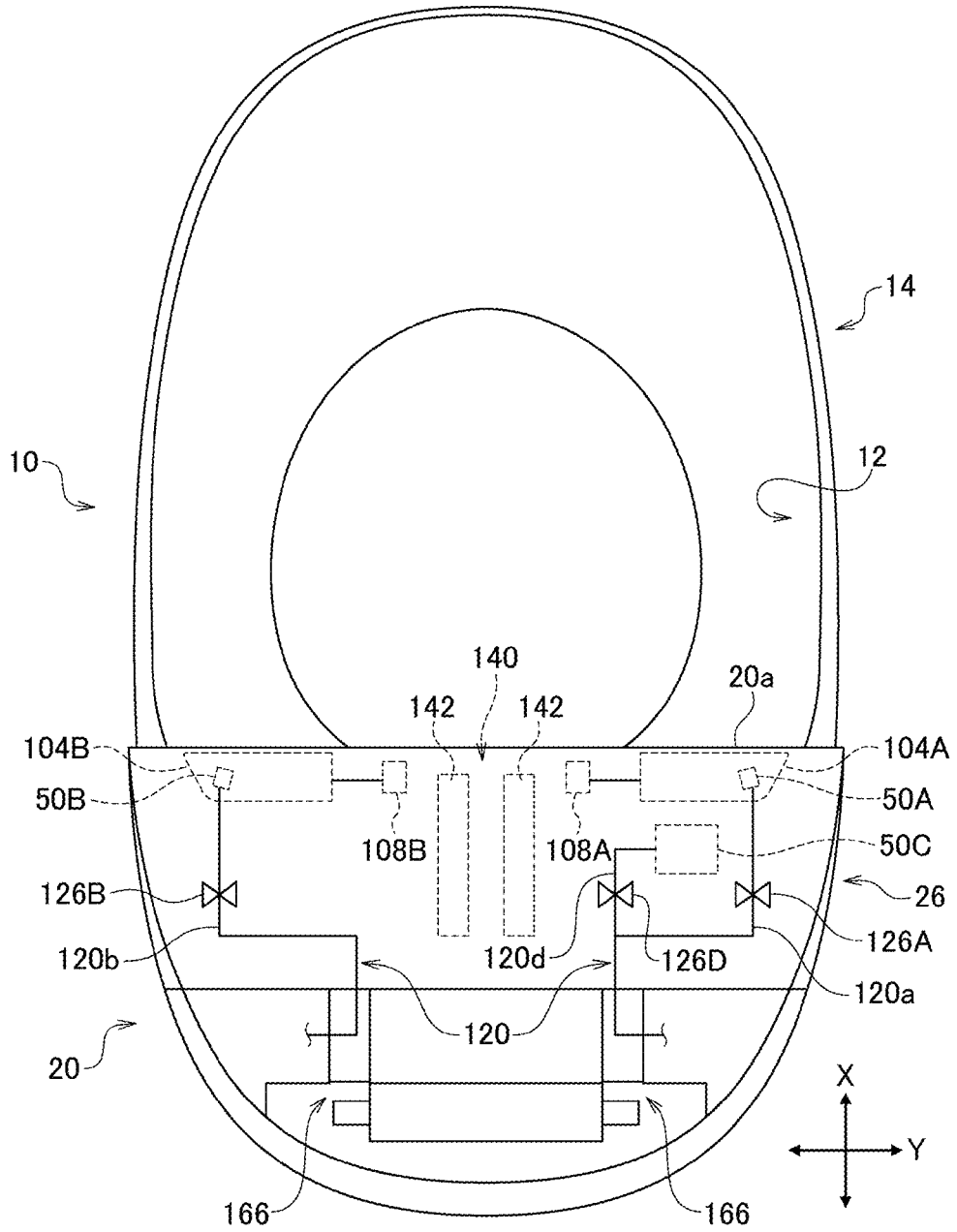
FIG. 5 is a top view of a part of the toilet device according to the first embodiment.

FIG. 5 is a top view of a part of the toilet device 10. As illustrated in FIGS. 4 and 5, the toilet device 10 includes a plurality of discharge parts 50A to 50C that can discharge a cleaning liquid supplied from a liquid supplying source such as a tank. A main component of the cleaning liquid according to the present embodiment is cleaning water, but alcohol or the like other than water may be a main component.

The discharge parts 50A to 50C according to the present embodiment include seat back discharge parts 50A and 50B for cleaning the back surface of the toilet seat 22. The seat back discharge parts 50A and 50B include a first discharge part 50A and a second discharge part 50B. The first discharge part 50A is arranged above a right half portion of the toilet body 14. The second discharge part 50B is arranged above a left half portion of the toilet body 14. In the present embodiment, the first discharge part 50A is arranged above a rear end portion of a right half portion of the toilet bowl 12, and the second discharge part 50B is arranged above the rear end portion of the left half portion of the toilet bowl 12.

Figure 6:
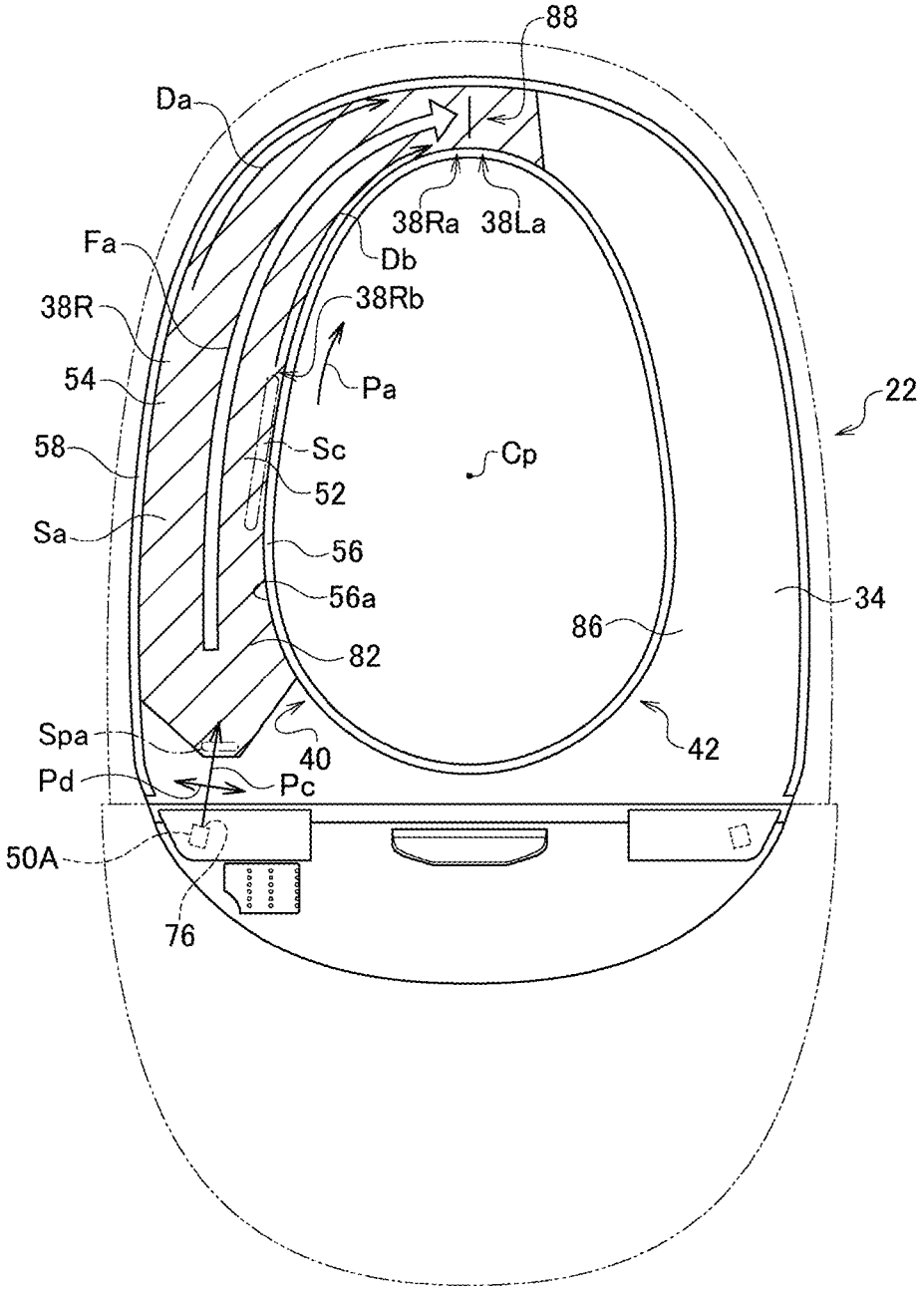
FIG. 6 is a diagram illustrating a range in which a cleaning liquid discharged from a first discharge part according to the first embodiment runs along a first bowl facing surface of a toilet seat.

FIG. 6 is a diagram illustrating a range Sa in which the cleaning liquid discharged by the first discharge part 50A runs along the first bowl facing surface 34 of the toilet seat 22. The first discharge part 50A discharges the cleaning liquid so that the cleaning liquid runs forward along the right half region 38R of the first bowl facing surface 34. The first discharge part 50A can also be considered as discharging the cleaning liquid so that the cleaning liquid runs along the first bowl facing surface 34 toward the one side Pa in the circumferential direction of the toilet seat 22.

Figure 7:
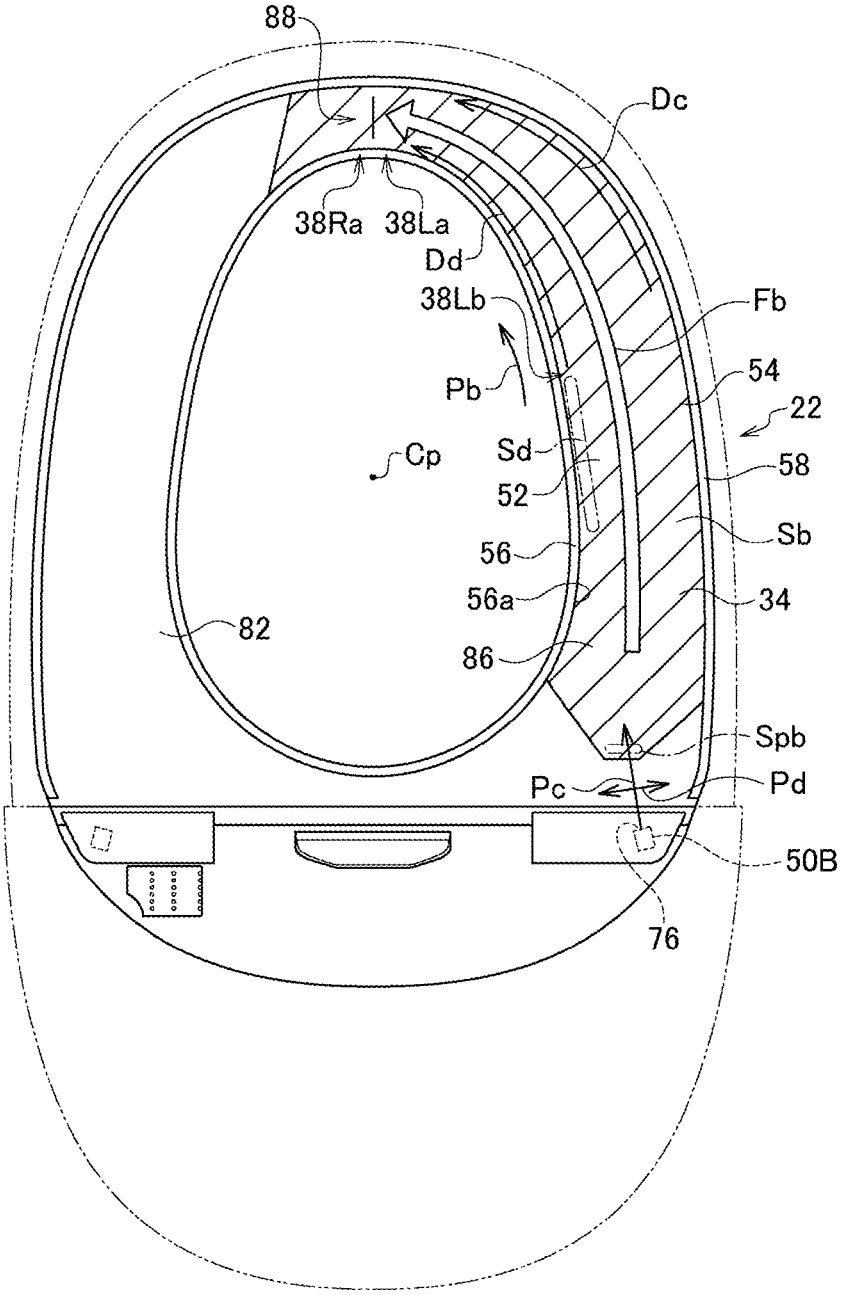
FIG. 7 is a diagram illustrating a range in which the cleaning liquid discharged from the second discharge part according to the first embodiment runs along a first bowl facing surface of the toilet seat.

FIG. 7 is a diagram illustrating a range Sb in which the cleaning liquid discharged by the second discharge part 50B runs along the first bowl facing surface 34 of the toilet seat 22. The second discharge part 50B discharges the cleaning liquid so that the cleaning liquid runs forward along the left half region 38L of the first bowl facing surface 34. The second discharge part 50B can also be considered as discharging the cleaning liquid so that the cleaning liquid runs along the first bowl facing surface 34 toward the other side Pb in the circumferential direction of the toilet seat 22.

As illustrated in FIG. 4, in the back surface view of the toilet seat 22, a bisector that bisects the first bowl facing surface 34 on a virtual half line La extending from the center Cp of the toilet seat 22 is referred to as Lb. The first bowl facing surface 34 has an inner peripheral side portion 52 on an inner peripheral side of a bisector Lb and an outer peripheral side portion 54 on an outer peripheral side of the bisector Lb.

Figure 8:
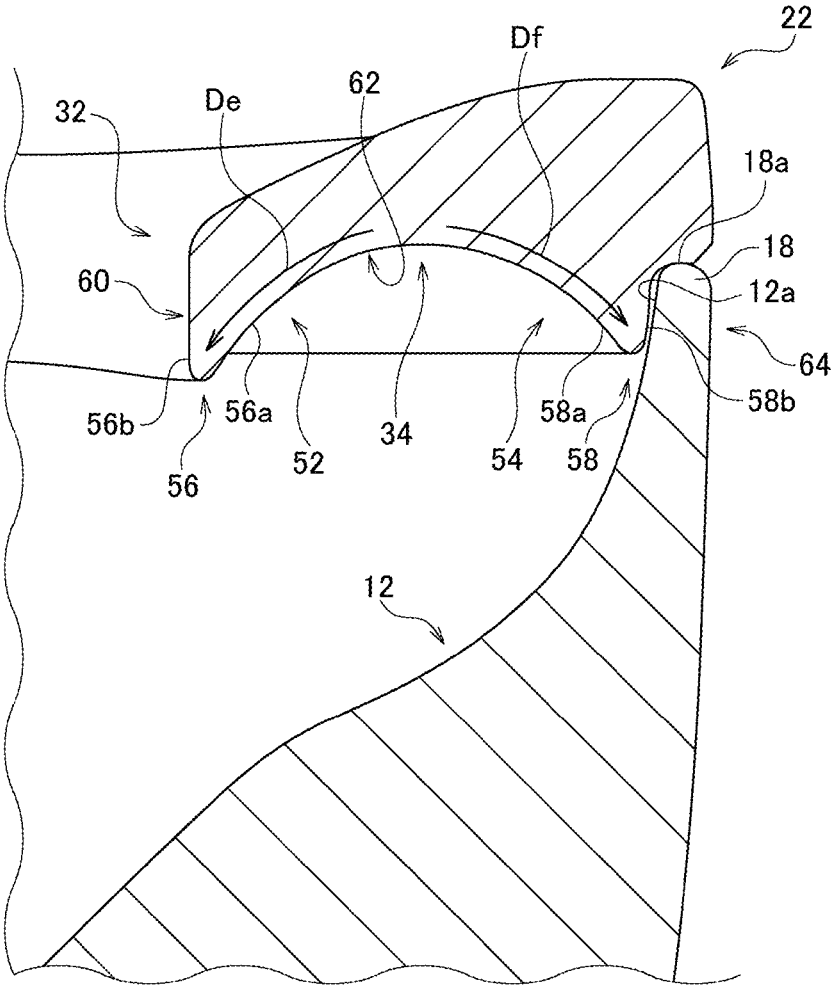
FIG. 8 is a cross-sectional view taken along the line A-A of FIG. 2 according to some embodiments.

FIG. 8 is a cross-sectional view taken along the line A-A of FIG. 2. FIG. 8 is also a vertical cross section that passes through the center Cp of the toilet seat 22. As illustrated in FIGS. 4 and 8, the toilet seat 22 has an inner peripheral side protrusion 56 that protrudes downward from the inner peripheral side portion 52 of the first bowl facing surface 34 and an outer peripheral side protrusion 58 that protrudes downward from the outer peripheral side portion 54 of the first bowl facing surface 34. The inner peripheral side protrusion 56 is provided in a range over a midway position in the radial direction from the inner peripheral edge portion within the first bowl facing surface 34. It is considered that the inner peripheral side protrusion 56 constitutes at least the inner peripheral edge portion of the first bowl facing surface 34. The outer peripheral side protrusion 58 is provided in a range over a midway position in the radial direction from an outer peripheral edge portion of the first bowl facing surface 34. It is considered that the outer peripheral side protrusion 58 constitutes at least the outer peripheral edge portion of the first bowl facing surface 34.

An outer peripheral surface 56*a* of the inner peripheral side protrusion 56 is formed to extend downward as the outer peripheral surface 56*a* goes toward the inside in the radial direction. As the shape that satisfies this condition, the outer peripheral surface 56*a* of the inner peripheral side protrusion 56 according to the present embodiment has a concave curved surface shape in the vertical cross section passing through the center Cp of the toilet seat 22.

The central opening portion 32 of the toilet seat 22 is provided with a flat surface 60 that is continuous from the surface of the toilet seat 22 to the back surface in a vertical cross section that passes through the center Cp of the toilet seat 22. The inner peripheral surface 56*b* of the inner peripheral side protrusion 56 according to the present embodiment constitutes a part of the flat surface 60.

An inner peripheral surface 58*a* of the outer peripheral side protrusion 58 is formed to extend downward as the inner peripheral surface 58*a* goes toward the outside in the radial direction. As the shape that satisfies this condition, the inner peripheral surface 58*a* of the outer peripheral side protrusion 58 according to the present embodiment has a concave curved surface shape in the vertical cross section passing through the center Cp of the toilet seat 22.

The outer peripheral surface 58*b* of the outer peripheral side protrusion 58 according to the present embodiment is formed in an outer shape that matches an inner peripheral surface of an upper end edge portion 12*a* of the toilet bowl 12, and is arranged along the inner peripheral surface thereof. The inner peripheral surface of the upper end edge portion 12*a* of the toilet bowl 12 has a concave curved surface shape, and the outer peripheral surface 58*b* of the outer peripheral side protrusion 58 has a convex curved surface shape having a radius of curvature equivalent to that formed by the inner peripheral surface of the upper end edge portion 12*a*.

In the present embodiment, the outer peripheral surface 56*a* of the inner peripheral side protrusion 56 and the inner peripheral surface 58*a* of the outer peripheral side protrusion 58 form a part of a smoothly continued concave curved surface 62. Further, the outer peripheral surface 56*a* of the inner peripheral side protrusion 56 and the inner peripheral surface 58*a* of the outer peripheral side protrusion 58 constitute a part of a groove part continuous in the circumferential direction.

Refer to FIG. 4. The inner peripheral side protrusion 56 is a ridge continuous in the circumferential direction on the first bowl facing surface 34. The inner peripheral side protrusion 56 according to the present embodiment has a first guide 40 that is provided to be continuous in the circumferential direction in a range from the central portion 38Rb of the right half region 38R of the first bowl facing surface 34 in the front-and-rear direction Y to the peripheral end portion 38Ra on the front side of the right half region 38R. The central portion 38Rb of the right half region 38R is referred to as a location overlapping a front-and-rear center line Cb of the first bowl facing surface 34 and a location that includes a peripheral portion around the front-and-rear center line Cb. The front-and-rear center line Cb is referred to as a line along the left-and-right direction Y that bisects a dimension of the first bowl facing surface 34 in the front-and-rear direction X, in the back surface view of the toilet seat 22. It can be considered that the first guide 40 is provided to be continuous in the circumferential direction in a range from a location overlapping the front-and-rear center line Cb of the right half region 38R to a peripheral end portion 38Ra of the right half region 38R.

The inner peripheral side protrusion 56 has a second guide 42 that is provided to be continuous in the circumferential direction in a range from the central portion 38Lb of the left half region 38L of the first bowl facing surface 34 in the front-and-rear direction Y to the peripheral end portion 38La on the front side of the left half region 38L. The central portion 38Lb of the left half region 38L is referred to as a location overlapping the front-and-rear center line Cb of the first bowl facing surface 34 and a location that includes a peripheral portion around the front-and-rear center line Cb. It can be considered that the second guide 42 is provided to be continuous in the circumferential direction in a range from a location overlapping the front-and-rear center line Cb of the left half region 38L to the peripheral end portion La of the left half region 38L.

The inner peripheral side protrusion 56 according to the present embodiment is provided to be continuous in the circumferential direction in a range from the rear end portion of the right half region 38R to the rear end portion of the left half region 38L via the front end region 39. The outer peripheral side protrusion 58 has also the same structure. The groove part constituted by the inner peripheral side protrusion 56 and the outer peripheral side protrusion 58 has also the same structure.

Refer to FIG. 8. The inner peripheral side protrusion 56 and the outer peripheral side protrusion 58 are provided to be located below an upper surface 18*a* of the rim part 18 of the toilet body 14. A lower end portion of the inner peripheral side protrusion 56 according to the present embodiment is provided to be located below a lower end portion of the outer peripheral side protrusion 58.

The toilet device 10 is provided with a flow restricting structure 64 for restricting the flow of the cleaning liquid going toward the outside in the radial direction through the rim part 18 of the toilet body 14 and the toilet seat 22. The flow restricting structure 64 according to the present embodiment is the upper end edge portion 12*a* of the toilet bowl 12 of the toilet body 14.

An operation of the above toilet device 10 will be described. Although details will be described later, the toilet device 10 according to the present embodiment is structured to end an operation of discharging the cleaning liquid from the first discharge part 50A and then start an operation of discharging the cleaning liquid from the second discharge part 50B.

As illustrated in FIG. 6, the cleaning liquid discharged from the first discharge part 50A hits the rear portion of the right half region 38R of the first bowl facing surface 34 of the toilet seat 22, and forms a first seat back flow Fa to run along the first bowl facing surface 34 while spreading in the discharge direction Pc from a hit location Spa. Here, the discharge direction Pc is referred to as a direction along a central axis line of a cleaning liquid outlet 76 (described later) of the referred discharge part. A part of the first seat back flow Fa hits the above-described flow restricting structure 64 and the outer peripheral side protrusion 58 of the toilet seat 22, so the flow direction of the part of the first seat back flow Fa is changed to be bent toward the inside in the radial direction and the part of the first seat back flow Fa is mainly guided to run along the outer peripheral side portion 54 of the first bowl facing surface 34 in the one side Pa of the circumferential direction (see a direction Da).

In the back surface view of the toilet seat 22, in a range Sc in which the cleaning liquid can go straight from the first discharge part 50A in the discharge direction Pc, the outer peripheral surface 56*a* of the inner peripheral side protrusion 56, more specifically, the outer peripheral surface of the first guide 40 is located. As a result, a part of the cleaning liquid discharged from the first discharge part 50A flows to run along the outer peripheral surface 56*a* of the inner peripheral side protrusion 56 in the circumferential direction. The first discharge part 50A is to discharge the cleaning liquid so that the cleaning liquid runs along the outer peripheral surface 56*a* (first guide 40) of the inner peripheral side protrusion 56 in the circumferential direction.

While a part of the cleaning liquid discharged from the first discharge part 50A runs along the outer peripheral surface 56*a* (first guide 40) of the inner peripheral side protrusion 56 in the circumferential direction, the cleaning liquid flows along the outer peripheral surface 56*a* while the flow direction of the part of the cleaning liquid being bent toward the inside in the radial direction by a Coanda effect (see direction Db). A part of the cleaning liquid is guided to run along the inner peripheral side portion 52 of the first bowl facing surface 34 in the one side Pa of the circumferential direction while the flow direction of the part of the cleaning liquid being changed to be bent toward the inside in the radial direction. In this way, the first guide 40 of the inner peripheral side protrusion 56 can guide a part of the cleaning liquid so that the part of the cleaning liquid runs along the inner peripheral side portion 52 of the first bowl facing surface 34 while the flow direction of the part of the cleaning liquid discharged from the first discharge part 50A being bent toward the inside in the radial direction.

As illustrated in FIG. 7, the cleaning liquid discharged from the second discharge part 50B hits the rear portion of the left half region 38L of the first bowl facing surface 34, and forms a second seat back flow Fb to run along the first bowl facing surface 34 while spreading in the discharge direction Pc from a hit location Spb. Similar to the first seat back flow Fa, a part of the second seat back flow Fb hits the flow restricting structure 64 and the outer peripheral side protrusion 58 of the toilet seat 22, so the flow direction of the part of the second seat back flow Fb is changed to be bent toward the inside in the radial direction and the part of the second seat back flow Fb is mainly guided to run along the outer peripheral side portion 54 of the first bowl facing surface 34 in the other side Pb of the circumferential direction (see a direction Dc).

When viewed from the back surface of the toilet seat 22, in a range Sd in which the cleaning liquid can go straight from the second discharge part 50B in the discharge direction Pc, the outer peripheral surface 56*a* of the inner peripheral side protrusion 56, more specifically, the outer peripheral surface of the second guide 42 is located. As a result, a part of the cleaning liquid discharged from the second discharge part 50B flows to run along the outer peripheral surface 56*a* (second guide 42) of the inner peripheral side protrusion 56 in the circumferential direction.

While a part of the cleaning liquid discharged from the second discharge part 50B also runs along the outer peripheral surface 56*a* (second guide 42) of the inner peripheral side protrusion 56 in the circumferential direction, the part of the cleaning liquid flows along the outer peripheral surface 56*a* while the flow direction of the part of the cleaning liquid being bent toward the inside in the radial direction by the Coanda effect (see direction Dd). A part of the cleaning liquid is guided to run along the inner peripheral side portion 52 of the first bowl facing surface 34 in the other side Pb of the circumferential direction while the flow direction of the part of the cleaning liquid being changed to be bent toward the inside in the radial direction. In this way, the second guide 42 of the inner peripheral side protrusion 56 can guide a part of the cleaning liquid so that the part of the cleaning liquid runs along the inner peripheral side portion 52 of the first bowl facing surface 34 while the flow direction of the part of the cleaning liquid discharged from the second discharge part 50B being bent toward the inside in the radial direction.

With the above configuration, the first seat back flow Fa runs along the first bowl facing surface 34 in the one side Pa of the circumferential direction so that the first seat back flow Fa passes through the central portion 38Rb in the front-and-rear direction Y and the peripheral end portion 38Ra of the right half region 38R of the toilet seat 22. In addition, the second seat back flow Fb runs along the first bowl facing surface 34 in the other side Pb of the circumferential direction so that the second seat back flow Fb passes through the central portion 38Lb in the front-and-rear direction Y and the peripheral end portion 38La of the left half region 38L of the toilet seat 22. The first seat back flow Fa and the second seat back flow Fb flow to run along the front end region 39 of the first bowl facing surface 34 as regions that partially overlap each other.

An effect of the above toilet device 10 will be described. The toilet device 10 includes the guides 40 and 42 (inner peripheral side protrusion 56) that can guide a part of the cleaning liquid so that the cleaning liquid runs along the inner peripheral side portion 52 of the first bowl facing surface 34 of the toilet seat 22. Thereby, at locations away from the locations Spa and Spb where the cleaning liquid starts to run along the first bowl facing surface 34, outside the region where the cleaning liquid can go straight from the locations Spa and Spb where the cleaning liquid starts to run, the cleaning liquid can easily run along the inner peripheral side portion 52 of the first bowl facing surface 34. This means that, for example, the cleaning liquid can easily run along regions 88A and 88B (see FIG. 9) described later. Therefore, the cleaning liquid can reach the wide range of the first bowl facing surface 34, and the unwashed portion on the first bowl facing surface 34 can be suppressed.

Figure 9B:
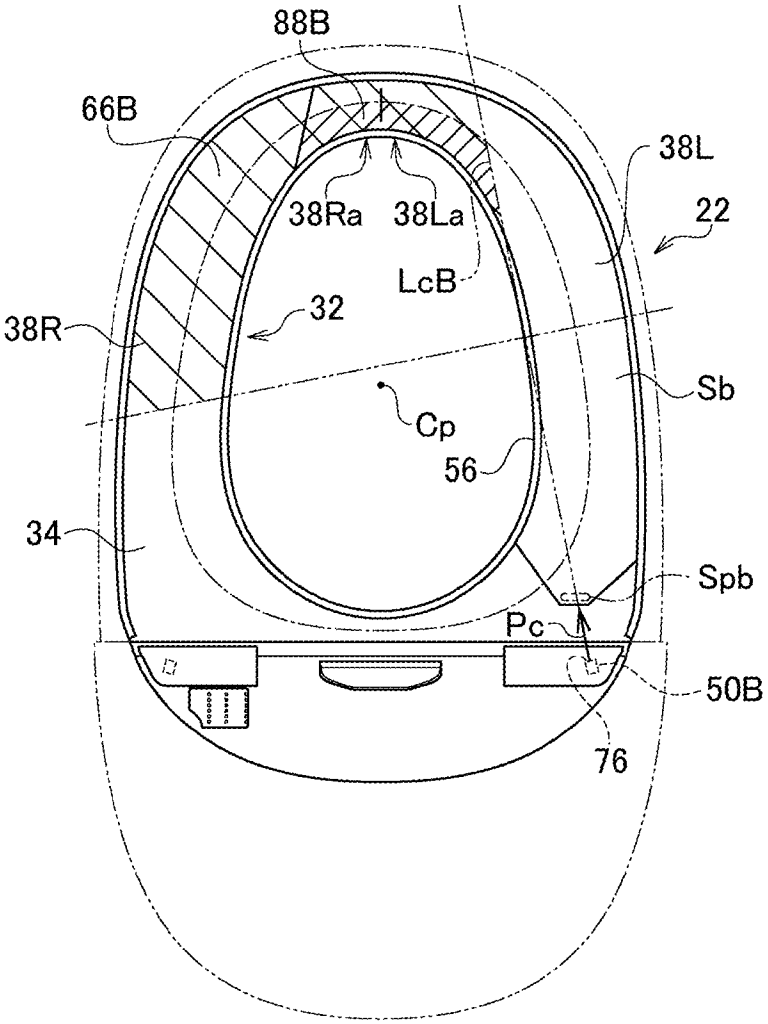
FIG. 9B is an explanatory diagram illustrating a second specific region according to some embodiments.
Figure 9A:
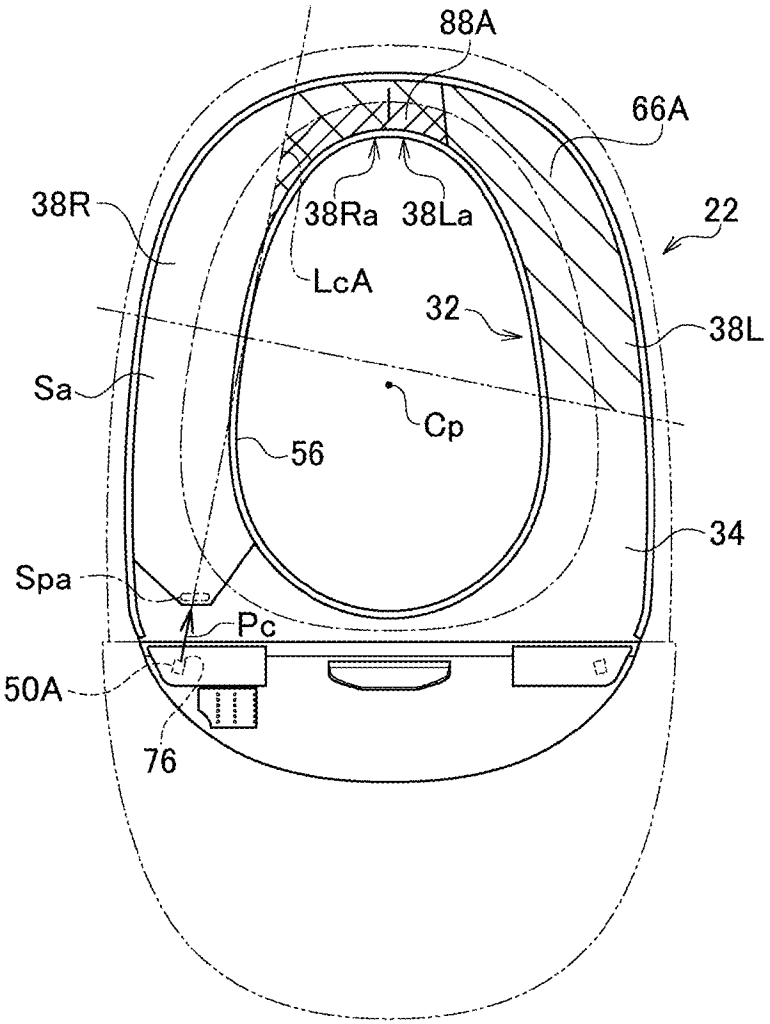
FIG. 9A is an explanatory diagram illustrating a first specific region according to some embodiments.

FIG. 9A is an explanatory diagram illustrating a first specific region 66A, and FIG. 9B is an explanatory diagram illustrating a second specific region 66B. In the back surface view of the toilet seat 22, lines which are virtual lines extending from the seat back discharge parts 50A and 50B in the discharge direction Pc of the cleaning liquid and circumscribe a contour of the central opening portion 32 of the toilet seat 22 are circumscribing lines LcA and LcB. The circumscribing lines LcA and LcB extend from the center of the cleaning liquid outlet 76 of the seat back discharge parts 50A and 50B, in the back surface view of the toilet seat 22. The circumscribing lines LcA and LcB include a first circumscribing line LcA corresponding to the first discharge part 50A and a second circumscribing line LcB corresponding to the second discharge part 50B.

In the first bowl facing surface 34 of the toilet seat 22, a region, which is a region closer to the center Cp of the toilet seat 22 from the first circumscribing line LcA and located in the discharge direction Pc of the first discharge part 50A from a circumscribing location of the first circumscribing line LcA, is referred to as the first specific region 66A. In the first bowl facing surface 34 of the toilet seat 22, a region, which is a region closer to the center Cp of the toilet seat 22 from the second circumscribing line LcB, and located in the discharge direction Pc of the second discharge part 50B from a circumscribing location of the second circumscribing line LcB, is referred to as the second specific region 66B. The first specific region 66A is a region in which the cleaning liquid discharged from the first discharge part 50A is difficult to reach, and the second specific region 66B is a region in which the cleaning liquid from the second discharge part 50B is difficult to reach.

At this time, the first guide 40 can guide a part of the cleaning liquid so that the part of the cleaning liquid runs along a part (region 88A of double hatching in FIG. 9A) of a location overlapping the first specific region 66A in the inner peripheral side portion 52 of the first bowl facing surface 34. In addition, the second guide 42 can guide a part of the cleaning liquid so that the part of the cleaning liquid runs along a part (region 88B of double hatching in FIG. 9B) of a location overlapping the second specific region 66B in the inner peripheral side portion 52 of the first bowl facing surface 34. As a result, it becomes easy to make the cleaning liquid reach a location where it is difficult for the cleaning liquid discharged from discharge parts 50A and 50B to reach.

When discharging the cleaning liquid from the discharge part 50A so that the cleaning liquid runs forward along the half region 38R, the peripheral end portion 38Ra on the front side of the half region 38R becomes a location where it is difficult for the cleaning liquid to reach. The first guide 40 of the inner peripheral side protrusion 56 is provided to be continuous in the circumferential direction in a range including at least the central portion 38Rb of the half region 38R in the front-and-rear direction Y to the peripheral end portion 38Ra on the front side. As a result, when discharging the cleaning liquid so that the cleaning liquid runs forward along the half region 38R, it is easy for the cleaning liquid to reach the peripheral end portion 38Ra on the front side of the half region 38R which the cleaning liquid is difficult to reach.

The seat back discharge parts 50A and 50B discharge the cleaning liquid so that the cleaning liquid runs along the outer peripheral surface 56*a* of the inner peripheral side protrusion 56 in the circumferential direction. Therefore, as described above, the cleaning liquid can be guided over a wide range of the inner peripheral side portion 52 of the first bowl facing surface 34 by using the Coanda effect. In addition, outside the region where the cleaning liquid can go straight from the locations Spa and Spb where the cleaning liquid starts running, the cleaning liquid cannot directly hit the outer peripheral surface 56*a* of the inner peripheral side protrusion 56, and the cleaning liquid is difficult to reach. According to the present embodiment, even in a part of the outer peripheral surface 56*a* of the inner peripheral side protrusion 56 in which the cleaning liquid is difficult to reach, it is possible to make the cleaning liquid reach by using the Coanda effect, and a part of the outer peripheral surface 56*a* can be effectively cleaned.

As illustrated in FIG. 8, the outer peripheral surface 56*a* of the inner peripheral side protrusion 56 is formed to extend downward as the outer peripheral surface 56*a* goes toward the inside in the radial direction. Therefore, when a part of the cleaning liquid attempts to run along the outer peripheral surface 56*a* of the inner peripheral side protrusion 56 toward the inside in the radial direction, the part of the cleaning liquid easily run to the lower end portion of the inner peripheral side protrusion 56 without losing its momentum (see a direction De). For this reason, it becomes easy to clean the outer peripheral surface 56*a* of the inner peripheral side protrusion 56 by using the momentum of the cleaning liquid toward the inside in the radial direction.

The inner peripheral surface 58*a* of the outer peripheral side protrusion 58 is formed to extend downward as the inner peripheral surface 58*a* goes toward the outside in the radial direction. Therefore, when a part of the cleaning liquid attempts running along the inner peripheral surface 58*a* of the outer peripheral side protrusion 58 toward the outside in the radial direction, the part of the cleaning liquid easily runs to the lower end portion of the outer peripheral side protrusion 58 without losing its momentum (see a direction DO. For this reason, it becomes easy to clean the inner peripheral surface 58*a* of the outer peripheral side protrusion 58 by using the momentum of the cleaning liquid toward the outside in the radial direction.

Other features of the toilet device 10 will be described. As illustrated in FIG. 2, the toilet body 14 has a trap part 70 connected to the bottom of the toilet bowl 12. The trap part 70 constitutes a part of an discharging passage part for discharging cleaning water and dirt in the toilet bowl 12 to a sewage side water channel. An inner space of the trap part 70 communicates with the inner space of the toilet bowl 12 through an inlet 70*a* formed at the bottom of the toilet bowl 12. The trap part 70 according to the present embodiment is provided on the front side of the bottom of the toilet bowl 12. The trap part 70 has an ascending water channel part 70*b* and a descending water channel part 70*c* in order from the upstream side to the downstream side. The ascending water channel part 70*b* is provided to ascend toward a downstream side of the trap part 70. The descending water channel part 70*c* is provided to descend toward the downstream side of the trap part 70.

Pooled water 72 accumulates in the bottom of the toilet bowl 12 and the ascending water channel part 70*b* of the trap part 70. The pooled water 72 functions as sealing water that blocks a flow of air in a water passage direction in the ascending water channel part 70*b* of the trap part 70, and prevents a backflow of odors from the sewage side water passage.

Figure 10:
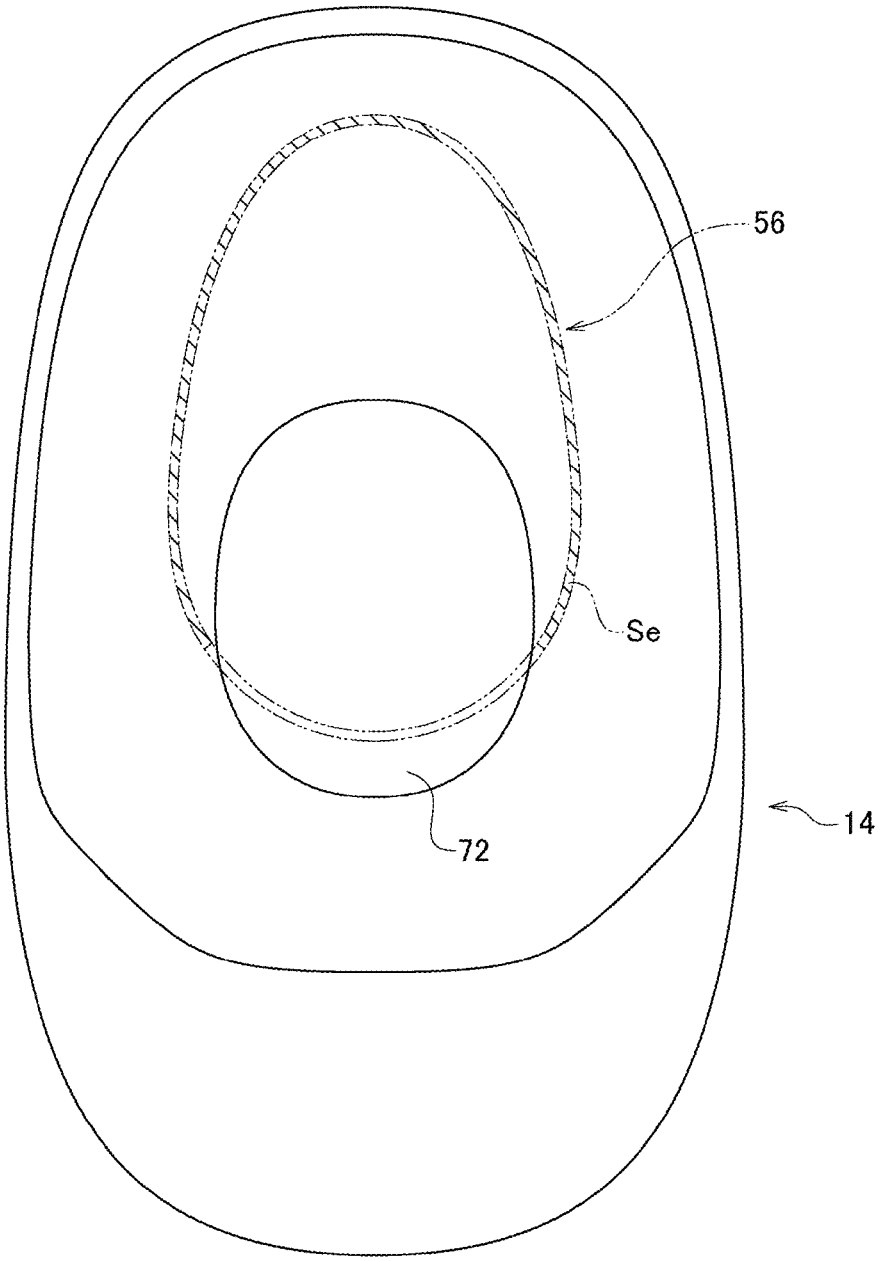
FIG. 10 is a diagram illustrating a positional relationship between an inner peripheral side protrusion of the toilet seat and pooled water according to the first embodiment.

FIG. 10 is a plan view of the toilet body 14 illustrating a positional relationship between the inner peripheral side protrusion 56 of the toilet seat 22 and the pooled water 72. In plan view, the inner peripheral side protrusion 56 is arranged at a location overlapping the toilet bowl 12 in the up-and-down direction Z at a location avoiding the pooled water 72 in a range Se where the cleaning liquid discharged from the seat back discharge parts 50A and 50B reaches. It can be said that the inner peripheral side protrusion 56 is to be provided at a location not overlapping the pooled water 72 in the up-and-down direction Z in the range Se where the cleaning liquid discharged from the seat back discharge parts 50A and 50B reaches. In the present embodiment, the range Se where the cleaning liquid reaches refers to the entire range from the rear portion of the left half region 38L and the right half region 38R of the first bowl facing surface 34 to the peripheral end portions 38La and 38Ra on the front side. As a result, after the cleaning of the toilet seat 22 with the cleaning liquid, even after a part of the cleaning liquid drips down from the inner peripheral side protrusion 56, it is difficult for the cleaning liquid to drop directly into the pooled water 72, and noise can be suppressed from occurring.

Figure 11:
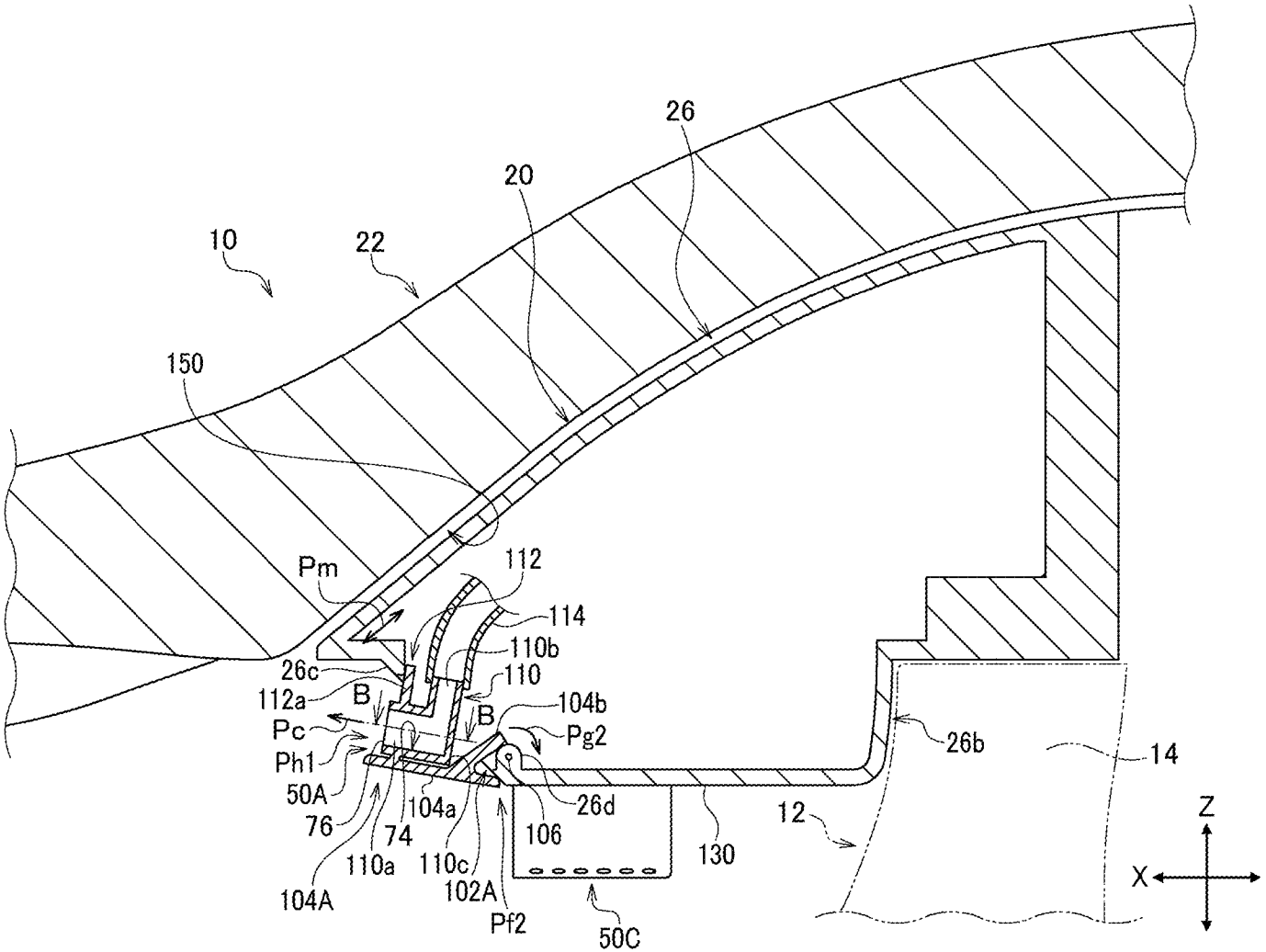
FIG. 11 is a side cross-sectional view of a first discharge part according to the first embodiment.
Figure 12A:
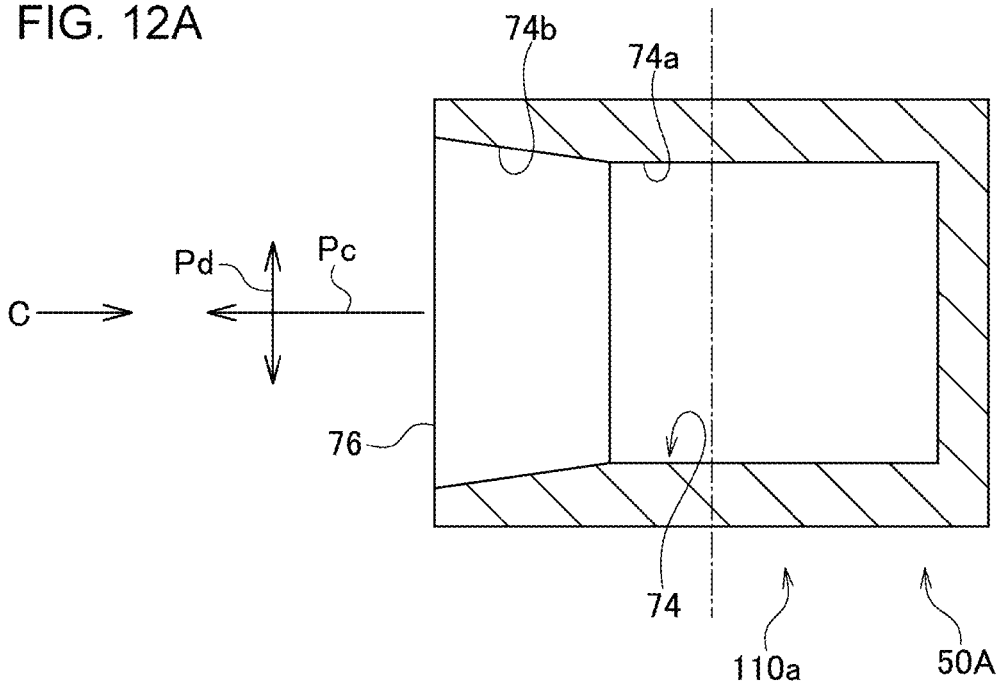
FIG. 12A is a cross-sectional view taken along the line B-B of FIG. 11 according to some embodiments.
Figure 12B:
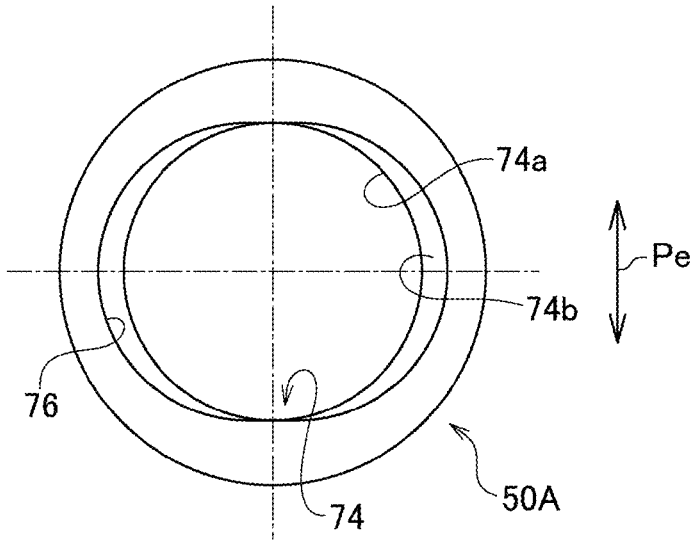
FIG. 12B is a view of FIG. 12A viewed from an arrow C according to some embodiments.

FIG. 11 is a side cross-sectional view of the first discharge part 50A. FIG. 12A is a cross-sectional view taken along the line B-B of FIG. 11, and FIG. 12B is a view of FIG. 12A viewed from an arrow C. Most of the first discharge part 50A and the second discharge part 50B have a common structure, and therefore the common structure will be described with reference to the drawing illustrating the first discharge part 50A. An discharge hole 74 for discharging the cleaning liquid is formed on the seat back discharge parts 50A and 50B. The discharge hole 74 has a first portion 74*a* on an upstream side and a second portion 74*b* connected to a downstream side of the first portion 74*a* and has a cleaning liquid outlet 76 formed at its downstream end portion.

The first portion 74*a* is formed so that the passage cross-sectional area has the same size toward the downstream side of the discharge hole 74. The first portion 74*a* according to the present embodiment is formed to extend linearly toward the downstream side of the discharge hole 74.

The second portion 74*b* is formed so that in the back surface view of the toilet seat 22, an inner width in a horizontal direction Pd is continuously widen as the second portion 74*b* approaches the cleaning liquid outlet 76. Here, the horizontal direction Pd refers to a direction orthogonal to the discharge direction Pc of the seat back discharge parts 50A and 50B described above, in the back surface view of the toilet seat 22. The second portion 74*b* is formed so that a passage cross-sectional area continuously increases toward the downstream side of the discharge hole 74. The cross section shape of the second portion 74*b* according to the present embodiment is an elliptical shape having the horizontal direction Pd as a major axis direction, and is formed so that a long diameter, which is a length in the major axis direction, increases as the second portion 74*b* approaches the cleaning liquid outlet 76. Note that the second portion 74*b* is formed so that inner widths in the direction Pe orthogonal to the discharge direction Pc and the horizontal direction Pd become the same size toward the cleaning liquid outlet 76.

Accordingly, the cleaning liquid flows in the second portion 74*b* of the discharge hole 74 while spreading in the direction Pd, and the cleaning liquid having a velocity component in the direction Pd can be discharged from the cleaning liquid outlet 76 of the discharge hole 74. Therefore, the cleaning liquid easily spreads in the direction Pd (see also FIGS. 6 and 7) while the cleaning liquid runs along the first bowl facing surface 34 of the toilet seat 22 in the discharge direction Pc, and the cleaning liquid easily reaches the wide range of the first bowl facing surface 34. In particular, there is an advantage that the cleaning liquid can easily be reached outside the region where the cleaning liquid can go straight from the locations Spa and Spb where the cleaning liquid starts running along the first bowl facing surface 34. This means that the cleaning liquid can easily run along the regions 88A and 88B in FIG. 9 described above, for example.

Figure 13:
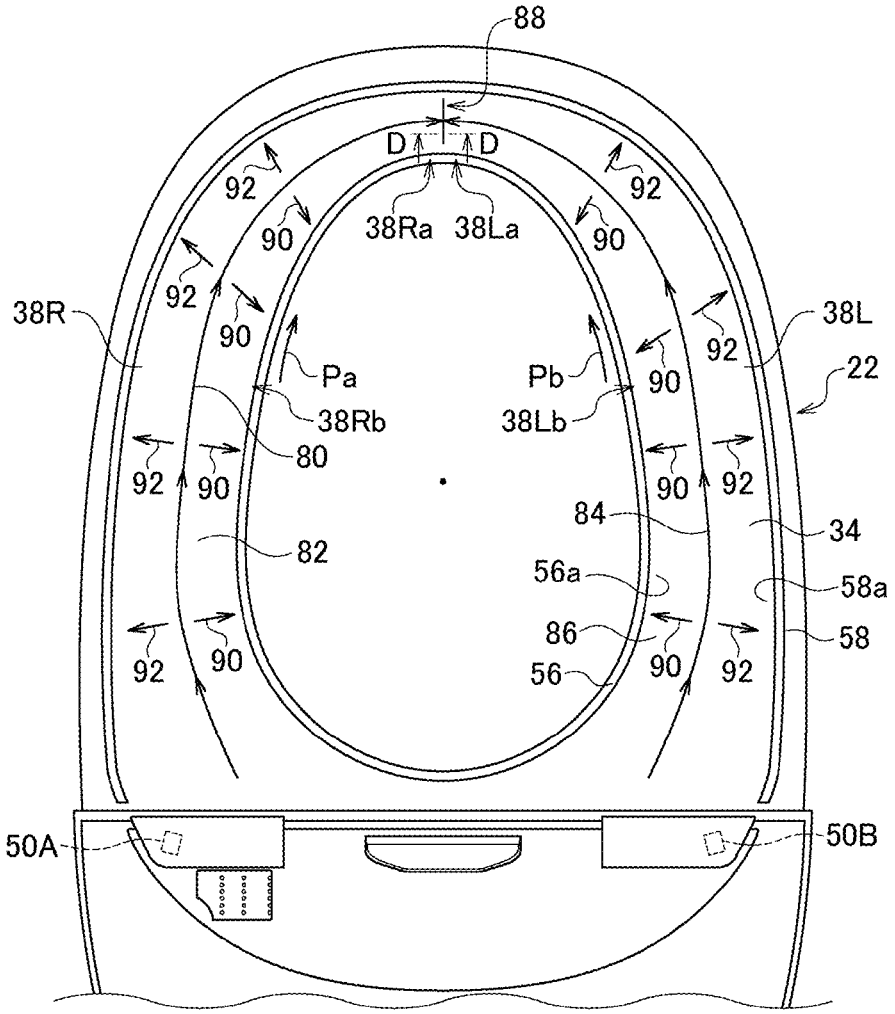
FIG. 13 is an explanatory diagram illustrating a gradient of a first bowl facing surface of the toilet seat according to the first embodiment.

Other features of the toilet device 10 will be described. FIG. 13 is an explanatory diagram illustrating a gradient of the first bowl facing surface 34 of the toilet seat 22. In FIG. 13, the direction in which the gradient goes from a high position to a low position is indicated by an arrow.

As illustrated in FIGS. 6 and 13, the first bowl facing surface 34 is provided with a first inclined surface 82 which becomes a downward gradient in a first gradient 80 toward the one side Pa in the circumferential direction in at least a part of the range in which the cleaning liquid discharged from the first discharge part 50A runs. The first inclined surface 82 according to the present embodiment is provided in a range including at least the central portion 38Rb of the right half region 38R of the first bowl facing surface 34 in the front-and-rear direction Y to the peripheral end portion 38Ra on the front side of the right half region 38R. The first inclined surface 82 according to the present embodiment is provided in the range from the rear end portion of the right half region 38R to the peripheral end portion 38Ra on the front side.

As illustrated in FIGS. 7 and 13, the first bowl facing surface 34 is provided with a second inclined surface 86 which becomes a downward gradient in a second gradient 84 toward the other side Pa in the circumferential direction in at least a part of the range in which the cleaning liquid discharged from the second discharge part 50B runs. The second inclined surface 86 according to the present embodiment is provided in a range including at least the central portion 38Lb of the left half region 38L of the first bowl facing surface 34 in the front-and-rear direction Y to the peripheral end portion 38La on the front side of the left half region 38L. The second inclined surface 86 according to the present embodiment is provided in the range from the rear end portion of the left half region 38L to the peripheral end portion 38La on the front side.

Figure 14:
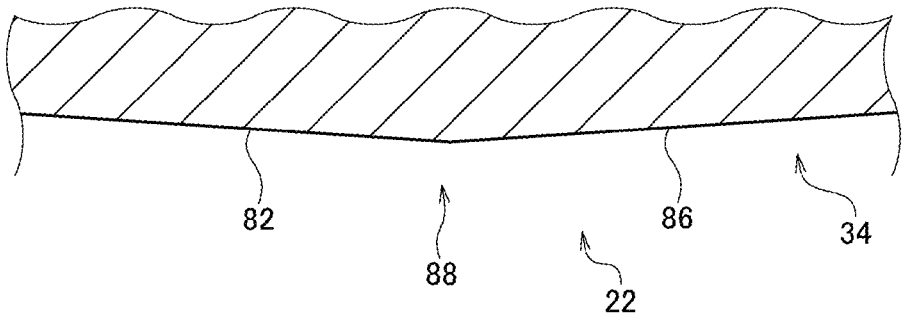
FIG. 14 is a cross-sectional view taken along the line D-D of FIG. 13 according to some embodiments.

FIG. 14 is a cross-sectional view taken along the line D-D of FIG. 13. The first bowl facing surface 34 of the toilet seat 22 is provided with a crest portion 88 that is constituted by a lower end portion of the first inclined surface 82 and a lower end portion of the second inclined surface 86. The crest portion 88 is provided on the first bowl facing surface 34 of the toilet seat 22 to have a downward convex shape. The crest portion 88 according to the present embodiment is provided so that the lower end portion of the first inclined surface 82 and the lower end portion of the second inclined surface 86 constitute a corner pointed downward.

The first inclined surface 82 and the second inclined surface 86 are provided with a third gradient 90 which becomes a downward gradient from the midway position of the first bowl facing surface 34 in the radial direction toward the inner peripheral edge portion of the first bowl facing surface 34. The third gradient 90 is provided on the outer peripheral surface 56*a* of the inner peripheral side protrusion 56. The first inclined surface 82 and the second inclined surface 86 are provided with a fourth gradient 92 which becomes a downward gradient from the midway position of the first bowl facing surface 34 in the radial direction toward the outer peripheral edge portion of the first bowl facing surface 34. The fourth gradient 92 is provided on the inner peripheral surface 58*a* of the outer peripheral side protrusion 58.

Figure 15A:
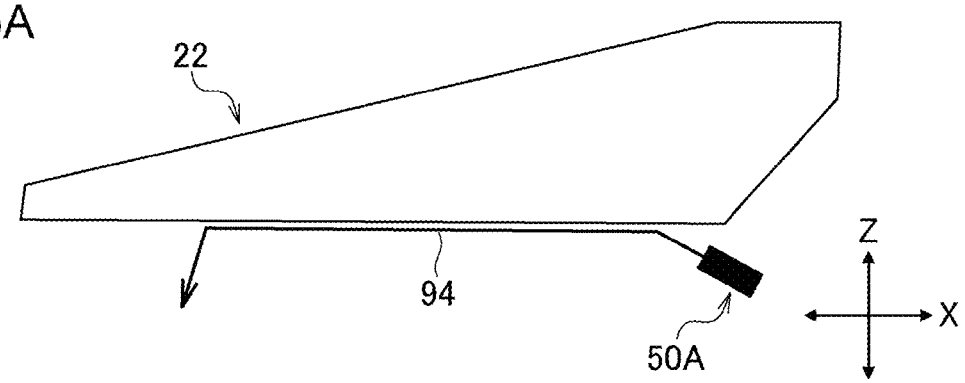
FIG. 15A is a diagram schematically illustrating a back surface of a toilet seat according to a first modification.
Figure 15B:
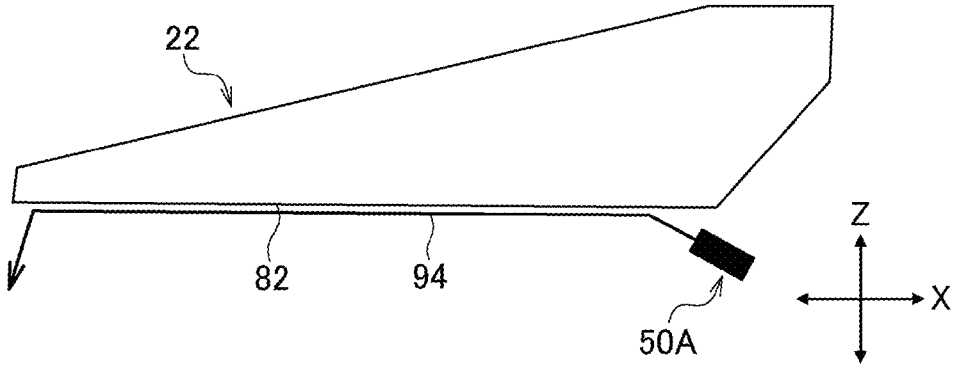
FIG. 15B is a schematic diagram of the back surface of the toilet seat according to the first embodiment.

The effects of the above features will be described. FIG. 15A is a diagram schematically illustrating the back surface of the toilet seat 22 of the first modification, and FIG. 15B is a diagram schematically illustrating the back surface of the toilet seat 22 of the first embodiment. The first inclined surface 82 is not provided on the back surface of the toilet seat 22 of the first modification. As illustrated in FIGS. 15A and 15B, when the back surface of the toilet seat 22 is provided with the inclined surface 82, the cleaning liquid 94 discharged from the first discharge part 50A easily runs along the back surface of the toilet seat 22. The reason will be described.

Figure 15C:
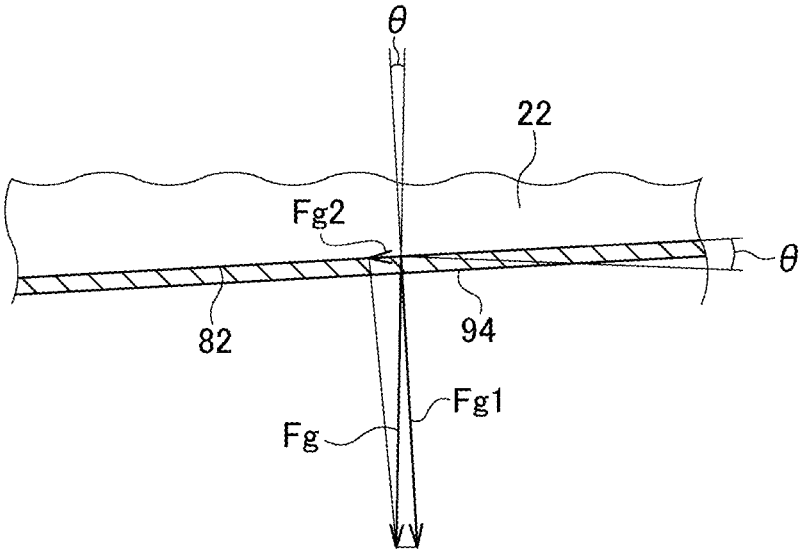
FIG. 15C is an enlarged view of a part of the back surface of the toilet seat of FIG. 15B according to some embodiments.

FIG. 15C is an enlarged view of a part of the back surface of the toilet seat 22 of FIG. 15B. The gravity due to the own weight of the cleaning liquid 94 is Fg, and the gravity Fg is decomposed into a force component Fg1 of the first inclined surface 82 in a normal direction and a force component Fg2 in a direction of a downward gradient that is parallel to the first inclined surface 82. At this time, the force component Fg2 having a magnitude obtained by multiplying a sine value (sin 0) of an angle θ formed by the first inclined surface 82 with respect to a horizontal plane and the gravity Fg acts on the cleaning liquid that runs along the first inclined surface 82. This means that, when the cleaning liquid runs along the first inclined surface 82 of the toilet seat 22, the cleaning liquid becomes to run easily in the direction (direction of the force component Fg2) in which the first inclined surface 82 becomes the downward gradient by using the gravity due to the own weight of the cleaning liquid. Therefore, according to the present embodiment, compared with the case where the toilet seat 22 does not have the first inclined surface 82, the cleaning liquid can easily reach the wide range of the back surface of the toilet seat 22.

In addition, the cleaning liquid runs along the second inclined surface 86 of the toilet seat 22, and therefore it becomes easy to run the cleaning liquid in the direction in which the second inclined surface 86 becomes the downward gradient by using the gravity due to the own weight of the cleaning liquid. Therefore, compared with the case where the toilet seat 22 does not have the second inclined surface 86, the cleaning liquid can easily reach the wide range of the back surface of the toilet seat 22.

From the viewpoint of obtaining these effects, the angle θ formed by the first inclined surface 82 with respect to the horizontal plane is preferably set within the range of 1° to 15°. When the angle θ is less than 1°, the force component Fg2 in the direction in which the first inclined surface 82 becomes the downward gradient becomes insufficient, and it becomes difficult to run the cleaning liquid in the direction which the first inclined surface 82 becomes the downward gradient. If the first gradient exceeds 15°, the dimension of the toilet seat 22 in the up-and-down direction Z becomes too large, which increases the size of the toilet seat 22. From this viewpoint, the angle θ is more preferably set within the range of 3° to 8°. For the same reason as the angle θ of the first inclined surface 82 with respect to the horizontal plane, the angle formed by the second inclined surface 86 with respect to the horizontal plane is preferably set within the range of 1° to 15°, and more preferably, within the range of 3° to 8°.

As illustrated in FIG. 14, the back surface of the toilet seat 22 is provided with the crest portion 88 at least a part which is constituted by the lower end portion of the first inclined surface 82 and the lower end portion of the second inclined surface 86. Therefore, the cleaning liquid running in the direction in which the first inclined surface 82 becomes the downward gradient or the cleaning liquid running in the direction in which the second inclined surface 86 becomes the downward gradient direction is easily drained in the crest portion 88. For this reason, it becomes easy to control so that a part of the cleaning liquid that runs along the first inclined surface 82 and the second inclined surface 86 falls into the toilet bowl 12 of the toilet body 14 below the vicinity of the crest portion 88. As a result, it becomes easier to control the location where the cleaning liquid adheres in the toilet bowl 12, and it becomes easier to clean the inside of the toilet bowl 12 with the cleaning liquid within the range including the location where the liquid adheres.

The first inclined surface 82 according to the present embodiment is provided in a range including at least the central portion Rb of the right half region 38R of the toilet seat 22 in the front-and-rear direction Y to the peripheral end portion 38Ra on the front side. Therefore, by using such a first inclined surface 82, the cleaning liquid easily reaches the peripheral end portion 38Ra on the front side of the right half region 38R which becomes the location where the cleaning liquid discharged from the first discharge part 50A is difficult to reach.

In addition, the second inclined surface 86 is provided in a range including at least the central portion Lb of the left half region 38L of the toilet seat 22 in the front-and-rear direction Y to the peripheral end portion 38La on the front side. Therefore, by using such a second inclined surface 86, the cleaning liquid easily reaches the peripheral end portion 38La on the front side of the left half region 38L which becomes the location where the cleaning liquid discharged from the second discharge part 50B is difficult to reach.

A second ingenuity of the toilet device 10 will be described. As illustrated in FIG. 2, the first casing 24 is arranged rearward of the toilet bowl 12 while avoiding a location overlapping the inner surface of the toilet bowl 12 in the up-and-down direction Z. A part of the second casing 26 is arranged at a location overlapping the inner surface of the toilet bowl 12 in the up-and-down direction.

Figure 16:
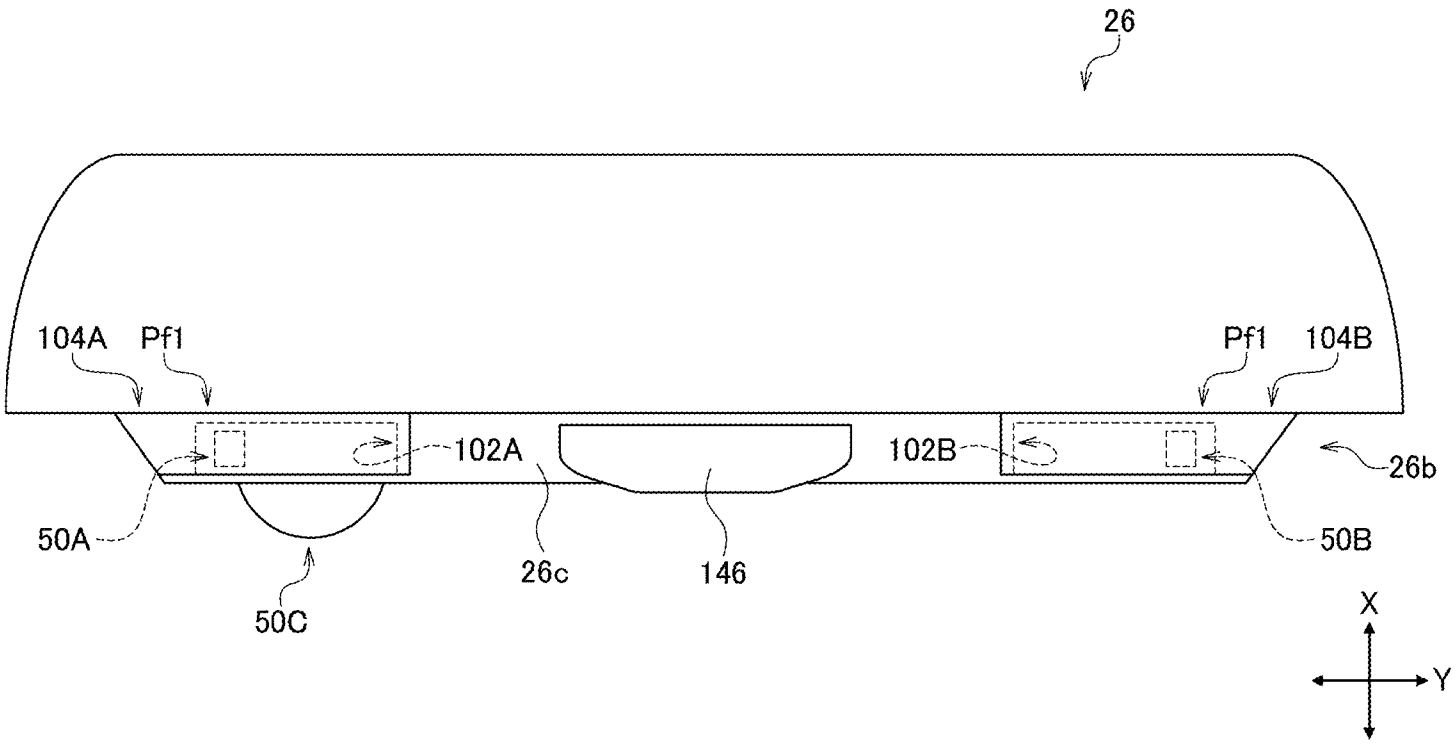
FIG. 16 is a front view of a second casing of FIG. 2 as viewed from the front according to some embodiments.
Figure 17:
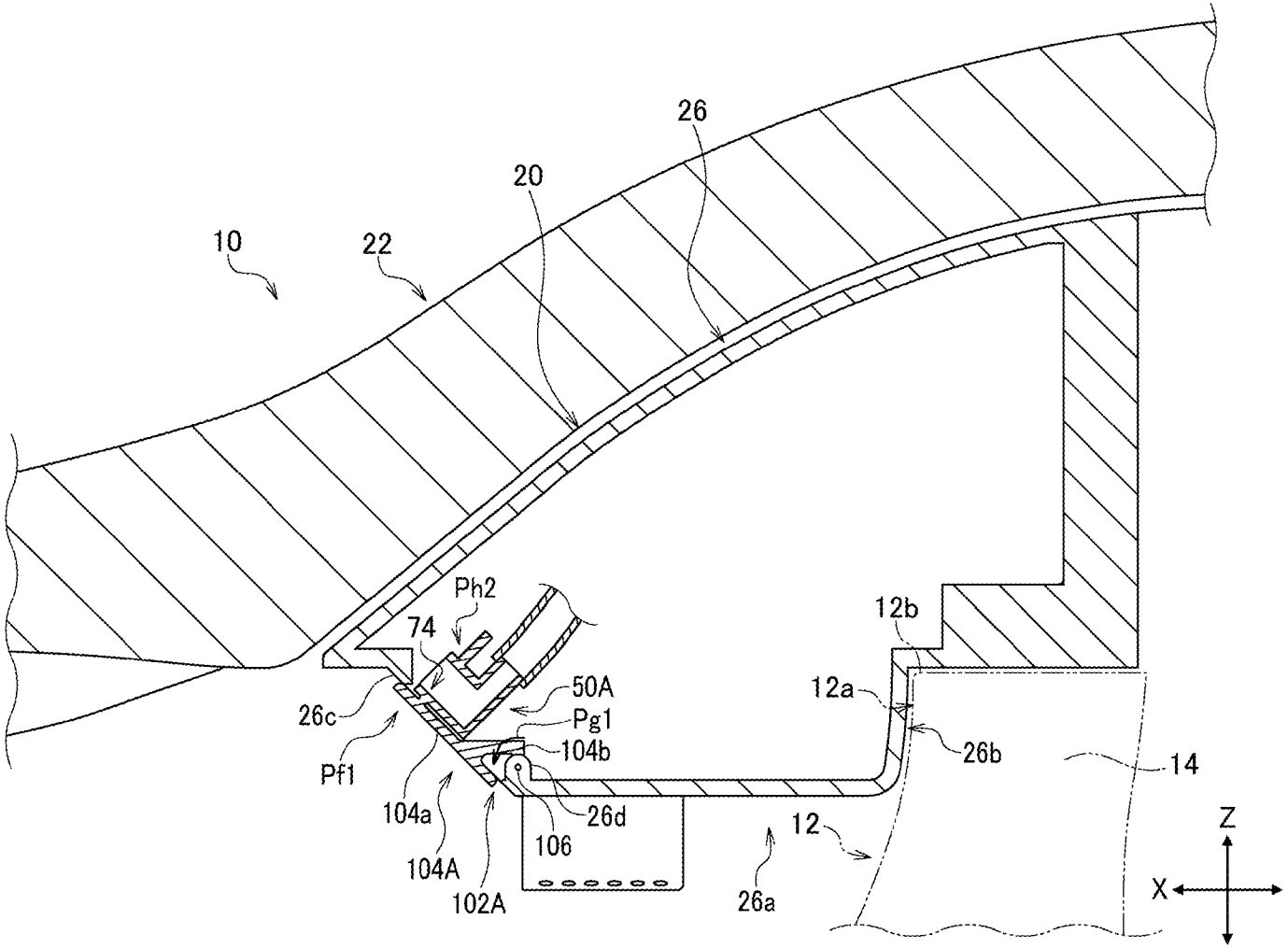
FIG. 17 is a side cross-sectional view of the second casing passing through a first discharge part of FIG. 16 according to some embodiments.

FIG. 16 is a front view of the second casing 26 of FIG. 2 as viewed from the front. FIG. 17 is a side cross-sectional view of the second casing 26 passing through the first discharge part 50A of FIG. 16. The second casing 26 functions as a housing member that houses the functional component therein. Here, the functional component is for exhibiting a predetermined function associated with the toilet device 10. The functional component includes the seat back discharge parts 50A and 50B described above, and on-off valves 126A, 126B, and 126D described later.

The second casing 26 has a stick-out portion 26*a* that sticks out above the inner surface of the toilet bowl 12 from the upper end opening 12*b* of the toilet bowl 12. The stick-out portion 26*a* is provided with a protruding portion 26*b* that protrudes downward from the stick-out portion 26*a*. The protruding portion 26*b* is arranged below the upper end opening 12*b* of the toilet bowl 12. A rear surface portion of the protruding portion 26*b* is formed in an outer shape that matches an outer shape of the inner peripheral surface of the upper end edge portion 12*a* of the toilet bowl 12, and is arranged along the inner peripheral surface thereof. The protruding portion 26*b* is fitted inside the rear portion of the upper end edge portion 12*a* of the toilet bowl 12. A front surface portion of the protruding portion 26*b* is provided with a slanted surface portion 26*c* facing obliquely downward toward the front side.

Figure 18:
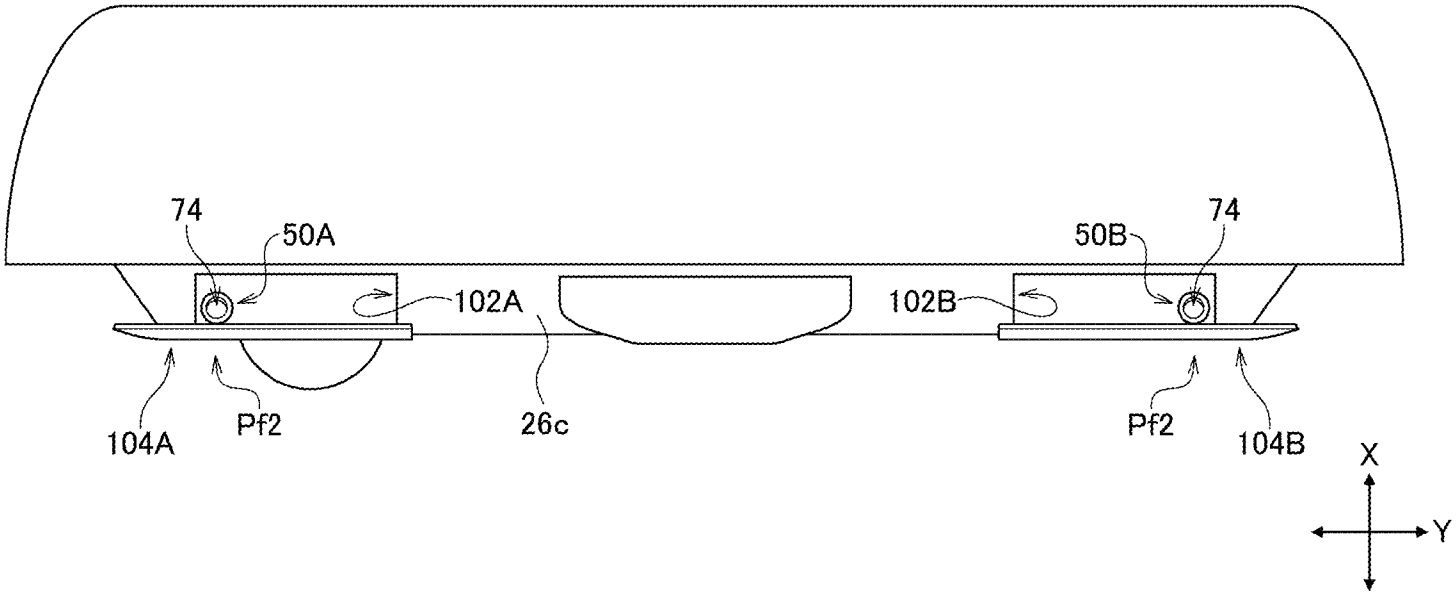
FIG. 18 is a diagram illustrating another state of the second casing of FIG. 16 according to some embodiments.
Figure 19:
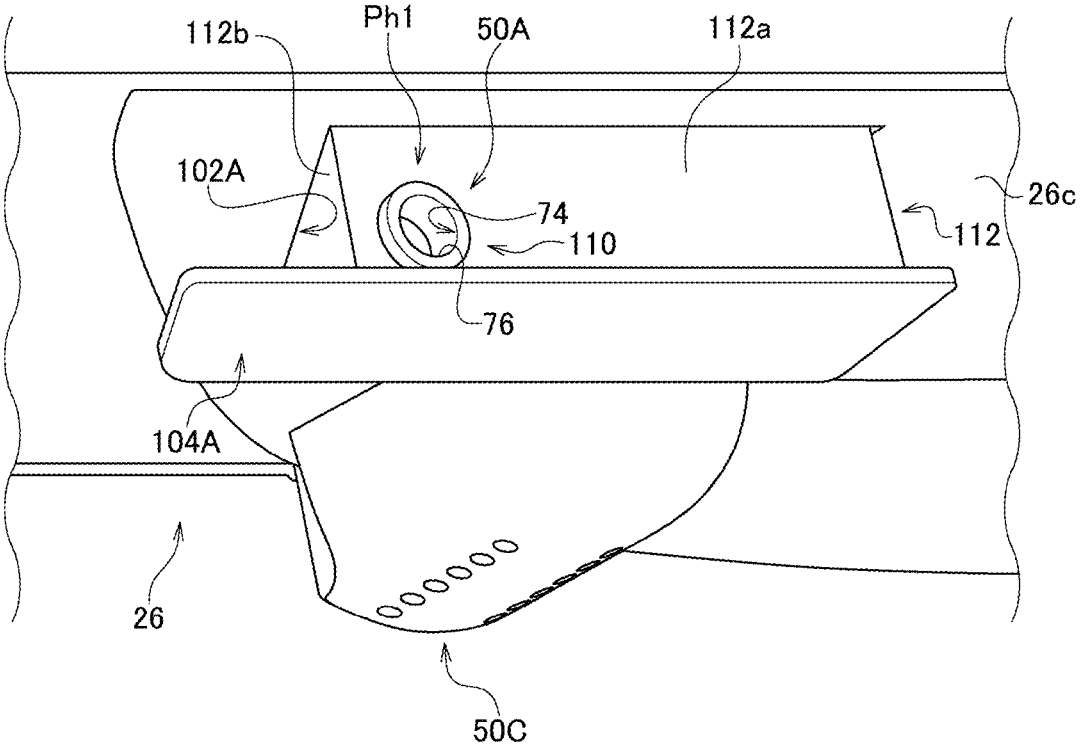
FIG. 19 is a perspective view of a configuration around the first discharge part of FIG. 18 viewed from the bottom according to some embodiments.

FIG. 18 is a diagram illustrating another state of the second casing 26 of FIG. 16. FIG. 11 is a side cross-sectional view of the second casing 26 passing through the first discharge part 50A of FIG. 18. FIG. 19 is a perspective view of a configuration around the first discharge part 50A of FIG.

18 viewed from the bottom. Hereinafter, this will be mainly described with reference to FIGS. 11 and 16 to 19.

A lower surface portion of the second casing 26 is provided with opening portions 102A and 102B. The opening portions 102A and 102B are provided on the slanted surface portion 26*c* of the second casing 26. The opening portions 102A and 102B include a first opening portion 102A corresponding to the first discharge part 50A and a second opening portion 102B corresponding to the second discharge part 50B. The first opening portion 102A is provided above the right half portion of the toilet body 14, and the second opening portion 102B is provided above the left half portion of the toilet body 14.

The toilet device 10 includes shutters 104A and 104B that can open and close the opening portions 102A and 102B of the second casing 26. The shutters 104A and 104B include a first shutter 104A corresponding to the first discharge part 50A and a second shutter 104B corresponding to the second discharge part 50B. The first shutter 104A can open and close the first opening portion 102A, and the second shutter 104B can open and close the second opening portion 102B. Most of the configurations of the first shutter 104A and the first opening portion 102A and the second shutter 104B and the second opening portion 102B are common, and the common configuration thereof will be described with reference to the drawings illustrating the former.

As illustrated in FIGS. 11 and 17, the shutters 104A and 104B are attached to the second casing 26 so that the opening portions 102A and 102B of the second casing 26 can be opened and closed. The shutters 104A and 104B have a main body portion 104*a* that can open and close the opening portions 102A and 102B, and a plurality of shaft fixing portions 104*b* that protrudes from a back surface of the main body portion 104*a*. In these drawings, only a single shaft fixing portion 104*b* is illustrated.

The main body portion 104*a* has a long plate shape in the left-and-right direction Y. A rotating shaft 106 penetrating through the shaft fixing portions 104*b* is fixed to tip portions of the plurality of shaft fixing portions 104*b*. The rotating shaft 106 is rotatably supported by a shaft support portion 26*d* that is provided inside the second casing 26. The shutters 104A and 104B according to the present embodiment are attached to the second casing 26 (housing member) to be rotatable around the rotating shaft 106 via the rotating shaft 106. The rotating shaft 106 according to the present embodiment extends along a horizontal direction. The shutters 104A and 104B rotate in one direction Pg1 around the rotating shaft 106 to open the opening portions 102A and 102B, and rotate in the opposite direction Pg2 to close the opening portions 102A and 102B.

The shutters 104A and 104B can move between concealed positions Pf1 (see FIGS. 16 and 17) where the discharge holes 74 of their corresponding discharge parts 50A and 50B are concealed from the outside, and exposed positions Pf2 (see FIGS. 11 and 18) where the discharge holes 74 are exposed to the outside. The shutters 104A and 104B according to the present embodiment close the opening portions 102A and 102B of the second casing 26 that the shutters 104A and 104B open and close when the shutters 104A and 104B are at the concealed position Pf1, and conceal the discharge hole 74 from the outside by closing the opening portions 102A and 102B. The shutters 104A and 104B according to the present embodiment open the opening portions 102A and 102B when the shutters 104A and 104B are at the exposed position Pf2, and open the opening portions 102A and 102B to expose the discharge hole 74 to the outside. When the shutters 104A and 104B are at the exposed position Pf2, it is possible to make the cleaning liquid discharged from the discharge hole 74 of the discharge parts 50A and 50B corresponding to the shutters 104A and 104B hit the back surface of the toilet seat 22.

As illustrated in FIG. 17, when the shutters 104A and 104B are at the concealed position Pf1, the shutters 104A and 104B regulate the entry of droplets from the outside into the discharge holes 74 of the corresponding discharge parts 50A and 50B. When the shutters 104A and 104B according to the present embodiment are at the concealed position Pf1, the shutters 104A and 104B regulate the entry of droplets from the outside into the opening portions 102A and 102B by closing the opening portions 102A and 102B that the shutters 104A and 104B open and close.

The shutters 104A and 104B according to the present embodiment come into contact with upper edge portions of the opening portions 102A and 102B that become a part of the opening portions 102A and 102B that the shutters 104A and 104B open and close, so the movable range of the shutters 104A and 104B is regulated and are held at the closed position where the opening portions 102A and 102B are closed. As illustrated in FIG. 11, the shutters 104A and 104B according to the present embodiment come into contact with lower edge portions of the opening portions 102A and 102B that become a part of the opening portions 102A and 102B that the shutters 104A and 104B open and close, so the movable range of the shutters 104A and 104B is regulated and are held at the opened position where the first opening portion 102A is opened.

As illustrated in FIG. 5, the toilet device 10 includes driving mechanisms 108A and 108B that can be driven to move the shutters 104A and 104B between the concealed position Pf1 and the exposed position Pf2. The driving mechanisms 108A and 108B include a first driving mechanism 108A corresponding to the first shutter 104A and a second driving mechanism 108B corresponding to the second shutter 104B. The driving mechanisms 108A and 108B are configured using a driving source such as a motor, for example. The driving mechanisms 108A and 108B according to the present embodiment are arranged inside the second casing 26. The driving mechanisms 108A and 108B according to the present embodiment drive the shutters 104A and 104B by rotating the shutters 104A and 104B around the rotating shaft 106 integrally with the rotating shaft 106.

As illustrated in FIGS. 11 and 17, the discharge parts 50A and 50B according to the present embodiment are integrated with the shutters 104A and 104B corresponding thereto. The term "integration" as used herein means that the above-described two elements can move integrally, and does not matter whether or not the two elements are a part of the same member. The discharge parts 50A and 50B according to the present embodiment are configured as a part of the same members as the shutters 104A and 104B corresponding thereto. As a result, the number of components can be reduced compared to the case where the discharge parts 50A and 50B and the shutters 104A and 104B are separate members, and the product cost can be reduced by reducing the assembling man-hours.

The discharge parts 50A and 50B are rotatably attached to the second casing 26 via the shutters 104A and 104B or the rotating shaft 106. The discharge parts 50A and 50B can move forward and backward with respect to the corresponding opening portions 102A and 102B by rotating around the rotating shaft 106. More specifically, the discharge parts 50A and 50B move to an advanced position Ph1 that advances outward from the opening portions 102A and 102B by rotating in one direction Pg1 around the rotating shaft 106. Further, the discharge parts 50A and 50B move to a retracted position Ph2 retracted inward from the opening portions 102A and 102B by rotating in the other direction Pg2 around the rotating shaft 106.

As illustrated in FIGS. 11 and 19, the discharge parts 50A and 50B include a hole forming part 110 in which the discharge hole 74 for discharging the cleaning liquid is formed, and a closing part 112 that closes the corresponding opening portions 102A and 102B when the discharge parts 50A and 50B are at the advanced position Ph1.

The hole forming part 110 includes an outlet side portion 110*a* in which the cleaning liquid outlet 76 from which the cleaning liquid flows out is formed at a downstream end portion, and an inlet side portion 110*b* that guides the cleaning liquid supplied from an upstream side to an outlet side portion 110*a* on a downstream side. The outlet side portion 110*a* and the inlet side portion 110*b* have a tubular shape. The outlet side portion 110*a* and the inlet side portion 110*b* according to the present embodiment are connected to each other via a bent portion 110*c* and extend linearly. The outlet side portion 110*a* extends in an in-plane direction of the plate-shaped shutters 104A and 104B. The inlet side portion 110*b* extends from the bent portion 110*c* in a direction away from the shutters 104A and 104B.

The outlet side portion 110*a* is provided with the above-described first portion 74*a* and second portion 74*b* (see FIG. 12). The outlet side portion 110*a* penetrates through a front wall portion 112*a* (described later) of the closing part 112 and is provided to protrude from the front wall portion 112*a*. A hose 114 in which a part of a liquid supplying path (described later) is formed is connected to the inlet side portion 110*b*. The hose 114 has flexibility and is housed inside the second casing 26.

The closing part 112 closes the entire opening portions 102A, 102B so that the droplets do not enter into the opening portions 102A, 102B corresponding to the discharge parts 50A, 50B from the outside when the discharge parts 50A, 50B are at the advanced position Ph1. The closing part 112 includes the front wall portion 112*a* extending along an axial direction (left-and-right direction Y) of the rotating shaft 106, and a side wall portion 112*b* extending from the axial end portion of the front wall portion 112*a* toward the opposite side of the discharge direction Pc of the discharge parts 50A and 50B.

The front wall portion 112*a* is provided so that the front wall portion 112*a* passes through a position facing, in the up-and-down direction Z, edge portions (upper edge portions in this example) of the opening portions 102A and 102B in the up-and-down direction when the discharge parts 50A and 50B move forward and backward through the opening portions 102A and 102B. The side wall portion 112*b* is provided so that the side wall portion 112*b* passes through a position facing, in the axial direction (left-and-right direction Y) of the above-described rotating shaft 106, the edge portions of the opening portions 102A and 102B in the left-and-right direction Y when the discharge parts 50A and 50B move forward and backward through the opening portions 102A and 102B.

The effects of the second ingenuity will be described. According to the toilet device 10 described above, the shutters 104A and 104B positioned at the concealed position Pf1 conceal the discharge holes 74 of the discharge parts 50A and 50B, so droplets can be prevented from entering the discharge hole 74 and a good hygiene can be obtained.

The shutters 104A and 104B close the opening portions 102A and 102B of the second casing 26 when the shutters 104A and 104B are at the concealed position Pf1. Therefore, it is possible to prevent the droplets from entering the second casing 26 by the shutters 104A and 104B and obtain the better hygiene.

The discharge parts 50A and 50B can move forward and backward with respect to the opening portions 102A and 102B of the second casing 26 by rotating around the rotating shaft 106. Therefore, compared with the structure (see FIG. 39) in which the discharge parts 50A, 50B move forward and backward through the opening portions 102A and 102B of the second casing 26 by making the discharge parts 50A, 50B go straight, it is possible to reduce the dimension of the discharge parts 50A and 50B in a forward/backward direction Pm. As a result, the space required for housing the discharge parts 50A and 50B in the second casing 26 (housing member) can be reduced.

The discharge parts 50A and 50B have the closing part 112 that closes the opening portions 102A and 102B corresponding to the discharge parts 50A and 50B when the discharge parts 50A and 50B are at the advanced position Ph1. Therefore, even when the discharge parts 50A and 50B are at the advanced position Ph1, it is possible to prevent droplets from entering the opening portions 102A and 102B of the second casing 26 and obtain the better hygiene.

Figure 20:
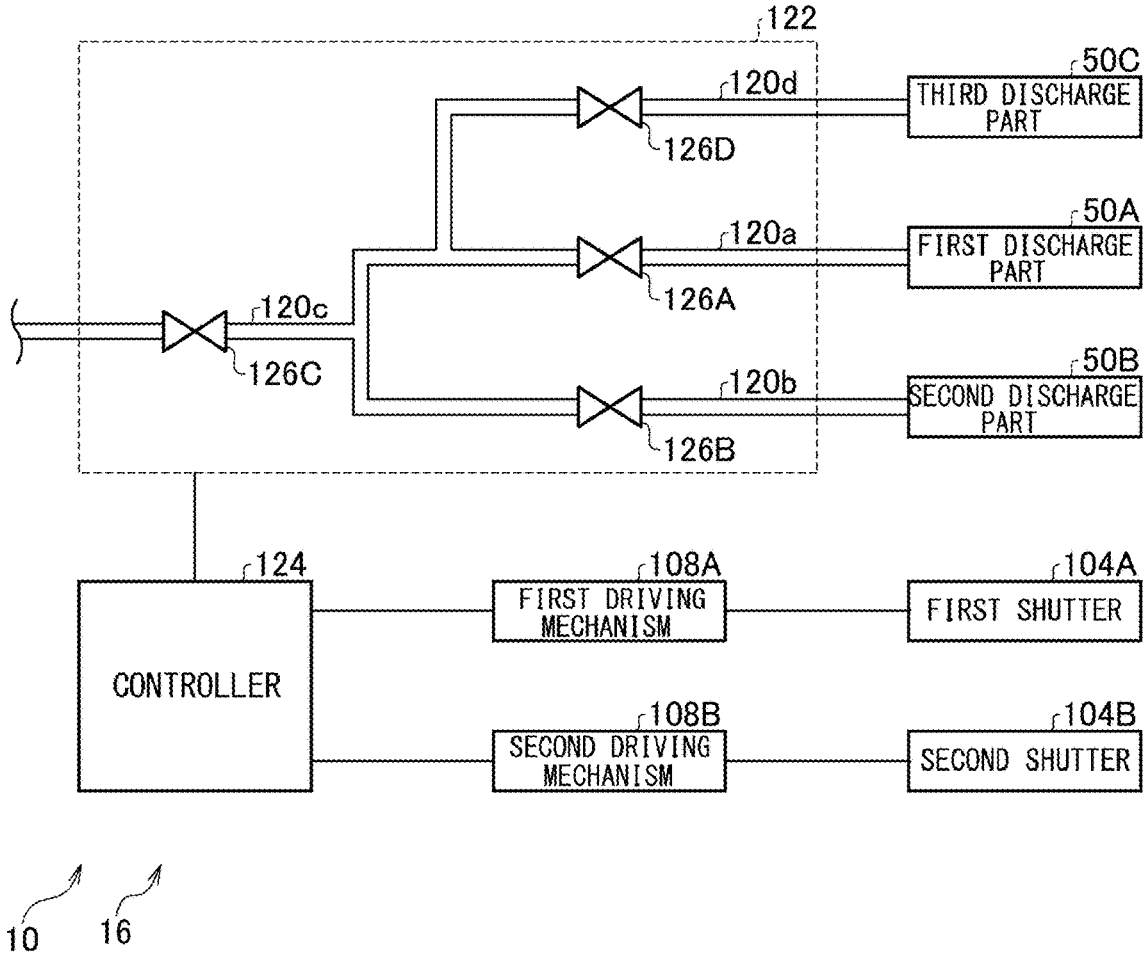
FIG. 20 is a block diagram illustrating a part of a function of the toilet device according to the first embodiment.

A third ingenuity of the toilet device 10 will be described. FIG. 20 is a block diagram illustrating a part of the function of the toilet device 10. The toilet device 10 (toilet seat unit 16) according to the present embodiment further includes a liquid supplying path 120, a switching mechanism 122, and a controller 124.

As illustrated in FIGS. 5 and 20, the liquid supplying path 120 serves as a passage for the cleaning liquid supplied from a liquid supplying source (not illustrated) such as a tank to the discharge parts 50A and 50B. The liquid supplying path 120 is constituted by a liquid passage forming member such as a hose. The liquid supplying path 120 has a first liquid passage 120*a* for supplying a cleaning liquid to the first discharge part 50A and a second liquid passage 120*b* for supplying the cleaning liquid to the second discharge part 50B. The liquid supplying path 120 according to the present embodiment has a common liquid passage 120*c* to which the cleaning liquid is supplied from the upstream side, and the common liquid passage 120*c* branches into a first liquid passage 120*a* and a second liquid passage 120*b*.

The switching mechanism 122 can switch whether or not the cleaning liquid supplied through the liquid supplying path 120 is supplied to the plurality of discharge parts 50A and 50B. The switching mechanism 122 according to the present embodiment includes a first open-close valve 126A that is provided on the middle of the first liquid passage 120*a*, a second open-close valve 126B that is provided on the middle of the second liquid passage 120*b*, and a common open-close valve 126C that is provided on the common liquid passage 120*c*. The first open-close valve 126A and the second open-close valve 126B are housed in the second casing 26.

The common open-close valve 126C is arranged outside the second casing 26. Although not illustrated, the common open-close valve 126C according to the present embodiment is housed inside the toilet body 14. Since the common open-close valve 126C closes the common liquid passage 120*c*, the supply pressure applied to the cleaning liquid does not act on the first open-close valve 126A or the second open-close valve 126B. As a result, each open-close valves 126A and 126B can be downsized, and the second casing 26 that houses the open-close valves 126A and 126B can be downsized.

The switching mechanism 122 can switch the supply state of the cleaning liquid to the plurality of discharge parts 50A and 50B to any of a next supply stop state, a first supply state and a second supply state by switching the open-close state of the plurality of open-close valves 126A to 126C. When the switching mechanism 122 is in the first supply state, the cleaning liquid supplied to the first discharge part 50A is discharged from the first discharge part 50A. When the switching mechanism is in the second supply state, the cleaning liquid supplied to the second discharge part 50B is discharged from the second discharge part 50B. (Supply Stop State) The state in which the supply of the cleaning liquid stops. (First Supply State) The state in which the cleaning liquid is supplied to the first discharge part 50A through the first liquid passage 120*a* of the liquid supplying path 120. (Second Supply State) The state in which the cleaning liquid is supplied to the second discharge part 50B through the second liquid passage 120*b* of the liquid supplying path 120.

When the switching mechanism 122 according to the present embodiment is in the supply stop state, the common open-close valve 126C closes the common liquid passage 120*c* of the liquid supplying path 120. When the switching mechanism is in the first supply state, the common open-close valve 126C opens the common liquid passage 120*c*, the first open-close valve 126A opens the first liquid passage 120*a*, and the second open-close valve 126B closes the second liquid passage 120*b*. When the switching mechanism is in the second supply state, the common open-close valve 126C opens the common liquid passage 120*c*, the second open-close valve 126B opens the second liquid passage 120*b*, and the first open-close valve 126A closes the first liquid passage 120*a*.

The controller 124 can control some components of the toilet device 10. The controller 124 according to the present embodiment can control the switching mechanism 122. The controller 124 is a one-chip microcomputer or the like, and is structured by a combination of a CPU, a RAM, a ROM, and the like. The controller 124 according to the present embodiment is arranged outside the second casing 26.

When the predetermined cleaning start condition is satisfied, the controller 124 controls the switching mechanism 122 to execute the cleaning operation for cleaning the back surface of the toilet seat 22. The cleaning start condition includes a condition that a cleaning start command is received through an operation on an operation member such as a lever or an electric device such as a remote controller or a smartphone.

The controller 124 executes the cleaning operation once by controlling the switching mechanism 122 to go through the following series of operations. This series of operations means to maintain the first supply state in which the cleaning liquid is supplied to the first discharge part 50A over a predetermined first liquid supplying time, and then to maintain the second supply state in which the cleaning liquid is supplied to the second discharge part 50B over a predetermined second liquid supplying time. The operation of discharging, by the first discharge part 50A, the cleaning liquid so that the cleaning liquid runs along the back surface of the toilet seat 22 is referred to as the first discharge operation, and the operation of discharging, by the second discharge part 50B, the cleaning liquid so that the cleaning liquid runs along the back surface is referred to as the second discharge operation. At this time, it can be considered that the controller 124 according to the present embodiment controls the switching mechanism 122 not to execute the first discharge operation during the execution of the second discharge operation, and not to execute the second discharge operation during the execution of the first discharge operation in the one-time cleaning operation. Here, the "discharge operation, by the discharge parts 50A and 50B, the cleaning liquid so that the cleaning liquid runs along the back surface of the toilet seat 22" does not include the operation of discharging, by the discharge parts 50A and 50B, the cleaning liquid that flows down without running along the back surface of the toilet seat 22.

It can be considered that the controller 124 controls the switching mechanism 122 to end the first supply state in which the cleaning liquid is supplied to the first discharge part 50A and then start the second supply state in which the cleaning liquid is supplied to the second discharge part 50B. It can be considered that the toilet device 10 (toilet seat unit 16) is structured to end the first discharge operation and then start the second discharge operation.

At this time, the controller 124 controls the switching mechanism 122 to end the first supply state and start the second supply state after a predetermined waiting time lapses. It can be considered that the controller 124 controls the switching mechanism 122 to end the above-described first discharge operation and then start the second discharge operation after the waiting time lapses. This waiting time is set for avoiding a collision between the cleaning liquid discharged from the first discharge part 50A and the cleaning liquid discharged from the second discharge part 50B on the back surface of the toilet seat 22. This waiting time is set to, for example, 0.5 seconds or more and 3.0 seconds or less, preferably 1.0 second or more and 2.0 seconds or less.

Figure 21A:
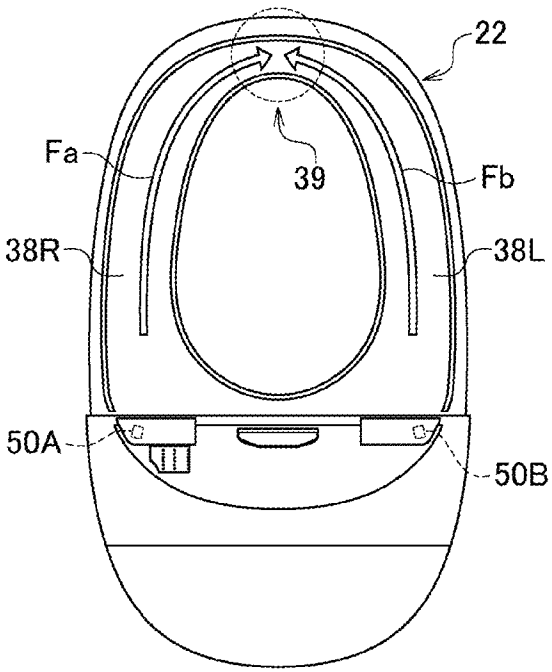
FIG. 21A is a diagram illustrating a state in which a first discharge operation and a second discharge operation are being performed simultaneously according to some embodiments.

The effects of the third ingenuity will be described. FIG. 21A is a diagram illustrating a state in which the first discharge operation and the second discharge operation are simultaneously executed. In this case, there is a possibility that the first seat back flow Fa formed by the cleaning liquid discharged from the first discharge part 50A and the second seat back flow Fb formed by the cleaning liquid discharged from the second discharge part 50B can collide with each other on the back surface of the toilet seat 22. In the present embodiment, there is a possibility of collision mainly in the front end region 39 of the back surface of the toilet seat 22.

Figure 21B:
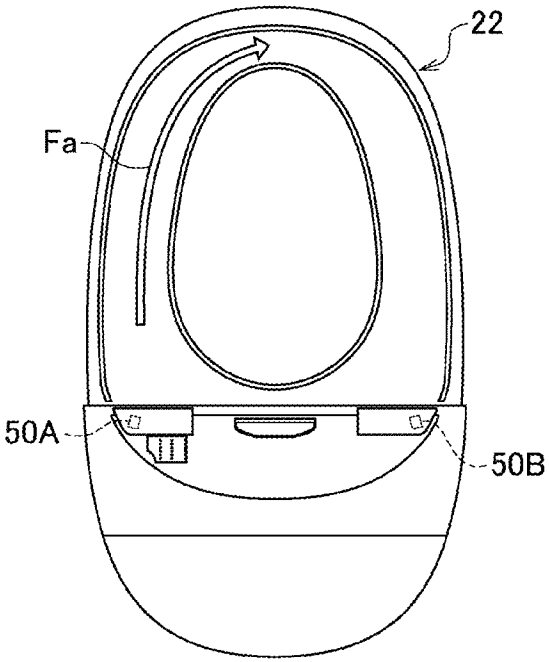
FIG. 21B is a diagram illustrating a state in which only the first discharge operation is being performed according to some embodiments.
Figure 21C:
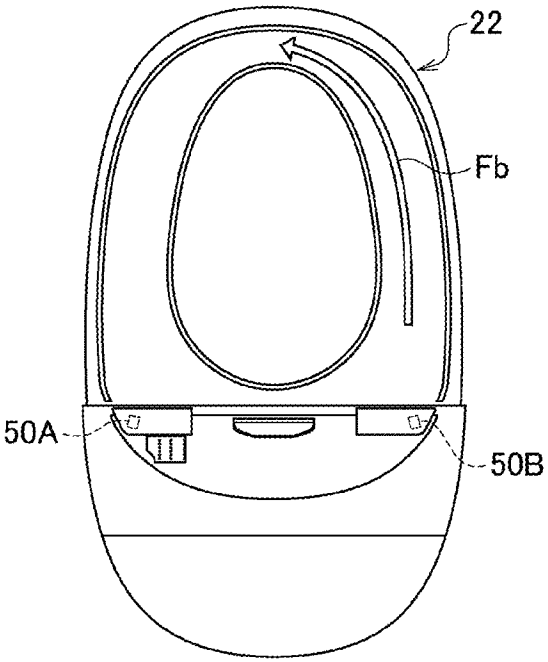
FIG. 21C is a diagram illustrating a state in which only the second discharge operation is being performed according to some embodiments.

On the other hand, the toilet seat unit 16 is structured to end the first discharge operation as illustrated in FIG. 21B and then start the second discharge operation as illustrated in FIG. 21C. As a result, even if the cleaning liquid discharged from the first discharge part 50A and the cleaning liquid discharged from the second discharge part 50B collide with each other, the collision time can be shortened. Therefore, it is possible to suppress the occurrence of droplets due to the collision of the cleaning liquids discharged from the plurality of discharge parts 50A and 50B.

The plurality of discharge parts 50A and 50B include a first discharge part 50A and a second discharge part 50B that discharge the cleaning liquid so that the cleaning liquid runs along the back surface of the toilet seat 22 in an opposite direction to each other in the circumferential direction. Therefore, there is an advantage that the first seat back flow Fa and the second seat back flow Fb can be formed to run along the regions that partially overlap each other on the back surface of the toilet seat 22, and the regions can be effectively cleaned.

Other features related to the third ingenuity will be described. As described above, the toilet device 10 (toilet seat unit 16) includes the first shutter 104A corresponding to the first discharge part 50A and the second shutter 104B corresponding to the second discharge part 50B, as illustrated in FIGS. 5 and 20. The toilet device 10 includes a first driving mechanism 108A corresponding to the first shutter 104A and a second driving mechanism 108B corresponding to the second shutter 104B. The driving mechanisms 108A and 108B can drive the shutters 104A and 104B corresponding thereto. The controller 124 described above can also control the first driving mechanism 108A or the second driving mechanism 108B.

Figure 22A:
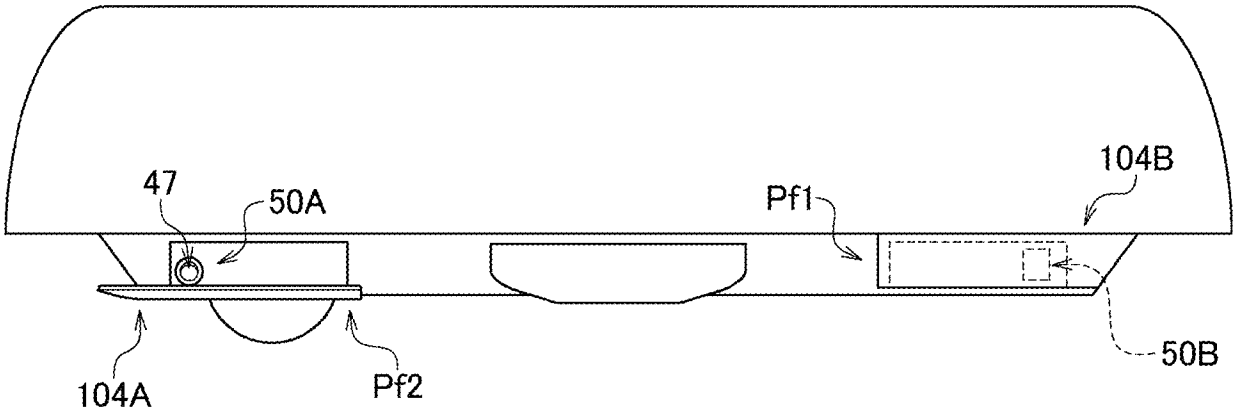
FIG. 22A is a diagram illustrating operation states of a first shutter and a second shutter according to some embodiments.
Figure 22B:
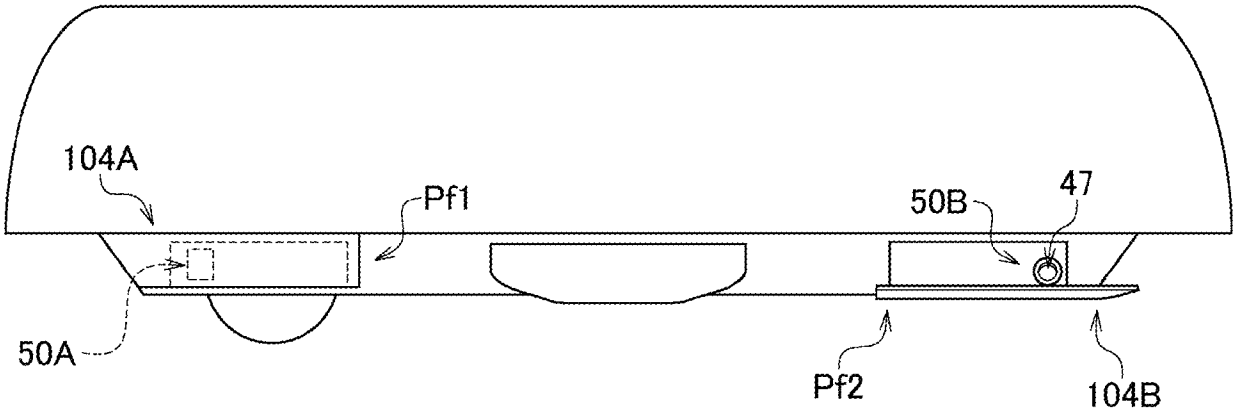
FIG. 22B is a diagram illustrating other operating states according to some embodiments.

FIG. 22A is a diagram illustrating operation states of the first shutter 104A and the second shutter 104B, and FIG. 22B is a diagram illustrating other operating states. As illustrated in FIG. 22A, the controller 124 controls the second driving mechanism 108B to move the second shutter 104B to the concealed position Pf1 when the first discharge part 50A is discharging the cleaning liquid. At this time, the controller 124 controls the first driving mechanism 108A to move the first shutter 104A to the exposed position Pf2.

Further, as illustrated in FIG. 22B, the controller 124 controls the first driving mechanism 108A to move the first shutter 104A to the concealed position Pf1 when the second discharge part 50B is discharging the cleaning liquid. At this time, the controller 124 controls the second driving mechanism 108B to move the second shutter 104B to the exposed position Pf2.

As a result, when one of the first discharge part 50A and the second discharge part 50B is discharging the cleaning liquid, it becomes difficult for the droplets of the cleaning liquid to enter the discharge hole 74 of the other of the first and second discharge parts 50A and 50B and it is possible to obtain the good hygiene.

Note that the controller 124 may control the switching mechanism 122 to complete the movement of the first shutter 104A from the concealed position Pf1 to the exposed position Pf2 and then start the first supply state in which the cleaning liquid is discharged from the first discharge part 50A. In addition, the controller 124 may control the switching mechanism 122 to complete the movement of the second shutter 104B from the exposed position Pf2 to the concealed position Pf1 and then start the first supply state in which the cleaning liquid is discharged from the first discharge part 50A.

Figure 23B:
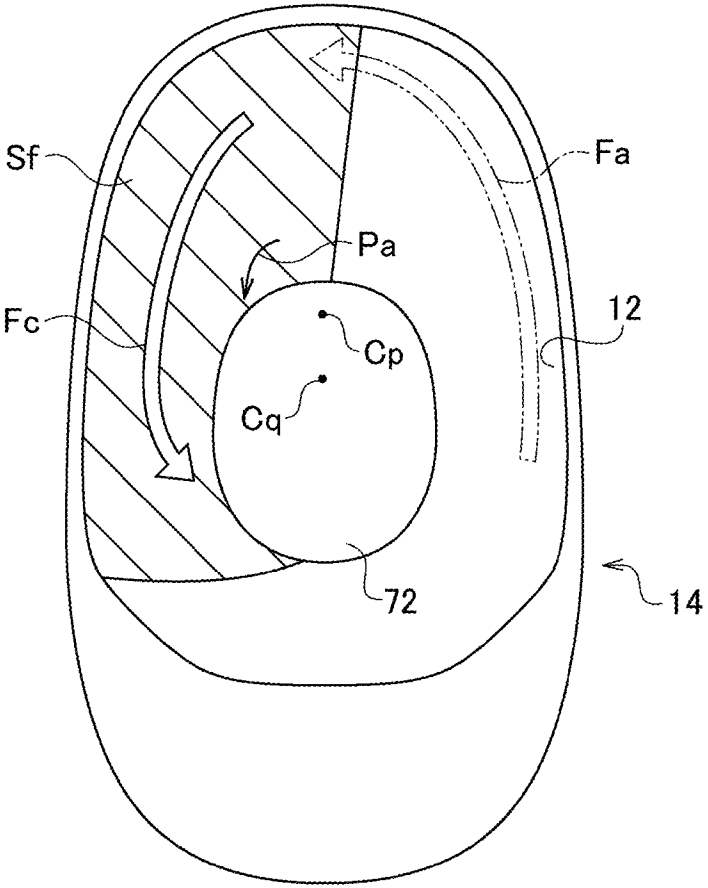
FIG. 23B is an explanatory diagram illustrating a first in-bowl flow according to some embodiments.
Figure 23A:
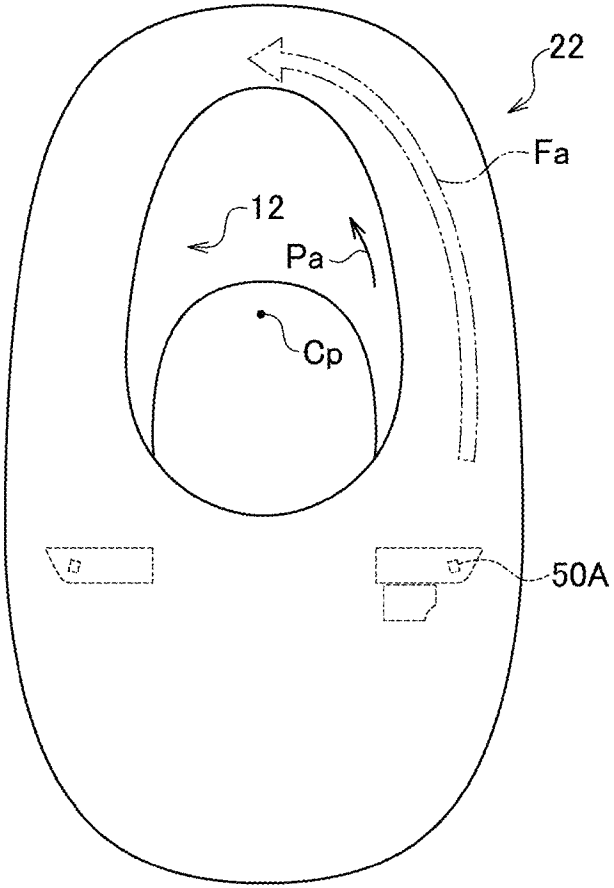
FIG. 23A is an explanatory diagram illustrating a first seat back flow according to some embodiments.
Figure 24B:
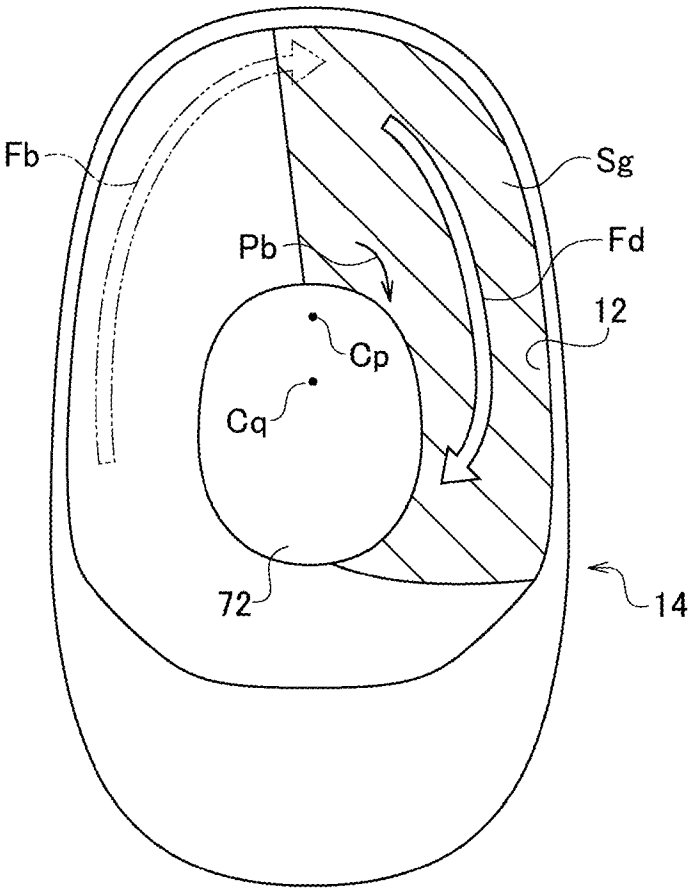
FIG. 24B is an explanatory diagram illustrating a second in-bowl flow according to some embodiments.
Figure 24A:
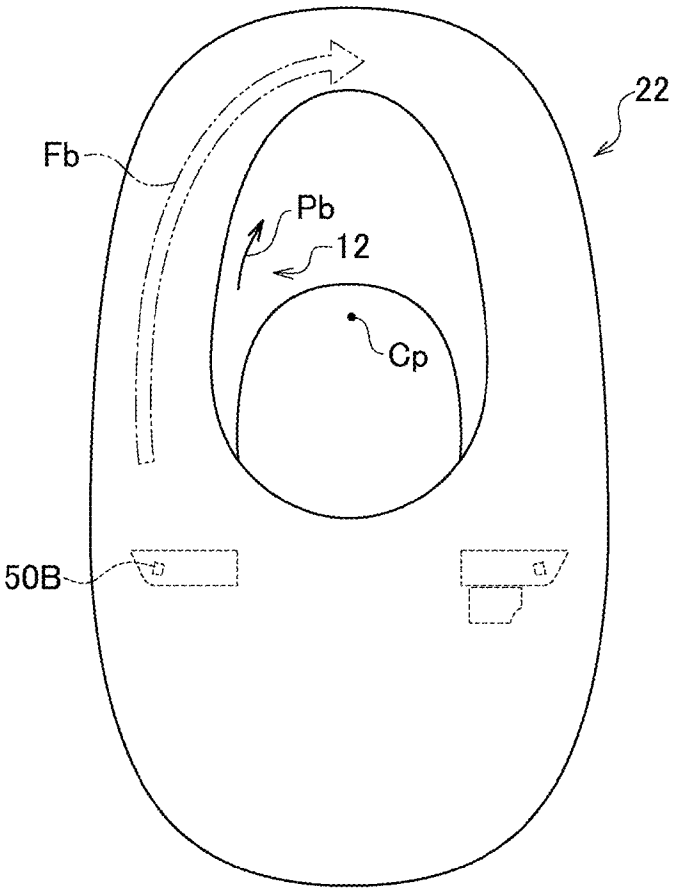
FIG. 24A is an explanatory diagram illustrating a second seat back flow according to some embodiments.

A fourth ingenuity of the toilet device 10 will be described. FIG. 23A is an explanatory diagram illustrating the first seat back flow Fa, and FIG. 23B is an explanatory diagram illustrating the first in-bowl flow Fc. FIG. 24B is an explanatory diagram illustrating the second seat back flow Fb, and FIG. 24 is an explanatory diagram illustrating the second in-bowl flow Fd. FIGS. 23A and 24A are plan views of the toilet seat 22 and the toilet body 14, and FIGS. 24B and 24B are plan views of the toilet body 14.

The toilet device 10 (toilet seat unit 16) is structured to satisfy the following condition (a). The condition (a) is to satisfy the following condition (a1) and condition (a2). As illustrated in FIGS. 6 and 23A, the condition (a1) is to form the first seat back flow Fa that runs along the one side Pa in the circumferential direction on the back surface of the toilet seat 22 by the cleaning liquid discharged from the first discharge part 50A. As illustrated in FIG. 23B, the condition (a2) is to form the first in-bowl flow Fc swirling to the one side Pa in the circumferential direction within the toilet bowl 12 of the toilet body 14 by using the cleaning liquid forming the first seat back flow Fa. FIG. 23B illustrates a main range Sf in which the cleaning liquid forming the first seat back flow Fa runs within the toilet bowl 12.

In addition, the toilet device 10 (toilet seat unit 16) is structured to satisfy the following condition (b). The condition (b) is to satisfy the following condition (b1) and condition (b2). As illustrated in FIGS. 7 and 24A, the condition (b1) is to form the second seat back flow Fb that runs along the other side Pb in the circumferential direction on the back surface of the toilet seat 22 by the cleaning liquid discharged from the second discharge part 50B. As illustrated in FIG. 24B, the condition (b2) is to form the second in-bowl flow Fd swirling toward the other side Pb in the circumferential direction within the toilet bowl 12 of the toilet body 14 by using the cleaning liquid forming the second seat back flow Fb. FIG. 24B illustrates a main range Sg in which the cleaning liquid forming the second seat back flow Fb runs within the toilet bowl 12.

The first seat back flow Fa according to the present embodiment is formed in a range including the rear portion of the right half region 38R of the back surface of the toilet seat 22 to the peripheral end portion 38Ra on the front side (see FIG. 6). The second seat back flow Fb according to the present embodiment is formed in a range including the rear portion of the left half region 38L of the back surface of the toilet seat 22 to the peripheral end portion 38La on the front side. Most of the cleaning liquid that forms the first seat back flow Fa and the second seat back flow Fb drips down with a horizontal velocity component on the back surface of the toilet seat 22. As described above, most of the cleaning liquid according to the present embodiment flows down from the crest portion 88 provided on the back surface of the toilet seat 22 and the vicinity of the crest portion 88.

The cleaning liquid that forms the seat back flows Fa and Fb flows down from the back surface of the toilet seat 22, hits the inner surface of the toilet bowl 12, and then flows with the momentum of the horizontal velocity component, thereby forming the in-bowl flows Fc and Fd. In plan view, the center Cq of the upper end opening of the toilet bowl 12 is referred to as the center Cq of the toilet bowl 12. The first in-bowl flow Fc according to the present embodiment is formed to flow from the front region in front of the center Cq of the toilet bowl 12 to the bottom of the toilet bowl 12 via the left half region on the left side of the center Cq of the toilet bowl 12 (see FIG. 23B). The second in-bowl flow Fd according to the present embodiment is formed to flow from the front region of the toilet bowl 12 to the bottom of the toilet bowl 12 via the right half region on the right side of the center Cq of the toilet bowl 12 (see FIG. 24B).

In order to satisfy the condition (a), at least the discharge direction of the cleaning liquid of the first discharge part 50A and the relative position of the first discharge part 50A with respect to the toilet seat 22 are set so that the cleaning liquid discharged from the first discharge part 50A runs along the one side Pa of the back surface of the toilet seat 22 in the circumferential direction. In order to satisfy the condition (b), at least the discharge direction of the cleaning liquid of the second discharge part 50B and the relative position of the second discharge part 50B with respect to the toilet seat 22 are set so that the cleaning liquid discharged from the second discharge part 50B runs along the other side Pb of the back surface of the toilet seat 22 in the circumferential direction. If the seat back flows Fa and Fb can be formed in this way, the cleaning liquid forming the seat back flows Fa and Fb flows down from the back surface of the toilet seat 22, and the flowing down cleaning liquid can flow in the toilet bowl 12 to form the in-bowl flows Fc and Fd.

As a result, it is possible to form the first in-bowl flow Fc that cleans a wide range in the toilet bowl 12 with a small amount of cleaning liquid while cleaning the back surface of the toilet seat 22 with the first seat back flow Fa, and the back surface of the toilet seat 22 and the toilet bowl 12 can be effectively cleaned.

In addition, it is possible to form the second in-bowl flow Fd that cleans a wide range in the toilet bowl 12 with a small amount of cleaning liquid while cleaning the back surface of the toilet seat 22 with the second seat back flow Fb, and the back surface of the toilet seat 22 and the toilet bowl 12 can be effectively cleaned. In particular, there is an advantage in that the range which cannot be cleaned with the first in-bowl flow Fc can be cleaned with the second in-bowl flow Fd while the range which cannot be cleaned with the first seat back flow Fa can be cleaned with the second seat back flow Fb.

Figure 25:
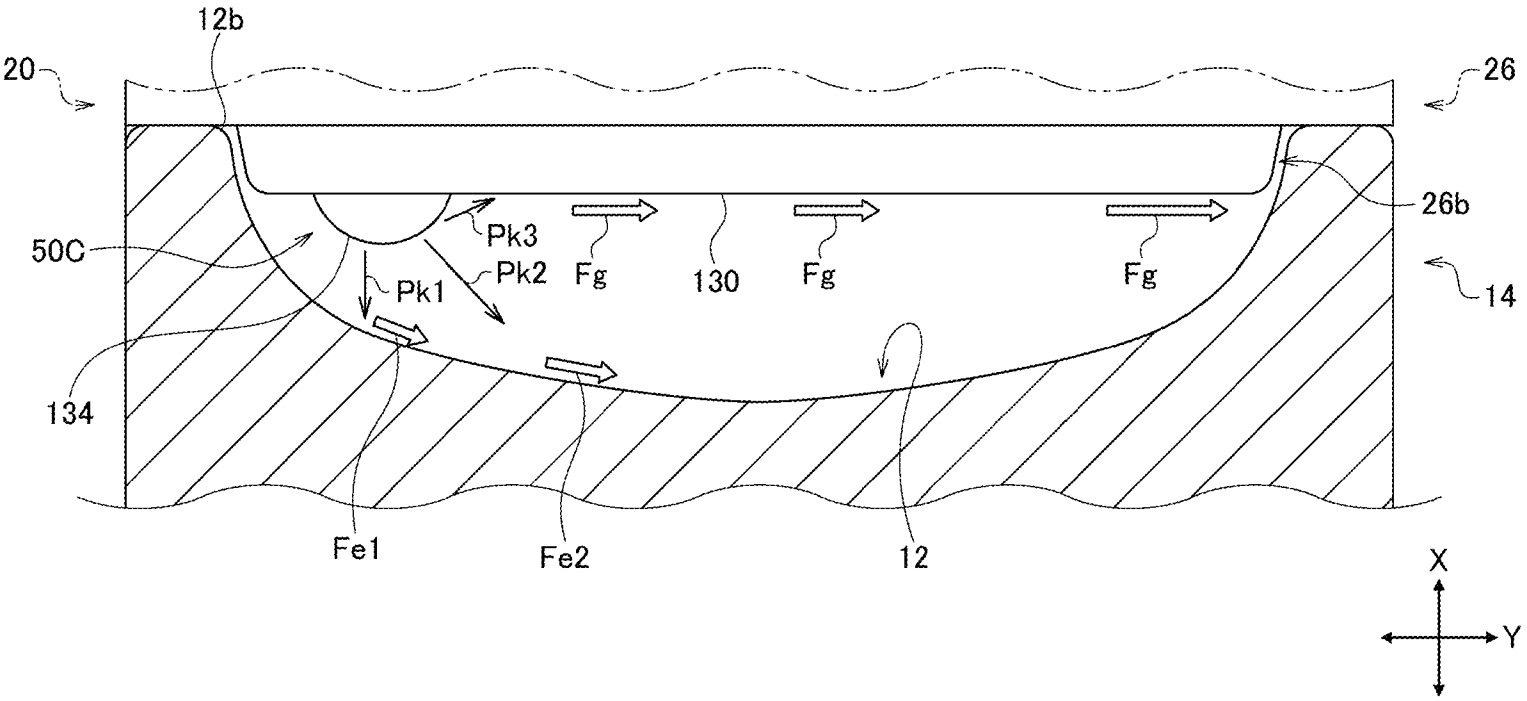
FIG. 25 is a diagram illustrating a part of a cross-sectional view taken along the line E-E of FIG. 2 according to some embodiments.

FIG. 25 is a diagram illustrating a part of a cross section taken along the line E-E of FIG. 2. As illustrated in FIGS. 11 and 25, the lower surface portion of the function device 20 is provided with the second bowl facing surface 130 facing the inner surface of the toilet bowl 12 of the toilet body 14 in the up-and-down direction Z. The second bowl facing surface 130 is provided on the lower surface portion of the protruding portion 26*b* of the second casing 26. The second bowl facing surface 130 is exposed in the inner space of the toilet bowl 12, and is easily contaminated due to adhesion of droplets of dirt or the like that are received by the toilet bowl 12.

As illustrated in FIGS. 3 and 25, in the discharge parts 50A to 50C of the toilet device 10, the toilet device 10 includes the third discharge part 50C capable of discharging the cleaning liquid from the plurality of liquid discharge holes 132A, 132B, and 132C. The third discharge part 50C according to the present embodiment is provided on the lower surface portion of the function device 20, more specifically, in the lower surface portion of the protruding portion 26*b* of the second casing 26. The third discharge part 50C according to the present embodiment is provided to protrude downward from the lower surface portion of the second casing 26. The third discharge part 50C according to the present embodiment is provided with an arc-shaped outer peripheral surface portion 134. The outer peripheral surface portion 134 according to the present embodiment has an arc shape extending along the front-and-rear direction X. On the outer peripheral surface portion 134, the cleaning liquid outlets of the liquid discharge holes 132A to 132C from which the cleaning liquid flows out open.

The third discharge part 50C according to the present embodiment is arranged above the right half portion of the toilet body 14. Specifically, the third discharge part 50C is arranged above the right half portion of the toilet body 14 located on the opposite side (right side) to the side (left side) where the second discharge part B is located in the left-and-right direction Y. The third discharge part 50C according to the present embodiment is arranged behind the first discharge part 50A and the second discharge part 50B.

Figure 26:
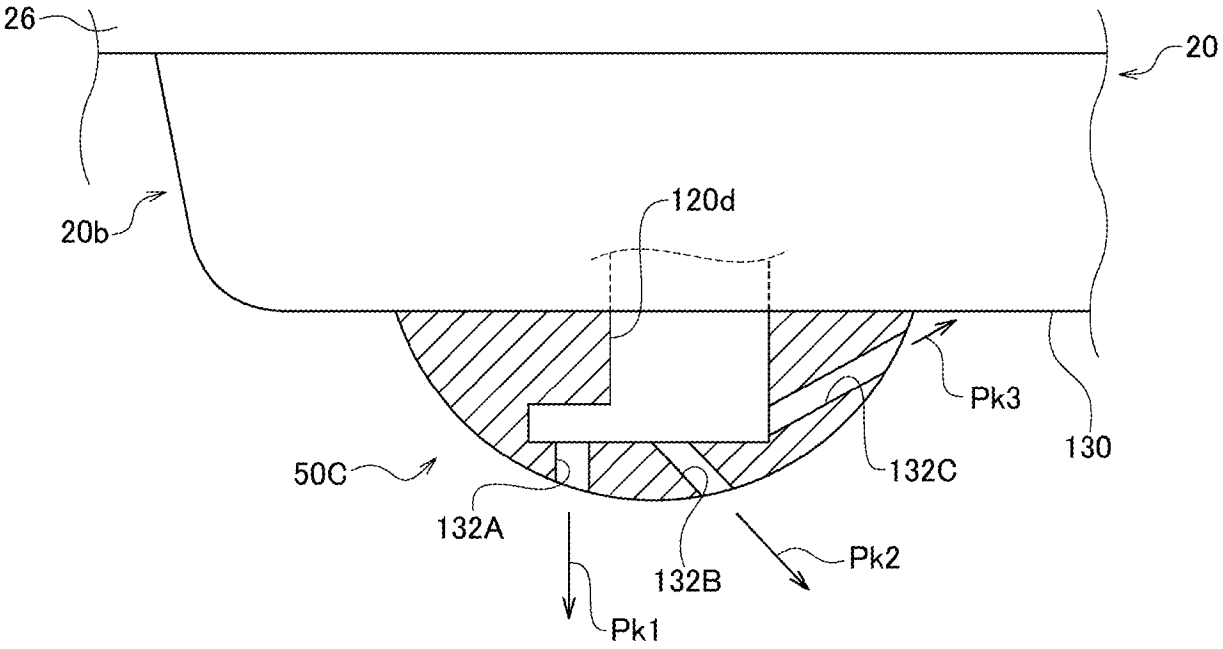
FIG. 26 is a cross-sectional view illustrating an inner structure of a third discharge part of FIG. 25 according to some embodiments.

FIG. 26 is a cross-sectional view illustrating an inner structure of the third discharge part 50C of FIG. 25. As illustrated in FIGS. 3, 25, and 26, the plurality of liquid discharge holes 132A, 132B, and 132C include liquid discharge holes for bowl 132A and 132B that can discharge a cleaning liquid downward in the toilet bowl 12 of the toilet body 14 and a third liquid discharge hole 132C that can discharge the cleaning liquid in a direction different from the discharge direction of the cleaning liquid of the liquid discharge hole for bowls 132A and 132B.

The liquid discharge holes for bowl 132A and 132B include a plurality of first liquid discharge holes 132A and a plurality of second liquid discharge holes 132B. The plurality of first liquid discharge holes 132A are provided in a line in the front-and-rear direction X. The same applies to the plurality of second liquid discharge holes 132B and the plurality of third liquid discharge holes 132C.

As illustrated in FIGS. 25 and 26, the first liquid discharge hole 132A according to the present embodiment can discharge the cleaning liquid, which has a downward velocity component in a vertical direction, in a direction Pk1. The second liquid discharge hole 132B according to the present embodiment can discharge a cleaning liquid, which has a horizontal velocity component and a downward velocity component, in a direction Pk2.

Figure 27:
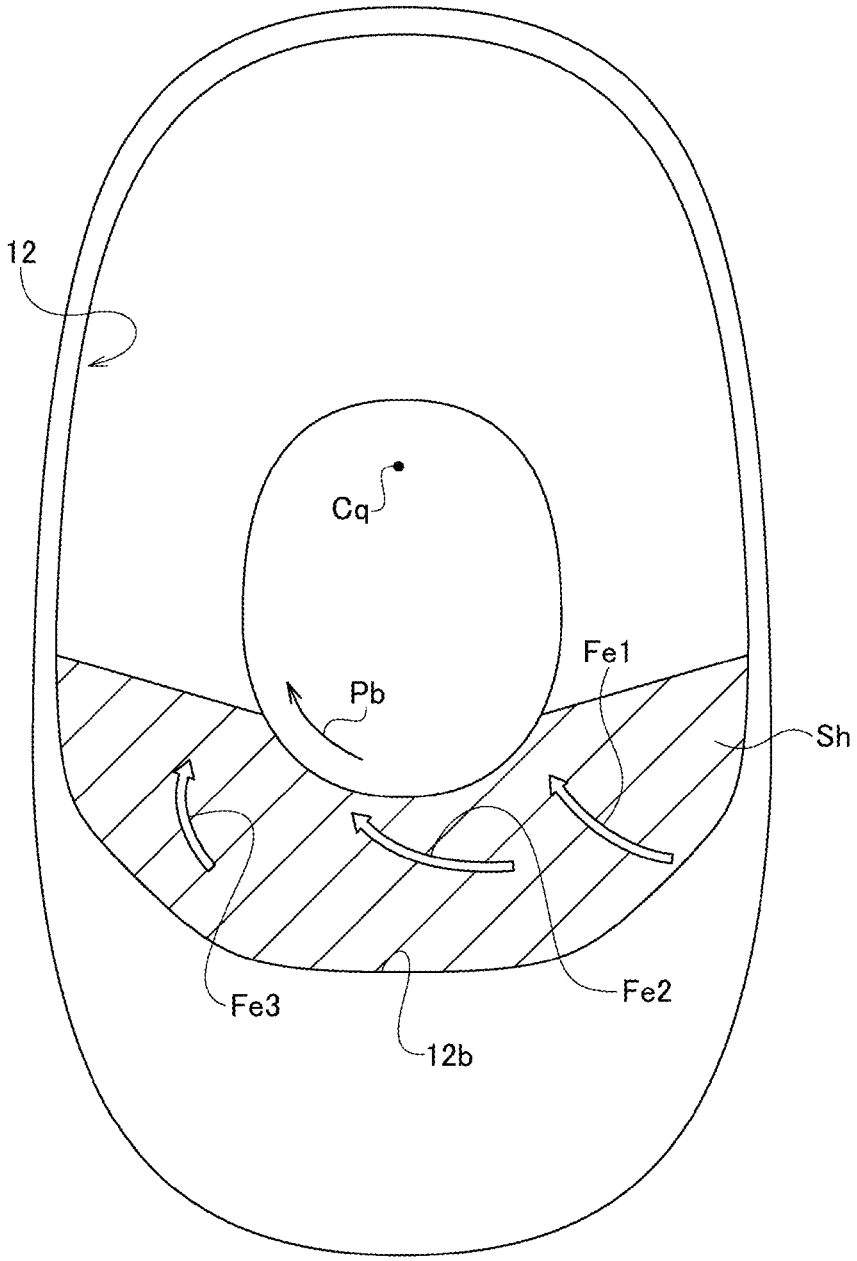
FIG. 27 is an explanatory diagram illustrating a third in-bowl flow according to some embodiments.

FIG. 27 is an explanatory diagram illustrating third in-bowl flows Fe1 to Fe3. FIG. 27 illustrates a main range Sh in which the cleaning liquid discharged by the third discharge part 50C runs.

The cleaning liquid discharged from the first liquid discharge hole 132A hits the inner peripheral surface of the toilet bowl 12 below the first liquid discharge hole 132A, and is guided to flow to the other side Pb in the circumferential direction therefrom, thereby forming the third in-bowl flow Fe1 swirling in the same direction. The cleaning liquid discharged from the first liquid discharge hole 132A hits the inner peripheral surface of the toilet bowl 12 behind and to the right of the center Cq of the toilet bowl 12.

The cleaning liquid discharged from the second liquid discharge hole 132B hits the inner peripheral surface of the toilet bowl 12 and then flows with the momentum of the horizontal velocity component, thereby forming the third in-bowl flow Fe2 swirling to the other side Pa in the circumferential direction.

The third liquid discharge hole 132C according to the present embodiment can discharge the cleaning liquid so that the cleaning liquid runs along the second bowl facing surface 130 of the function device 20. The third liquid discharge hole 132C can discharge a cleaning liquid having an upward velocity component. The third liquid discharge hole 132C according to the present embodiment discharges a cleaning liquid having an upward velocity component and a horizontal velocity component.

The third liquid discharge hole 132C discharges the cleaning liquid so that the cleaning liquid runs from the right side to the left side (from the left side to the right side of the page of FIG. 25) of the second bowl facing surface 130 of the function device 20. As a result, the cleaning liquid discharged from the third liquid discharge hole 132C forms a back surface flow Fg that runs from the right side to the left side of the second bowl facing surface 130 of the function device 20. FIG. 7 illustrates a range Si in which the cleaning liquid forming the back surface flow Fg runs. Most of the cleaning liquid that forms the back surface flow Fg drips down in the left half of the second bowl facing surface 130 of the function device 20 while having a horizontal velocity component. The cleaning liquid flowing down from the second bowl facing surface 130 of the function device 20 hits the inner peripheral surface of the toilet bowl 12 and then forms the third in-bowl flow Fe3 swirling to the other side Pa in the circumferential direction while having the momentum of the horizontal velocity component.

The third in-bowl flows Fe1 to Fe3 flow toward the bottom of the toilet bowl 12 while swirling the rear of the toilet bowl 12 around the center Cq behind the center Cq of the toilet bowl 12. The swirling direction of the third in-bowl flows Fe1 to Fe3 is the other side Pb in the circumferential direction, and is the same as the swirling direction of the second in-bowl flow Fd (see FIG. 24) formed on the toilet bowl 12 by the cleaning liquid discharged from the second discharge part 50B.

Refer to FIGS. 20 and 26. The cleaning liquid is supplied to the plurality of liquid discharge holes 132A to 132C of the third discharge part 50C through the third liquid passage 120*d* branched from the first liquid passage 120*a*. The above-described switching mechanism 122 has the third open-close valve 126D provided on the middle of the third liquid passage 120*d*. When the second discharge part 50B executes the discharge operation of discharging the cleaning liquid, the controller 124 controls the switching mechanism 122 to execute even the third discharge part 50C to execute the discharge operation of discharging the cleaning liquid by opening the third liquid passage 120*d* by the third open-close valve 126D.

Figure 28:
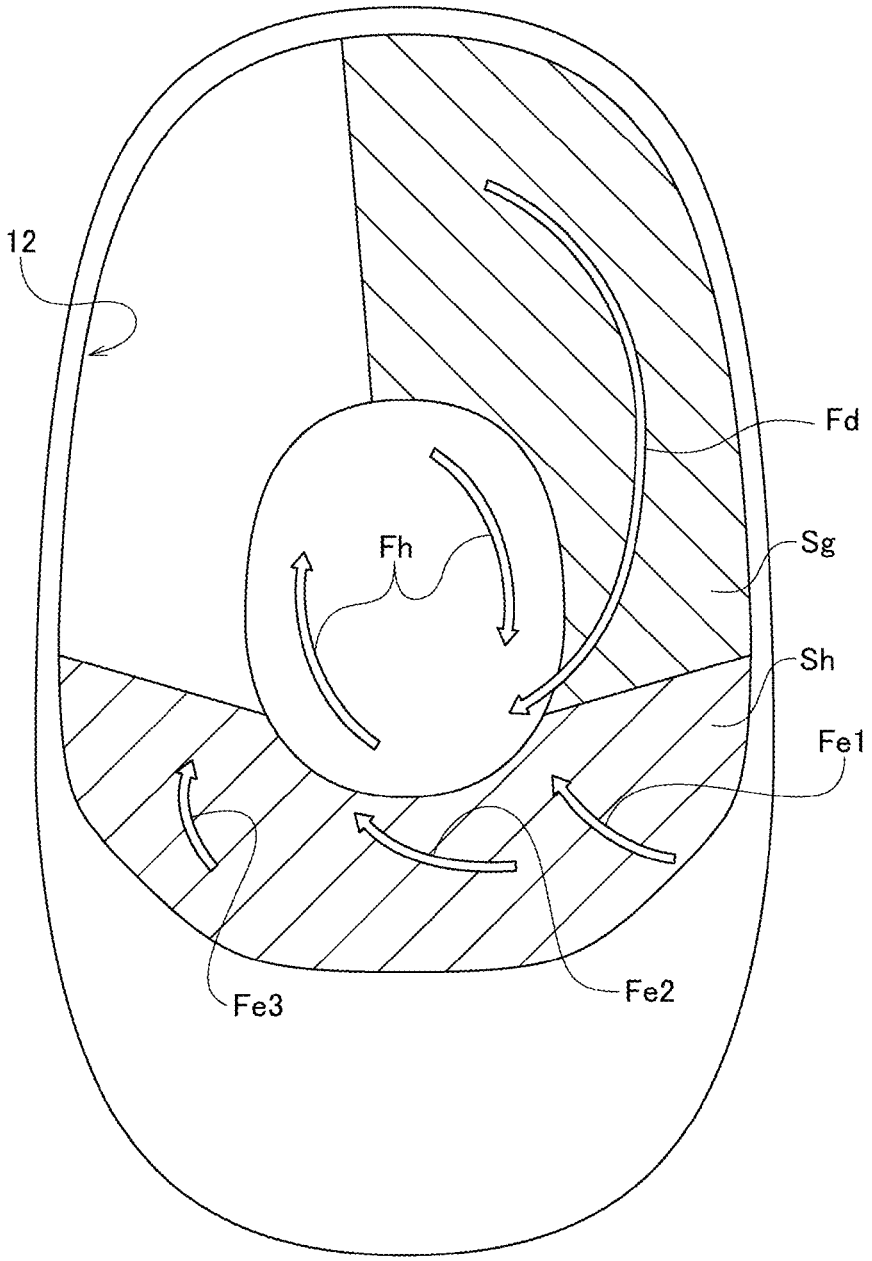
FIG. 28 is an explanatory diagram illustrating the second in-bowl flow and the third in-bowl flow according to some embodiments.

FIG. 28 is an explanatory diagram illustrating the second in-bowl flow Fd and the third in-bowl flows Fe1 to Fe3. By the above control, when the third in-bowl flows Fe1 to Fe3 are formed on the toilet bowl 12 by the cleaning liquid discharged from the third discharge part 50C, the second in-bowl flow Fd is also formed on the toilet bowl 12 by the cleaning liquid discharged from the second discharge part 50B. The third in-bowl flows Fe1 to Fe3 swirl in the same circumferential direction as the first in-bowl flow Fc, and are joined at the bottom of the toilet bowl 12. As a result, a swirling flow Fh having a large circumferential velocity component is formed at the bottom of the toilet bowl 12, and the cleaning performance at the bottom of the toilet bowl 12 is improved. Further, when the dirt in the toilet bowl 12 is discharged through the trap part 70 using a siphon action, there is also an advantage in that the siphon action can be effectively obtained by forming the swirling flow Fh having a large circumferential velocity component in the toilet bowl 12.

The third in-bowl flows Fe1 to Fe3 flow with a downward velocity component larger than the downward velocity component of the second in-bowl flow Fd. The second in-bowl flow Fd joins the third in-bowl flow Fe1 to Fe3 above the bottom of the toilet bowl 12 to avoid the situation of continuing to swirl in the toilet bowl 12 without flowing into the bottom of the toilet bowl 12 and easily discharge the dirt at an early stage.

The first in-bowl flow Fc, the second in-bowl flow Fd, and the third in-bowl flows Fe1 to Fe3 flow over the entire inner peripheral surface of the toilet bowl 12 as a whole, and the entire region in the toilet bowl 12 is cleaned by the cleaning liquid.

A fifth ingenuity of the toilet device 10 will be described. As described above, the discharge parts 50A to 50C are provided on the second casing 26 of the function device 20, as illustrated in FIG. 5. The discharge parts 50A and 50B are to be provided at locations different from the toilet seat 22 of the toilet device 10. The second casing 26 houses, as the above-mentioned functional component, a private part cleaning device 140 for cleaning a private part of a sitting person sitting on the toilet seat 22. The private part cleaning device 140 has a private part cleaning nozzle 142 (hereinafter, simply referred to as a nozzle 142) for discharging cleaning water for cleaning the private part of the sitting person.

Figure 29:
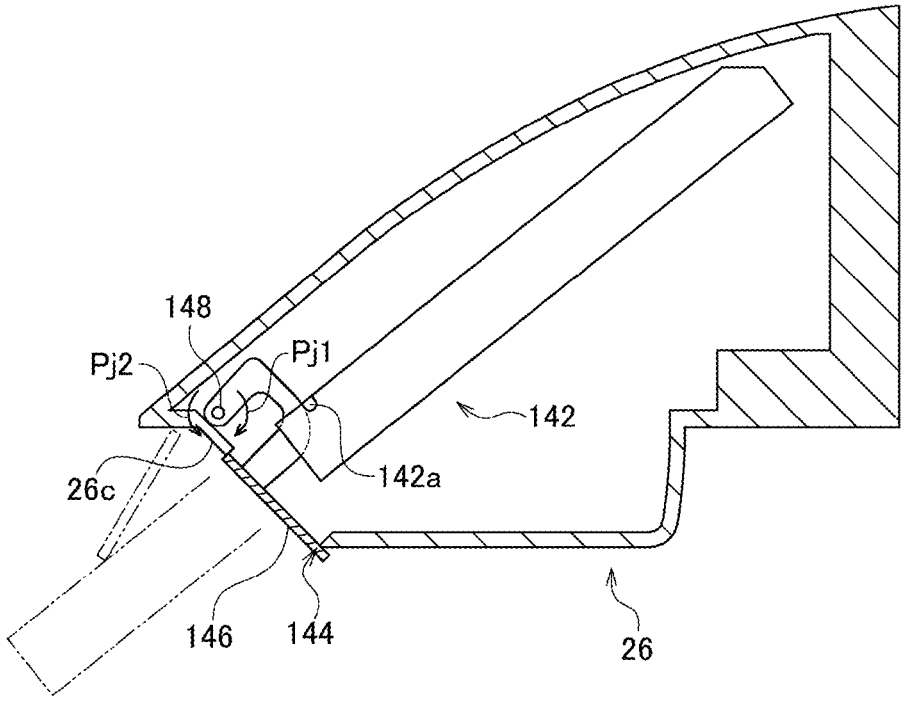
FIG. 29 is a side cross-sectional view of the second casing passing through a nozzle according to the first embodiment.

FIG. 29 is a side cross-sectional view of the second casing 26 passing through the nozzle 142. The second casing 26 is provided with an opening portion for nozzle 144. The opening portion for nozzle 144 according to the present embodiment is formed on the slanted surface portion 26*c* of the second casing 26. A shutter for nozzle 146 that can open and close the opening portion for nozzle 144 is attached to the second casing 26. The shutter for nozzle 146 according to the present embodiment has a long plate shape in the left-and-right direction Y. The shutter for nozzle 146 according to the present embodiment is rotatably attached to the second casing 26 via a rotating shaft 148. The rotating shaft 148 according to the present embodiment extends along a horizontal direction. The shutter for nozzle 146 opens the opening portion for nozzle 144 by rotating in one direction Pj1 around the rotating shaft 148, and closes the opening portion for nozzle 144 by rotating in an opposite direction Pj2 thereto.

The nozzle 142 is provided to be inclined downward toward the front. A tip portion of the nozzle 142 is located below the nozzle 142, and a nozzle hole 142*a* for discharging cleaning water is formed on the tip portion. The nozzle 142 is driven by a nozzle driving mechanism (not illustrated) using a motor or the like to be able to move forward and backward with respect to the opening portion for nozzle 144 along with the opening and closing of the shutter for nozzle 146. The nozzle 142 is provided to be able to move forward and backward with respect to the opening portion for nozzle 144.

As illustrated in FIG. 3, the discharge parts 50A to 50C and the nozzle 142 are provided behind the center Cp of the toilet seat 22. In the present embodiment, these are provided behind a rear end 32*a* of the central opening portion 32 of the toilet seat 22. Further, in the present embodiment, these are housed in a continuing inner spaces formed on the second casing 26.

As illustrated in FIG. 5, the first discharge part 50A is provided on the right side which is one side in the left-and-right direction Y with respect to the nozzle 142. The second discharge part 50B is provided on the left side which is the other side in the left-and-right direction Y with respect to the nozzle 142. The first discharge part 50A and the second discharge part 50B are arranged at locations overlapping the nozzle 142 in the left-and-right direction Y in a plan view.

The discharge parts 50A to 50C are provided behind a front end portion 20*a* of the function device 20. The discharge parts 50A and 50B according to the present embodiment are provided to satisfy this condition when the shutters 104A and 104B are provided at the above-described concealed position Pf1. The front end portion 20*a* of the function device 20 is provided behind the center Cp of the toilet seat 22 (see FIG. 3). The front end portion 20*a* of the function device 20 is provided behind the rear end 32*a* of the central opening portion 32 of the toilet seat 22. Here, the front end portion 20*a* of the function device 20 is referred to as the front end portion of the second casing 26. The discharge parts 50A to 50C are provided at locations concealed by the function device 20 in plan view.

The effects of the fifth ingenuity will be described. The discharge parts 50A to 50C are provided not in the toilet seat 22 but in the second casing 26 of the function device 20. Accordingly, even when the cleaning liquid remains inside the discharge parts 50A and 50B, the case where the weight of the cleaning liquid is not added to the toilet seat, and the load to be applied for moving the toilet seat 22 increases can be avoided. In the present embodiment, this means a case where the load to be applied for rotating the toilet seat 22 to an upright position increases. It is possible to avoid the increase in the load to be applied for rotating the upright position. For this reason, the usability of the toilet seat 22 can be maintained while realizing the cleaning of the back surface of the toilet seat 22.

In addition, the discharge parts 50A and 50B are provided behind the center Cp of the toilet seat 22 and on the left and right sides of the nozzle 142. Therefore, as compared with the case where the discharge parts 50A and 50B are provided on front of the center Cp of the toilet seat 22, the discharge parts 50A and 50B and the nozzle 142 can be provided at a gathered location of the function device 20, and the function device 20 can be made compact.

The discharge parts 50A and 50B include a first discharge part 50A that can discharge a cleaning liquid so that the cleaning liquid runs along the back surface of the toilet seat 22 toward the one side Pa in the circumferential direction and a second discharge part 50B that can discharge the cleaning liquid so that the cleaning liquid runs along the back surface of the toilet seat 22 toward the other side Pb in the circumferential direction. Therefore, as described above, in a partial region (front end region 39) of the first bowl facing surface 34 of the toilet seat 22, the first seat back flow Fa running toward the one side Pa in the circumferential direction and the second seat back flow Fb running toward the other side Pb in the circumferential direction can be formed, and the region can be effectively cleaned.

In particular, the front end region 39 of the first bowl facing surface 34 of the toilet seat 22 is likely to be hit by droplets of a urine received in the toilet bowl 12 of the toilet body 14 and is likely to be easily contaminated. There is an advantage in that the first seat back flow Fa and the second seat back flow Fb can be formed on such a region, and the dirt can be easily cleaned off.

The discharge parts 50A to 50C are provided behind a front end portion 20*a* of the function device 20. Therefore, when the inside of the toilet bowl 12 of the toilet body 14 is looked into from the upper side, the discharge parts 50A to 50C are concealed by the function device 20 and are not easy to see, and therefore the good design is obtained.

Other features of the toilet device 10 will be described. Refer to FIG. 2. A recess part 150 that is recessed upward is formed on the lower surface portion of the rear portion of the toilet seat 22. The recess part 150 is arranged at a location overlapping a part of the upper surface portion of the function device 20 in the up-and-down direction Z. The recess part 150 is formed to have an outer shape that matches an outer shape of a part of the upper surface portion of the function device 20, and is arranged along the upper surface. As illustrated in FIG. 11, the discharge parts 50A to 50C are arranged at a location overlapping the recess part 150 of the toilet seat 22 in the up-and-down direction Z.

The seat back discharge parts 50A and 50B are provided at a location spaced apart from the back surface of the toilet seat 22, and discharge the cleaning liquid in the discharge direction Pc so that the cleaning liquid hits the back surface of the toilet seat 22 from that location. The seat back discharge parts 50A and 50B can discharge a cleaning liquid having an upward velocity component from the cleaning liquid outlet 76. This means that the seat back discharge parts 50A and 50B can discharge the cleaning liquid so that the cleaning liquid has an upward velocity component at least when the cleaning liquid flows out through the cleaning liquid outlet 76. It can be said that the discharge direction Pc of the seat back discharge parts 50A and 50B is set to be upward. The seat back discharge parts 50A and 50B according to the present embodiment discharge a cleaning liquid having an upward velocity component in a vertical direction and a horizontal velocity component. The seat back discharge parts 50A and 50B according to the present embodiment discharge the cleaning liquid in which the horizontal velocity component is larger than the upward velocity component.

Figure 30B:
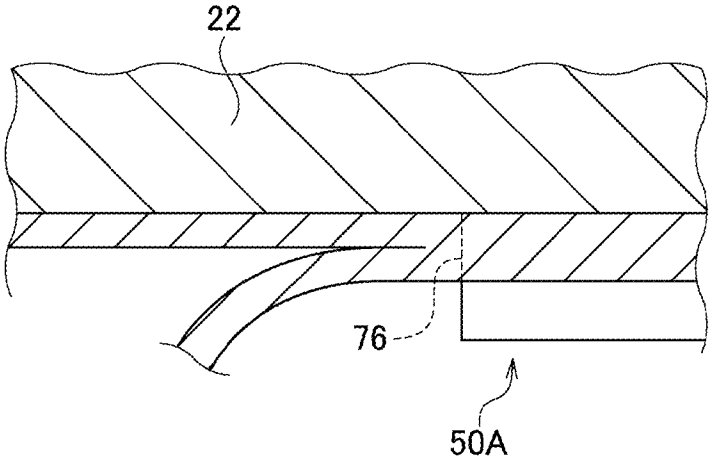
FIG. 30B is a diagram schematically illustrating a cleaning liquid discharged from a first discharge part according to a second modification.
Figure 30A:
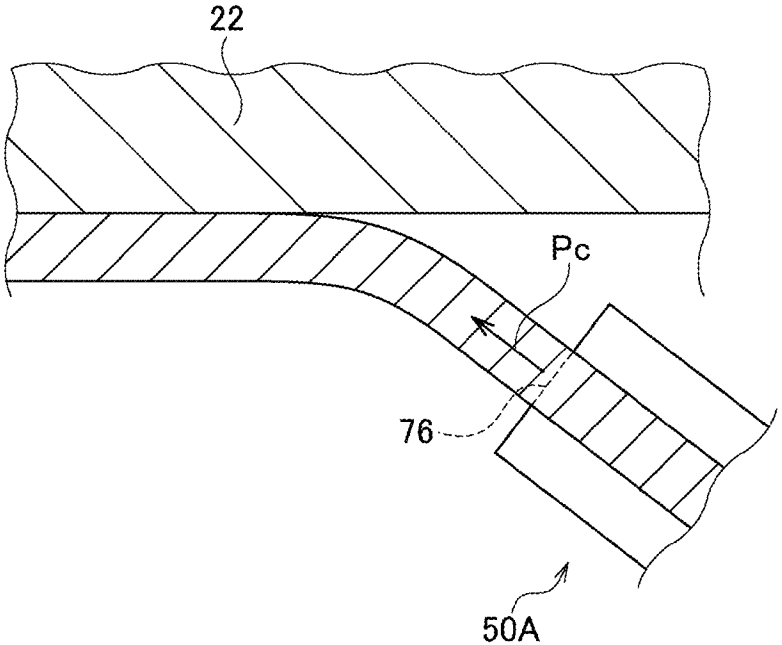
FIG. 30A is a diagram schematically illustrating a cleaning liquid discharged from the first discharge part according to the first embodiment.

FIG. 30A is a diagram schematically illustrating the cleaning liquid discharged from the first discharge part 50A. As for the cleaning liquid discharged from the seat back discharge parts 50A and 50B, the velocity component in the vertical direction attempts to approach to zero due to the influence of gravity, but hits the back surface of the toilet seat 22 before the velocity component becomes zero. This means that the cleaning liquid discharged from the seat back discharge parts 50A and 50B hits the back surface of the toilet seat 22 having an upward velocity component. It can be said that the toilet device 10 (toilet seat unit 16) is structured to satisfy the condition. In order to satisfy the condition, in addition to the discharge direction Pc of the cleaning liquid of the seat back discharge parts 50A and 50B, the distance from the location where the cleaning liquid hits the back surface of the toilet seat 22 to the discharge part 50A, 50B, the supply pressure applied to the cleaning liquid supplied to discharge parts 50A and 50B, and the like are set. The smaller the distance and the higher the supply pressure of the cleaning liquid, the easier it is to satisfy the above conditions.

The advantages will be described. FIG. 30B is a diagram schematically illustrating the cleaning liquid discharged from the first discharge part 50A according to the second modification. The first discharge part 50A of this example discharges a cleaning liquid having only the horizontal velocity component. This means that the first discharge part 50A in this example discharges the cleaning liquid having no upward velocity component. In this case, a part of the cleaning liquid flowing out from the cleaning liquid outlet 76 of the first discharge part 50A is affected by gravity and easily flows downward without hitting the back surface of the toilet seat 22. In particular, the tendency becomes stronger as a part of the cleaning liquid flows out from a location closer to the lower edge of the cleaning liquid outlet 76.

On the other hand, according to the present embodiment, as illustrated in FIG. 30A, even if the influence of gravity is exerted, it is easily designed so that most of the cleaning liquid hits the back surface of the toilet seat 22. Therefore, compared with the example of FIG. 30B, by reducing the amount of cleaning liquid flowing out from the seat back discharge parts 50A and 50B without hitting the back surface of the toilet seat 22, the amount of cleaning liquid that runs along the back surface of the toilet seat 22 can be easily increased, and the back surface of the toilet seat 22 can be effectively cleaned.

Figure 31:
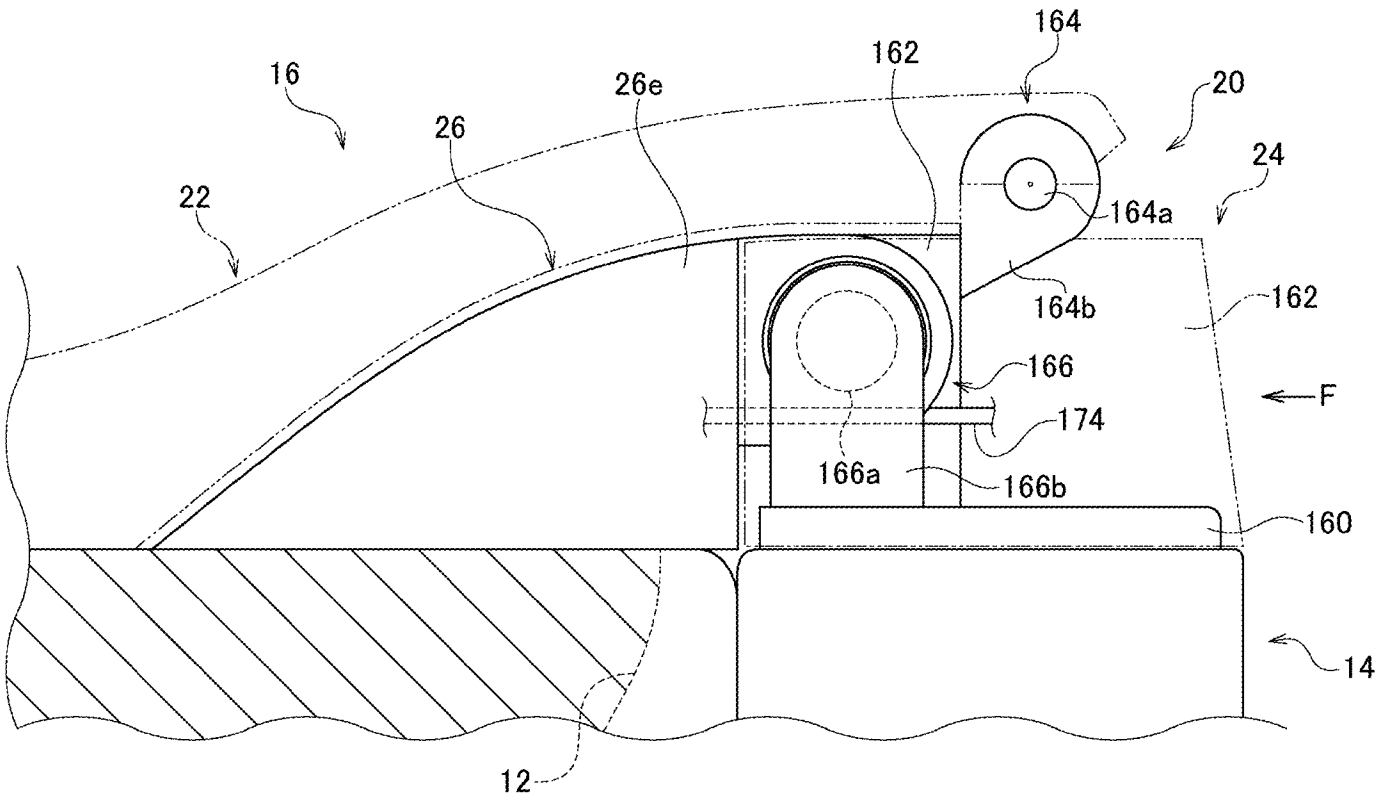
FIG. 31 is an enlarged side view of a part of the toilet seat unit according to the first embodiment.

A sixth ingenuity of the toilet device 10 will be described. FIG. 31 is an enlarged side view of a part of the toilet seat unit 16. As described above, the function device 20 includes the first casing 24 and the second casing 26. The first casing 24 has a base plate 160 that is provided on the upper surface portion of the rear portion of the toilet body 14, and a case cover 162 that is assembled to the base plate 160 to cover the base plate 160 from above. In FIG. 31, a part of the case cover 162 is omitted.

Figure 32C:
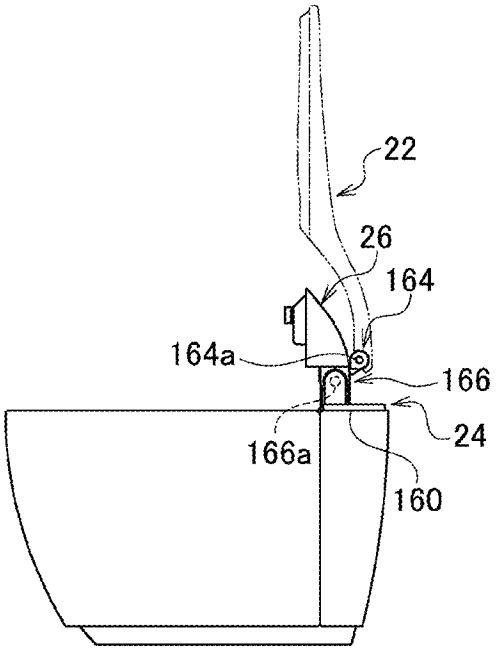
FIG. 32C is a diagram illustrating a positional relationship between the toilet seat and the second casing according to the first embodiment.
Figure 32B:
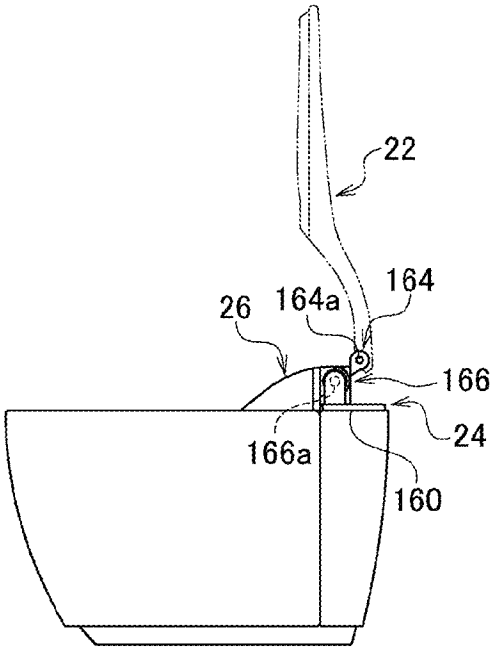
FIG. 32B is a diagram illustrating a positional relationship between the toilet seat and the second casing according to the first embodiment.
Figure 32A:
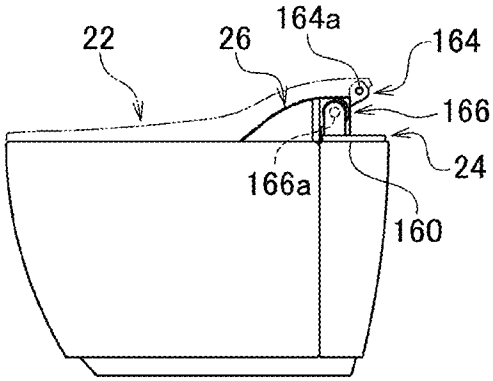
FIG. 32A is a diagram illustrating a positional relationship between the toilet seat and the second casing according to the first embodiment.
Figure 33:
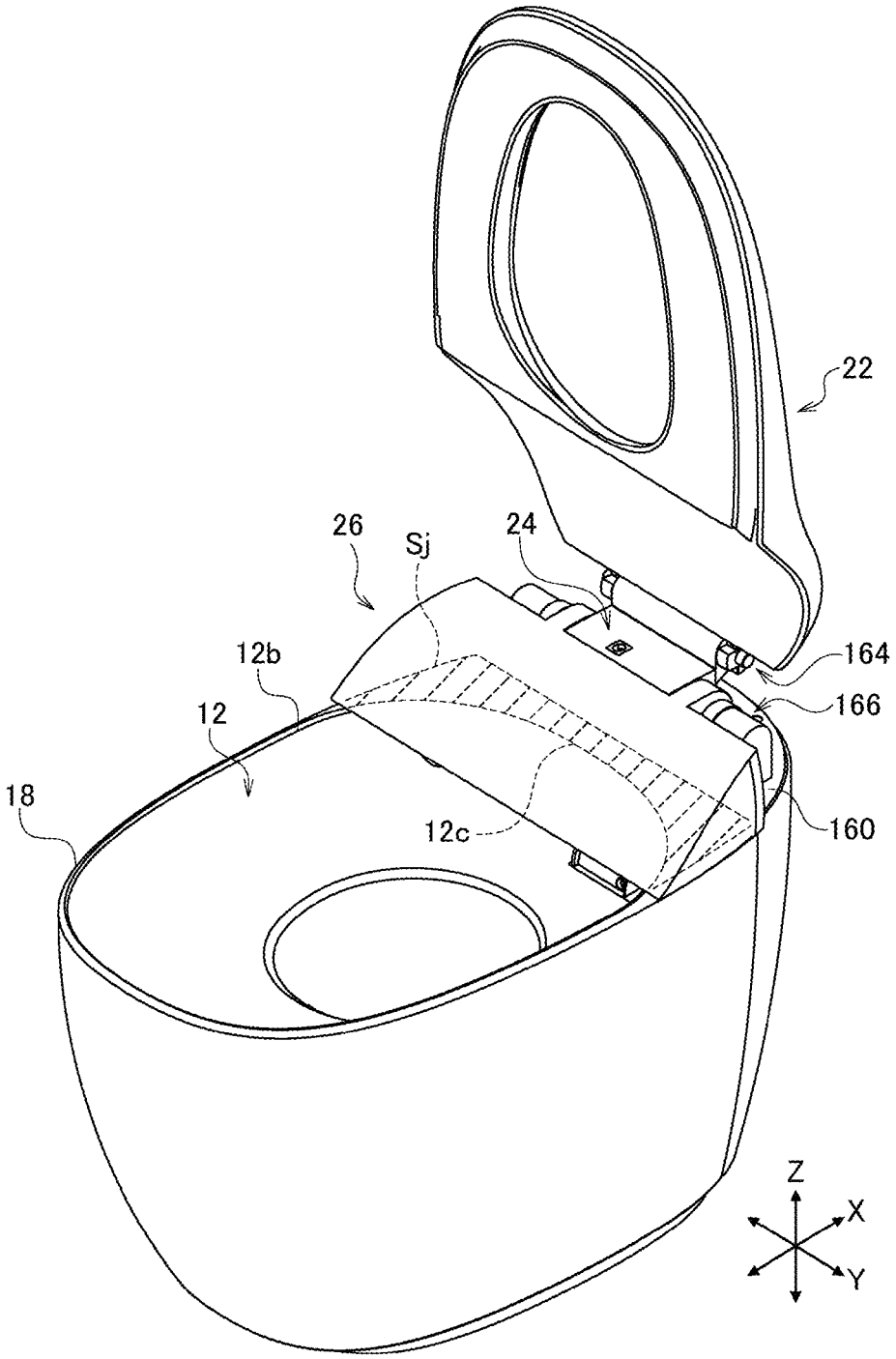
FIG. 33 is a perspective view of FIG. 32B according to some embodiments.
Figure 34:
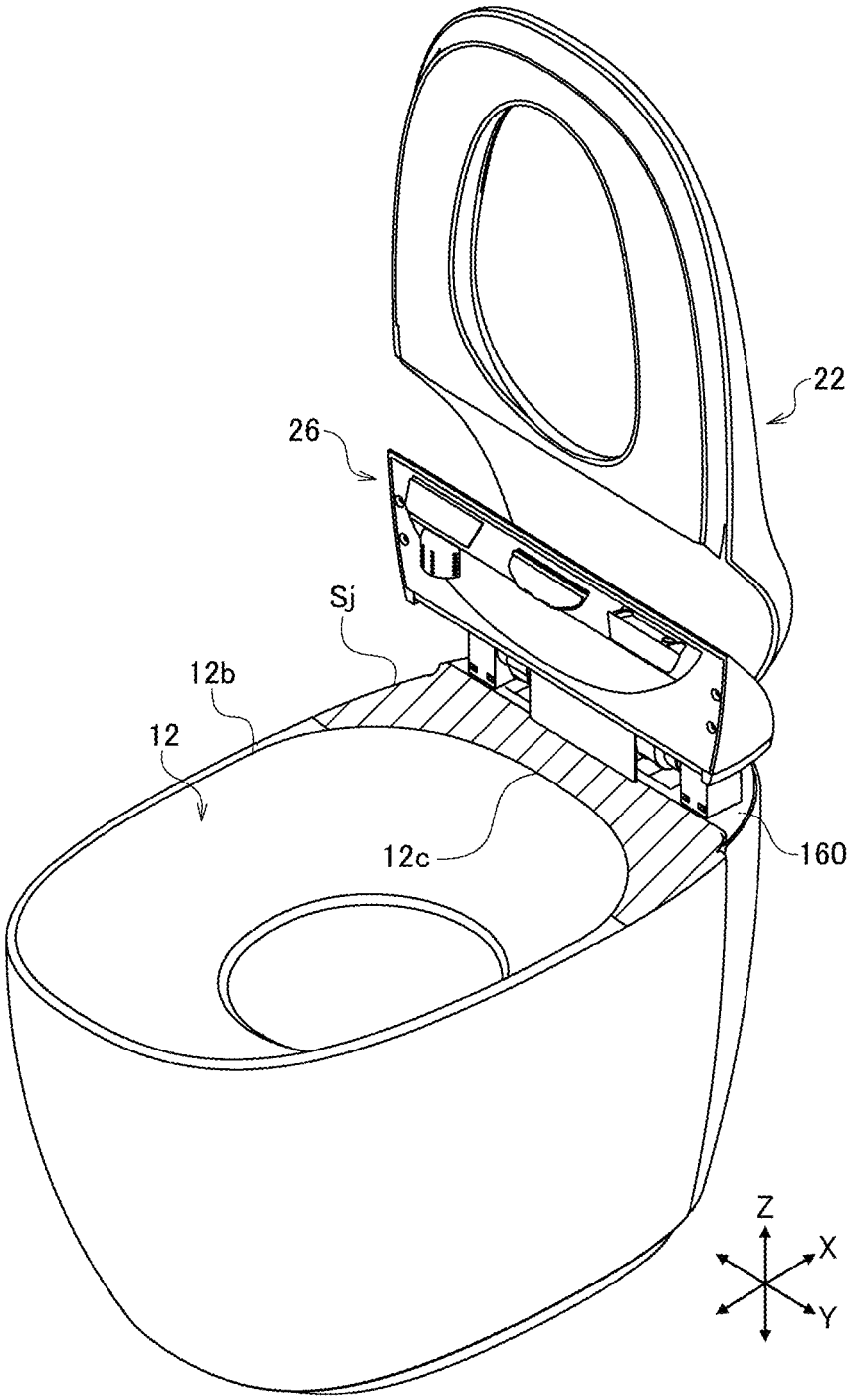
FIG. 34 is a perspective view of FIG. 32C according to some embodiments.

FIG. 32 is a diagram schematically illustrating the positional relationship between the toilet seat 22 and the second casing 26. FIG. 33 is a perspective view of FIG. 32B, and FIG. 34 is a perspective view of FIG. 32C. The toilet seat 22 is rotatably attached to the first casing 24 via a first hinge mechanism 164. The toilet seat 22 can rotate itself to move to a lying position (see FIG. 32A) lying on the toilet body 14 and an upright position (see FIG. 32B and FIG. 32C) upright with respect to the toilet body 14. In this specification, unless otherwise specified, the positional relationship of the toilet seat 22 will be described based on the time when the toilet seat 22 is at the lying position.

The second casing 26 is movably attached to the base plate 160 of the first casing 24. The second casing 26 according to the present embodiment is rotatably attached to the first casing 24 via the second hinge mechanism 166. The second casing 26 can move to a first position (see FIG. 32A and FIG. 32B) where the second casing 26 is placed on the upper surface portion of the toilet body 14 and a second position (see FIG. 32C) where at least a front portion of the second casing 26 is located above the first position. The second casing 26 according to the present embodiment can rotate itself to move between the lying position as the first position lying on the toilet body 14 and the upright position as the second position upright with respect to the toilet body 14. In this specification, unless otherwise specified, the positional relationship of the second casing 26 will be described based on the case where the second casing 26 is at the first position.

As illustrated in FIG. 31, the second casing 26 is provided separately from the toilet seat 22, and is rotatably attached to the toilet body 14 via the first casing 24. The second casing 26 has a main body portion 26*e* in which the first discharge parts 50A to 50C are provided. The main body portion 26*e* is provided so that at least a part of the main body portion 26*e* is located in front of a second hinge shaft 166*a* of the second hinge mechanism 166, which is the center of rotation of the second casing 26. A second hinge shaft 166*a* is provided to be located behind the toilet bowl 12 of the toilet body 14 and above the upper surface portion of the toilet body 14. The main body portion 26*e* of the second casing 26 according to the present embodiment is provided to be entirely located in front of the second hinge shaft 166*a*. Further, the main body portion 26*e* of the second casing 26 is provided so that at least a part of the main body portion 26*e* is located at a location overlapping the toilet bowl 12 of the toilet body 14 in the up-and-down direction.

As illustrated in FIG. 32C, the main body portion 26*e* of the second casing 26 is provided to be located above the second hinge shaft 166*a* when the second casing 26 is at the second position. Although not illustrated, the main body portion 26*e* according to the present embodiment is provided to be located above the first casing 24 when the second casing 26 is at the second position.

Refer to FIGS. 33 and 34. When the second casing 26 is at the first position, the second casing 26 is provided to cover the upper surface portion of the rear portion of the rim part 18 from above, in the rim part 18 of the toilet bowl 12. In FIG. 33, a range Sj in which the rim part 18 is covered by the second casing 26 is shown with hatching. At this time, the second casing 26 is provided to cover the range Sj which crosses over a rear end 12*c* of the upper end opening 12*b* of the toilet bowl 12 in the front-and-rear direction X.

When the second casing 26 is at the second position, the upper surface portion of the rim part 18 of the toilet bowl 12 is provided to be exposed in an annularly continuous range. At this time, the upper surface portion of the rim part 18 of the toilet body 14 is provided to expose the range Sj which crosses over a rear end 12*c* of the upper end opening 12*b* of the toilet bowl 12 in the front-and-rear direction X.

The toilet seat unit 16 can expose a part of the upper surface portion of the toilet body 14 by rotating the second casing 26 instead of merely moving the second casing 26 upward. Therefore, when the second casing 26 moves to the second position and a part of the upper surface of the toilet body 14 is exposed, most of the second casing 26 is not located above the exposed position. As a result, the visibility of the exposed position of the upper surface portion of the toilet body 14 becomes good, and the cleanability of the exposed position becomes good.

In addition, when the second casing 26 moves from the first position to the second position, the discharge parts 50A to 50C provided on the main body portion 26*e* of the second casing 26 can move upward. Therefore, when the second casing 26 is at the second position, a wide range Sj of the upper surface portion of the toilet body 14 can be exposed around a space occupied by the discharge parts 50A and 50B when the second casing 26 is at the first position. Therefore, while the discharge parts 50A to 50C are incorporated in the second casing 26, the cleanability of the upper surface portion of the toilet body 14 is improved.

Further, since the discharge parts 50A to 50C are provided not in the toilet seat 22 but in the second casing 26, the effect (E) described above can be obtained.

Figure 35:
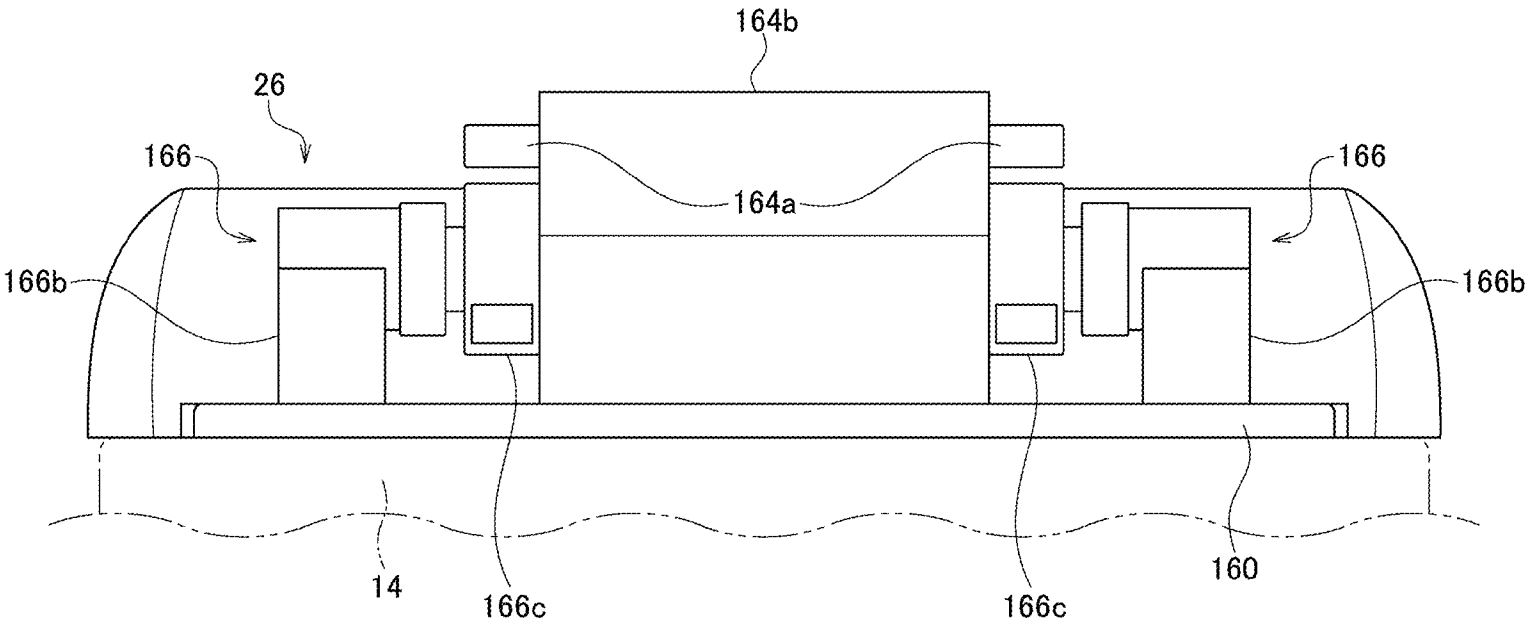
FIG. 35 is a view seen from the arrow F of FIG. 31 according to some embodiments.
Figure 36:
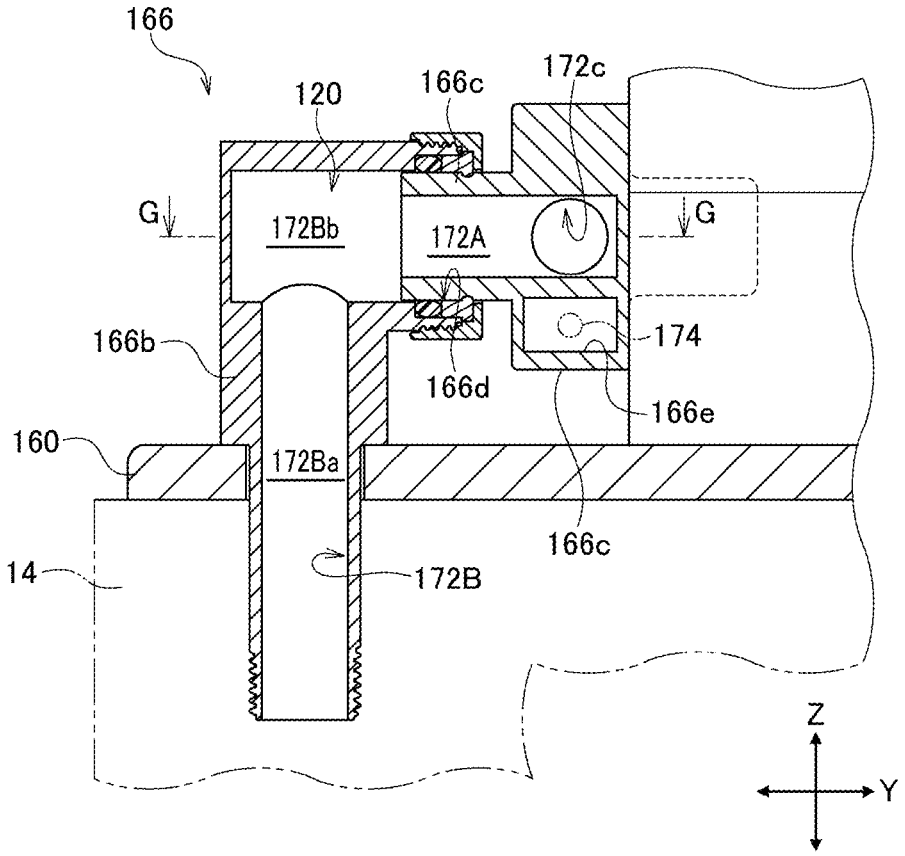
FIG. 36 is an enlarged cross-sectional view illustrating a part of FIG. 35 according to some embodiments.
Figure 37:
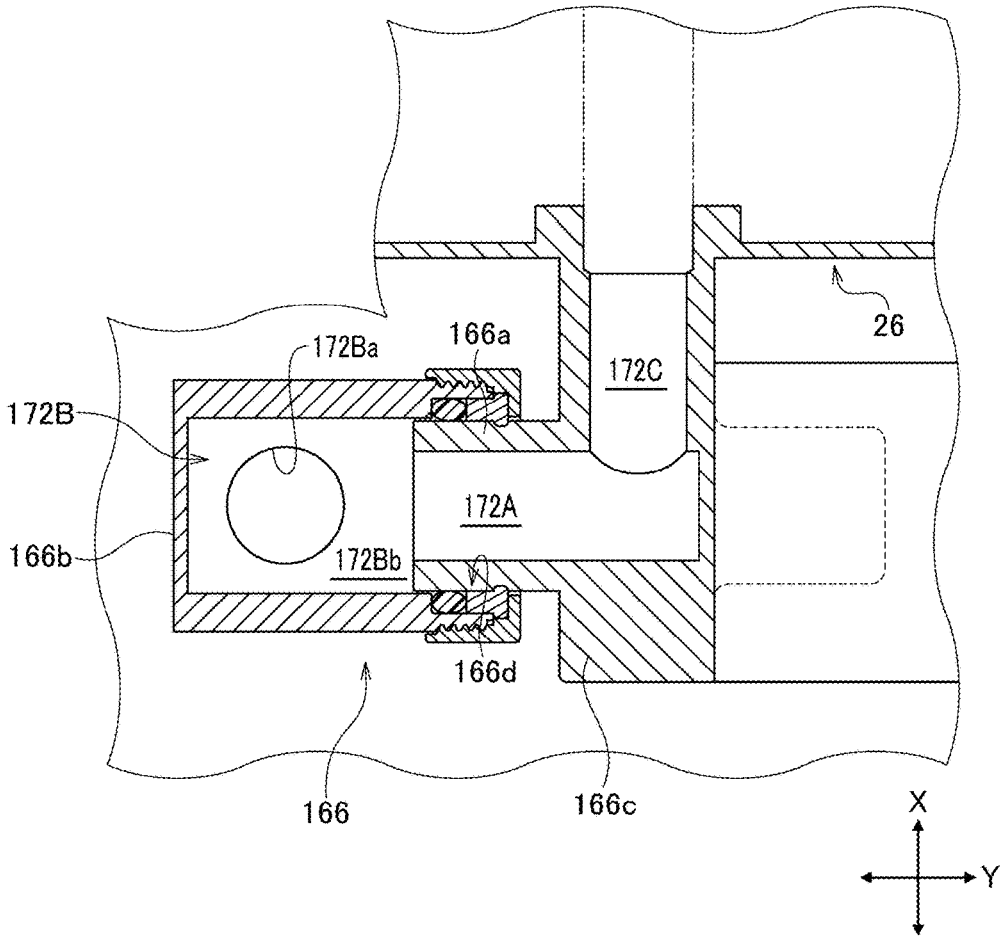
FIG. 37 is a cross-sectional view taken along the line G-G of FIG. 36 according to some embodiments.

Other features related to the sixth ingenuity will be described. FIG. 35 is a view seen from an arrow F of FIG. 31. FIG. 36 is an enlarged cross-sectional view illustrating a part of FIG. 35. FIG. 37 is a cross-sectional view taken along the line G-G of FIG. 36. The second casing 26 is rotatably attached to the toilet body 14 via the first casing 24 using the second hinge mechanism 166. The second hinge mechanism 166 has a second hinge shaft 166*a*, a second hinge base portion 166*b* provided on the first casing 24, and a second hinge part 166*c* provided on the second casing 26. The second hinge shaft 166*a* rotatably connects the second hinge part 166*c* to the second hinge base portion 166*b*. It can be said that the second casing 26 is rotatably connected to the toilet body 14 via the second hinge shaft 166*a* around the second hinge shaft 166*a*.

The second hinge shaft 166*a* is provided to be rotatable integrally with the second hinge part 166*c*. The second hinge shaft 166*a* according to the present embodiment constitutes a part of the same member as the second hinge part 166*c*, and is provided to protrude toward the outside of the second hinge part 166*c* in the left-and-right direction Y.

The second hinge base portion 166*b* is concealed from the outside by the case cover 162 of the first casing 24 (see FIG. 31). The second hinge base portion 166*b* according to the present embodiment is provided to protrude upward from the base plate 160 of the first casing 24. The second hinge base portion 166*b* according to the present embodiment is provided with a shaft support hole 166*d* through which the second hinge shaft 166*a* is inserted and that rotatably supports the second hinge shaft 166*a*. The shaft support hole 166*d* according to the present embodiment is provided to be opened toward the inside of the second hinge base portion 166*b* in the left-and-right direction Y.

Figure 38:
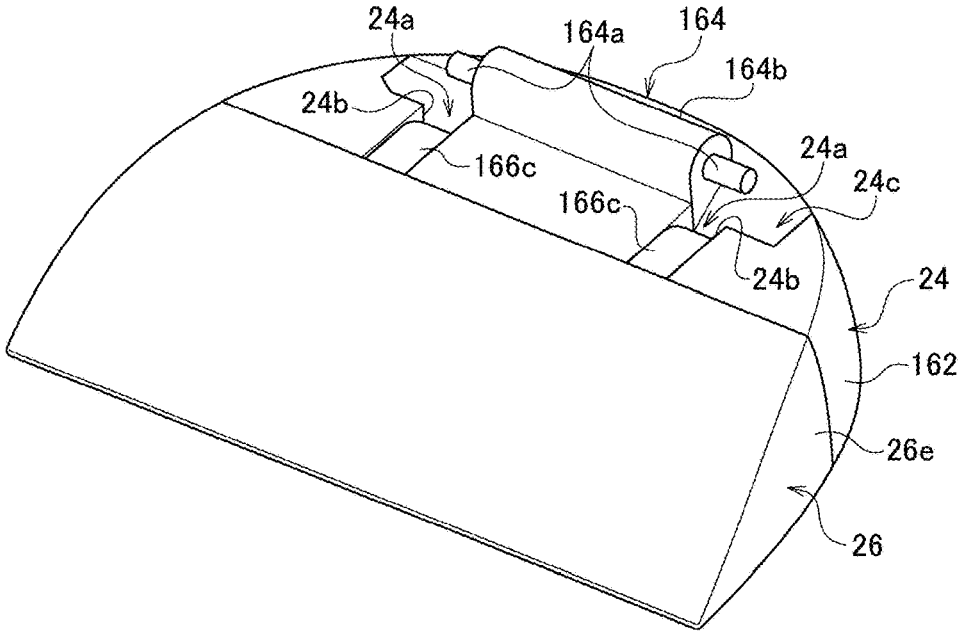
FIG. 38 is a perspective view of a function device according to the first embodiment.

FIG. 38 is a perspective view of the function device 20. The second hinge part 166*c* is provided to protrude backward from the main body portion 26*e* of the second casing 26 when the second casing 26 is at the first position (lying position). A plurality of (two) second hinge parts 166*c* are provided on the first casing 24 at intervals in the left-and-right direction Y.

The front portion of the first casing 24 is provided with a hinge housing part 24*a* that houses the second hinge part 166*c*. The hinge housing parts 24*a* are individually provided corresponding to each of the plurality of second hinge parts 166*c*. The hinge housing part 24*a* is provided to be recessed backward from the front surface portion of the first casing 24. The hinge housing part 24*a* according to the present embodiment is provided with an opening 24*b* to be opened forward and opened upward. The second hinge part 166*c* is housed to be fitted into the hinge housing part 24*a* when the second casing 26 is at the first position. At this time, the upper surface portion of the second hinge part 166*c* of the second casing 26 is provided to be flush with the upper surface portion of the first casing 24. In the present embodiment, the upper surface portion of the main body portion 26*e* of the second casing 26 is provided to be flush with the upper surface portion of the first casing 24.

As illustrated in FIG. 5, the above-described liquid supplying path 120 for supplying the cleaning liquid from the outside of the second casing 26 to the inside is provided the inside of the second hinge mechanism 166. A part of the first liquid passage 120*a* of the liquid supplying path 120 for supplying the cleaning liquid to the first discharge part 50A is provided inside one of the two second hinge mechanisms 166. A part of the second liquid passage 120*b* of the liquid supplying path 120 for supplying the cleaning liquid to the second discharge part 50B is provided inside the other of the two second hinge mechanisms 166.

Refer to FIGS. 36 and 37. A part of the liquid supplying path 120 is formed on each of the second hinge shaft 166*a*, the second hinge base portion 166*b*, and the second hinge part 166*c*, which are components of the second hinge mechanism 166. In the present embodiment, a part of the liquid supplying path 120 does not constitute the hose.

The second hinge shaft 166*a* is provided with a first liquid passage forming surface 172A that extends along an axial direction of the second hinge shaft 166*a*. The first liquid passage forming surface 172A constitutes a bottomed hole that is opened toward a side (left side in the page of FIG. 36) where the second hinge base portion 166*b* is located in the axial direction of the second hinge shaft 166*a*, and is closed toward the opposite side (right side in the page of FIG. 36) in the axial direction to the side.

The second hinge base portion 166*b* is provided with a second liquid passage forming surface 172B that forms an inner space continuous with the inner space of the first liquid passage formation surface 172A of the second hinge shaft 166*a*. The second liquid passage forming surface 172B has an upstream side portion 172Ba that extends toward the outside in the radial direction of the second hinge shaft 166*a* and a downstream side portion 172Bb that extends along the axial direction of the second hinge shaft 166*a*. The downstream side portion 172Bb of the second liquid passage forming surface 172B is formed on a deep inside of the shaft support hole 166*d*.

The second hinge part 166*c* is provided with the second liquid passage forming surface 172C that forms an inner space continuous with the inner space of the first liquid passage formation surface 172A of the second hinge shaft 166*a*. The second liquid passage forming surface 172C extends toward the outside in the radial direction of the second hinge shaft 166*a*, and an end portion thereof is connected to a liquid passage forming member such as a hose.

Since the liquid supplying path 120 is provided inside the second hinge mechanism 166 according to the present embodiment, the cleaning liquid can be supplied into the second casing 26 by using the space occupied by the components of the second hinge mechanism 166.

In particular, in the present embodiment, the liquid passage forming surfaces 172A to 172C that form a part of the liquid supplying path 120 are provided on the components of the second hinge mechanism 166. On the other hand, when the hose is inserted into the second hinge mechanism 166 and the liquid supplying path 120 is provided on the hose, the hose is twisted as the second casing 26 rotates, and therefore the countermeasure is required. In this respect, according to the present embodiment, there is an advantage that a part of the liquid supplying path 120 can be provided inside the second hinge mechanism 166 without taking measures against the twist of the hose.

Other features of the toilet seat unit 16 will be described. As illustrated in FIGS. 31 and 36, the toilet seat unit 16 includes a cable 174 that is drawn to pass through the inside of the first casing 24 and the second casing 26. The cable 174 connects the open-close valve 126A that is a functional component inside the second casing 26, and the controller 124 that is an electronic component arranged outside the second casing 26. The controller 124 supplies a control signal and power to the open-close valve 126A through the cable 174.

A cable insertion hole 166*e* for inserting the cable 174 is formed on the second hinge part 166*c* of the second hinge mechanism 166. The cable insertion hole 166*e* according to the present embodiment is formed to extend along the same direction as the extending direction of the second liquid passage forming surface 172C of the second hinge part 166*c*.

As illustrated in FIG. 31, the toilet seat 22 is rotatably attached to the toilet body 14 via the base plate 160 of the first casing 24 by using the first hinge mechanism 164. The first hinge mechanism 164 includes a first hinge shaft 164*a* that is rotatably provided integrally with the toilet seat 22 and a first hinge base portion 164*b* that is provided on the base plate 160 of the first casing 24 and rotatably supports the first hinge shaft 164*a*. It can be said that the toilet seat 22 is rotatably connected to the toilet body 14 via the first hinge shaft 164*a* around the first hinge shaft 164*a*.

As illustrated in FIG. 38, the first hinge base portion 164*b* is exposed without being concealed by the case cover 162 of the first casing 24. The first hinge base portion 164*b* according to the present embodiment is provided to protrude upward from the upper surface portion of the first casing 24 and has a tubular shape extending in the left-and-right direction Y.

As illustrated in FIG. 32, the second hinge shaft 166*a* is arranged in front of the first hinge shaft 164*a*. As a result, as illustrated in FIG. 32C, when the toilet seat 22 is at the upright position and the second casing 26 is at the second position (upright position), the positions of the toilet seat 22 and the second casing 26 can be shifted to the front-and-rear direction X, which becomes easier to design to avoid interference between the toilet seat 22 and the second casing 26. Note that the second hinge shaft 166*a* according to the present embodiment is arranged below the first hinge shaft 164*a*.

As illustrated in FIGS. 2 and 38, the first casing 24 is provided with a avoid part 24*c* for avoiding interference with the rear end portion of the toilet seat 22 when the toilet seat 22 rotates to the upright position. The avoid part 24*c* according to the present embodiment is a downward recessed portion that is provided on the upper surface portion of the first casing 24. In addition, a toilet lid 176 is rotatably attached to the toilet body 14 of the first casing 24 via a first hinge shaft 164*a* common to the toilet seat 22.

Other features of the toilet device 10 will be described. As described above, the toilet seat unit 16 has the first discharge part 50A, the second discharge part 50B, and the third discharge part 50C that can discharge the cleaning liquid. The first discharge part 50A to the third discharge part 50C clean the inside of the toilet bowl 12 of the toilet body 14 by forming the in-bowl flows Fc, Fd, and Fe1 to Fe3 by the cleaning liquid discharged from themselves. It can be said that the first discharge part 50A to the third discharge part 50C can discharge the cleaning liquid for cleaning the toilet bowl 12.

As illustrated in FIG. 2, the upper portion of the toilet bowl 12 is not provided with a discharge part that can discharge the cleaning liquid for cleaning the toilet bowl 12. In this present embodiment, it can be said that the toilet bowl 12 is not provided with the discharge part, but the toilet bowl 12 is cleaned by using the discharge parts 50A, 50B, and 50C provided on the toilet seat unit 16. The upper portion of the toilet bowl 12 according to the present embodiment is circumferentially continuous around the vertical line passing through the center Cq (see FIG. 23) of the upper end opening 12*b* of the toilet bowl 12. In addition, in the present embodiment, no discharge part that can discharge the cleaning liquid is provided below the toilet bowl 12.

As a result, since there is no discharge part on the upper portion of the toilet bowl 12, it becomes easier to wipe the inner peripheral surface on the top of the toilet bowl 12 in the circumferential direction without being hindered, and the cleanability of the toilet bowl 12 becomes good. Moreover, since there is no discharge part on the upper portion of the toilet bowl 12, the inner peripheral surface on the upper part of the toilet bowl 12 has a neat structure, and the good design can be obtained.

An inlet 70*a* of the trap part 70 of the toilet body 14 described above is open to the inner wall surface on the front side of the toilet bowl 12. There is no opening portion on the rear inner wall of the rear side of the toilet bowl 12, in addition to the inlet 70*a* of the trap part 70. This makes it difficult to visually recognize the inlet 70*a* of the trap part 70 when the inside of the toilet bowl 12 of the toilet body 14 is looked into from the front side. Therefore, when the inside of the toilet bowl 12 is looked into from the front side, not only the upper portion of the toilet bowl 12 but also the bottom of the toilet bowl 12 has a clean structure, and the good design can be obtained.

Second Embodiment

Figure 39B:
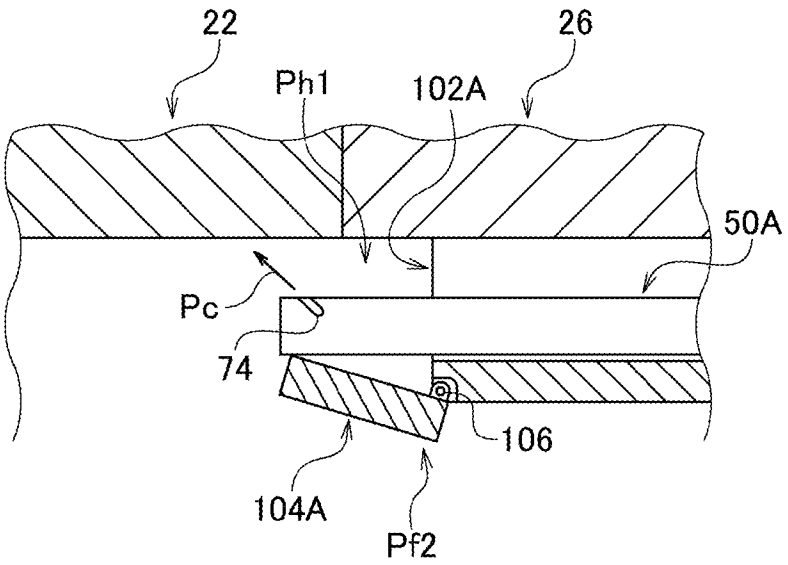
FIG. 39B is another diagram illustrating a part of the toilet device according to a second embodiment.
Figure 39A:
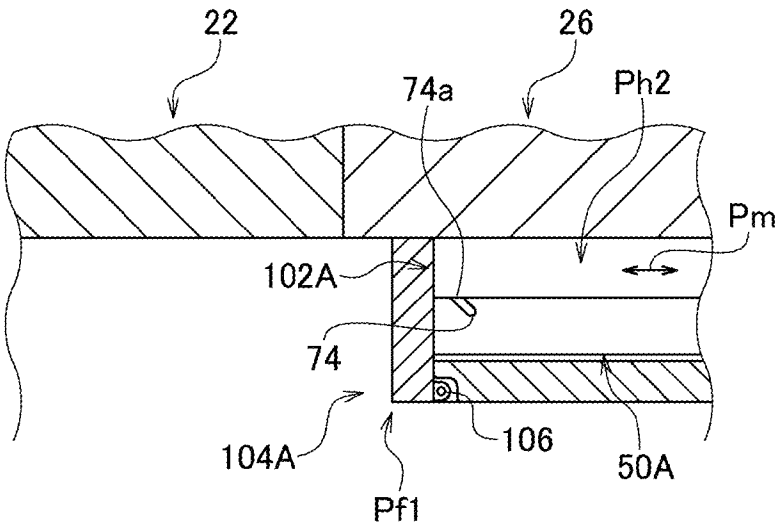
FIG. 39A is a diagram illustrating a part of the toilet device according to a second embodiment.

FIG. 39 is a diagram illustrating a part of a toilet device 10 according to the second embodiment. In FIG. 39A, a shutter 104A is at a concealed position Pf1, and in FIG. 39B, the shutter 104A is at an exposed position Pf2. The present embodiment is mainly related to the second ingenuity.

A discharge part 50A according to the present embodiment is provided separately from the shutter 104A. Further, the discharge part 50A according to the present embodiment has a long shape as a whole, and is supported by the second casing 26 to be linearly movable in a forward/backward direction Pm. A cleaning liquid outlet 76 of an discharge hole 74 is opened on an outer peripheral surface of discharge part 50A.

The driving mechanism 108A (not illustrated) according to the present embodiment drives the discharge part 50A in the forward/backward direction Pm to move the discharge part 50A between the advanced position Ph1 and the retreated position Ph2, and move the shutter 104A between the concealed position Pf1 and the exposed position Pf2.

Specifically, as illustrated in FIG. 39B, the discharge part 50A applies a pressing force to the shutter 104A when driven by to one side (left side in FIG. 39B) in the forward/backward direction Pm by the driving mechanism 108A. As a result, the discharge part 50A moves the shutter 104A in the direction in which the opening portion 102A is opened as the shutter 104A rotates. As a result, the discharge part 50A is moved to the advanced position Ph1 where the discharge part 50A advances to the outside from the opening portion 102A in which the shutter 104A is opened. Further, the shutter 104A is moved to the exposed position Pf2 where the discharge hole 74 of the discharge part 50A is exposed to the outside. At this time, by hitting the back surface of the toilet seat 22 with the cleaning liquid discharged from the discharge hole 74 of the discharge part 50A in the discharge direction Pc, the cleaning liquid can run along the back surface of the toilet seat 22.

A biasing member (not illustrated) applies a biasing force to the shutter 104A in the direction in which the opening portion 102A of the second casing 26 is closed. When the discharge part 50A is driven to the other side (the right side in the figure) in the forward/backward direction Pm by the driving mechanism 108A, as illustrated in FIG. 39A, the discharge part 50A is moved to the retreated position Ph2 where the discharge part 50A is retreated inward from the opening portion 102A. As a result, the shutter 104A moves by the biasing force of the biasing member in the direction in which the opening portion 102A is closed as the shutter 104A rotates. As a result, the shutter 104A is moved to the concealed position Pf1 where the shutter 104A conceals the discharge hole 74 of the discharge part 50A from the outside.

In this way, the discharge part 50A can move forward and backward with respect to the opening portion 102A of the second casing 26, but the specific structure thereof is not particularly limited.

Third Embodiment

Figure 40B:
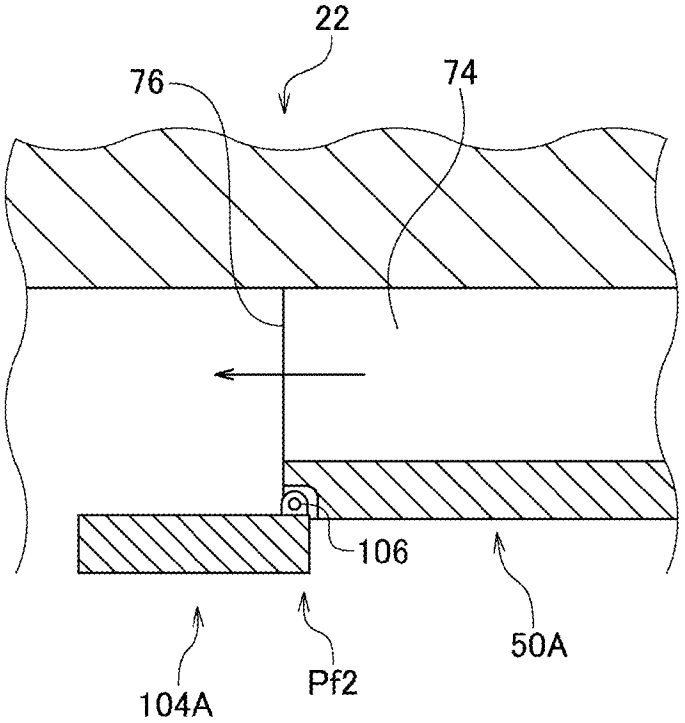
FIG. 40B is another diagram schematically illustrating a part of a toilet seat according to a third embodiment.
Figure 40A:
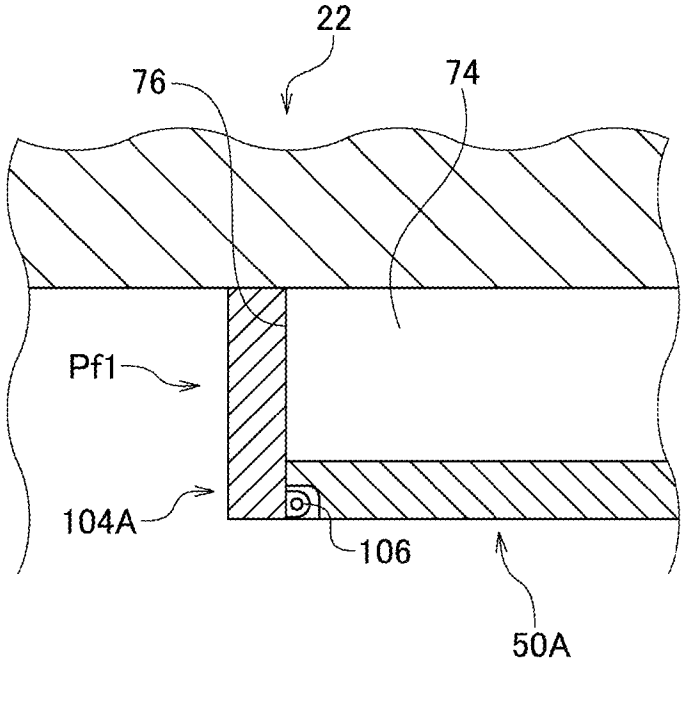
FIG. 40A is a diagram schematically illustrating a part of a toilet seat according to a third embodiment.

FIG. 40 is a diagram schematically illustrating a part of a toilet seat 22 according to a third embodiment. The present embodiment is mainly related to the second ingenuity. A discharge part 50A according to the present embodiment is provided not on a second casing 26 of a function device 20 but on a back surface of a toilet seat 22.

A shutter 104A according to the present embodiment can open and close an discharge hole 74 of the discharge part 50A instead of an opening portion 102A of the second casing 26. The shutter 104A according to the present embodiment can open and close the discharge hole 74 of the corresponding discharge part 50A by rotating around the rotating shaft 106. The shutter 104A closes the discharge hole 74 when being at the concealed position Pf1 where the discharge hole 74 is concealed from the outside. The shutter 104A opens the discharge hole 74 when being at an exposed position Pf2 that exposes the discharge hole 74 to the outside. At this time, by discharging a cleaning liquid from the discharge hole 74 of the discharge part 50A in an discharge direction Pc, the cleaning liquid can run along the back surface of the toilet seat 22.

Thus, the shutter 104A may conceal the discharge hole 74 by closing the discharge hole 74, or may conceal the discharge hole 74 by closing the opening portion 102A of a housing member.

Fourth Embodiment

Figure 41C:
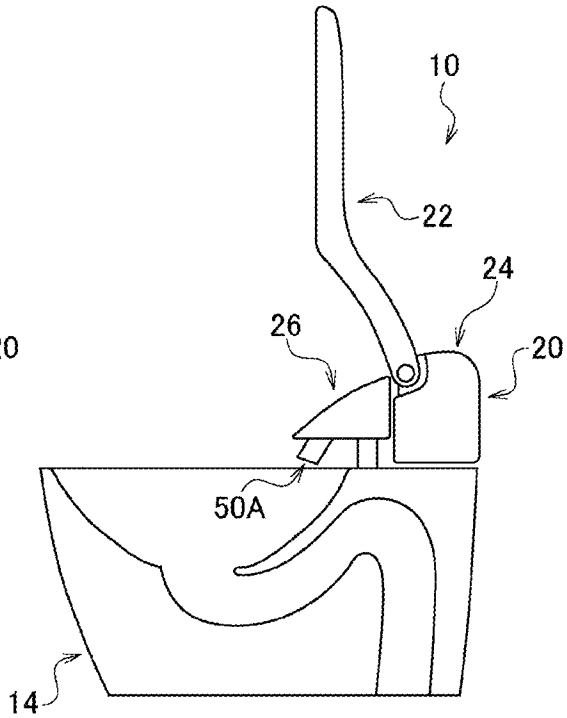
FIG. 41C is a more other diagram schematically illustrating a part of a toilet device according to a fourth embodiment.
Figure 41B:
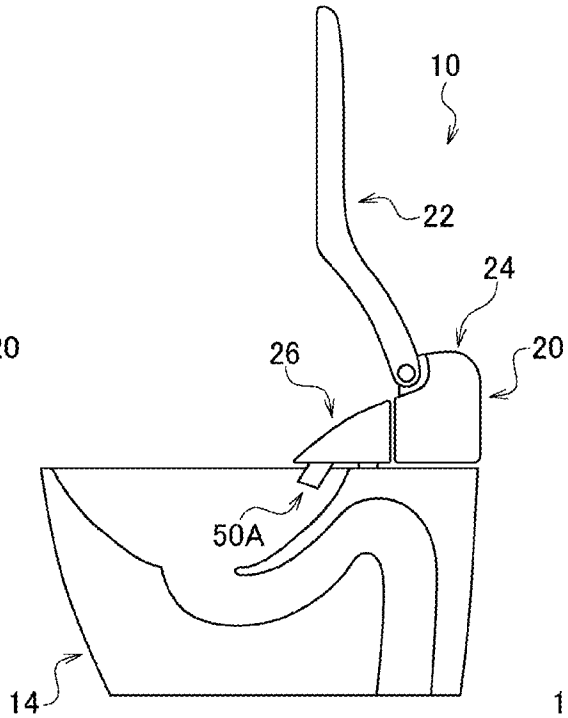
FIG. 41B is another diagram schematically illustrating a part of a toilet device according to a fourth embodiment.
Figure 41A:
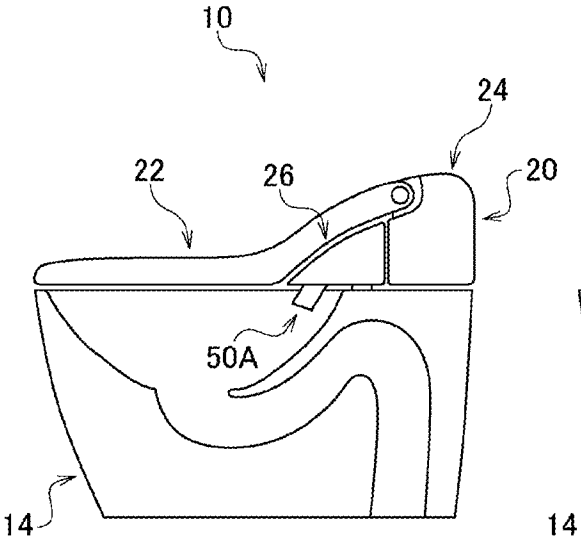
FIG. 41A is a diagram schematically illustrating a part of a toilet device according to a fourth embodiment.

FIG. 41 is a diagram schematically illustrating a part of a toilet device 10 according to a fourth embodiment. FIG. 41A illustrates an example in which a toilet seat 22 is at a lying position and a second casing 26 is at the first position. FIG. 41B illustrates an example in which a toilet seat 22 is at an upright position and the second casing 26 is at the first position. FIG. 41C illustrates an example in which a toilet seat 22 is at the upright position and the second casing 26 is at a second position.

The present embodiment is mainly related to the fifth ingenuity. In providing a discharge part 50A on the second casing 26 of the function device 20, the example in which the second casing 26 is rotatably attached to a toilet body 14 via a first casing 24 has been described.

In addition to this, the second casing 26 may be attached to the toilet body 14 to be movable in an up-and-down direction. Specifically, the second casing 26 is movable between the first position where the second casing 26 is placed on an upper surface portion of the toilet body 14 and a second position where the second casing 26 is separated upward from the upper surface portion of the toilet body 14. Even in this case, the effect described in (E) can be obtained.

Fifth Embodiment

Figure 42C:
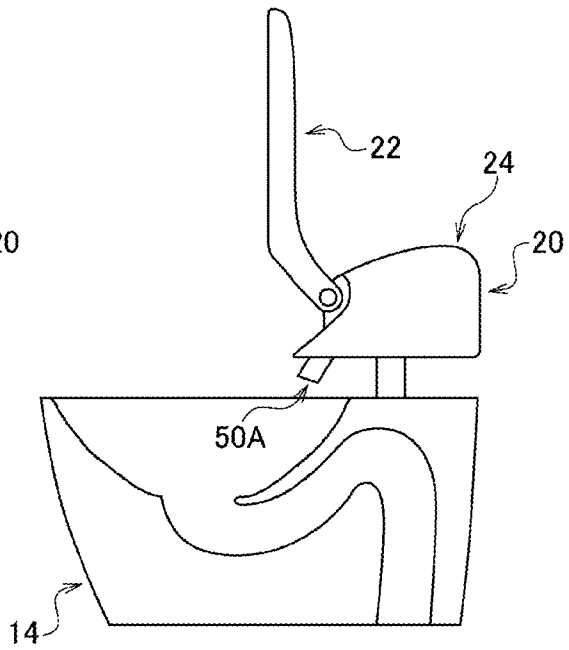
FIG. 42C is a more other diagram schematically illustrating a part of a toilet device according to a fifth embodiment.
Figure 42B:
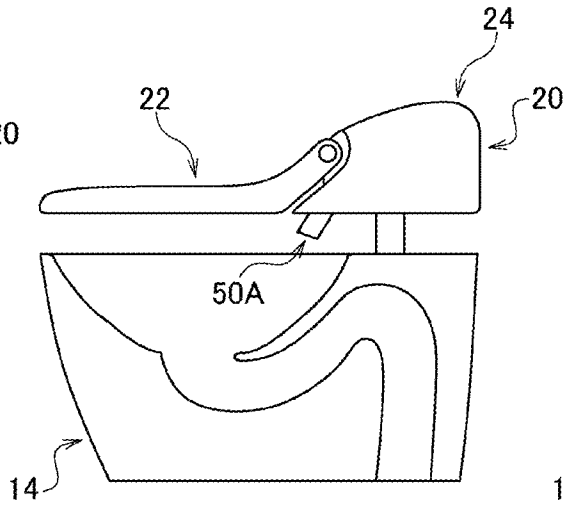
FIG. 42B is another diagram schematically illustrating a part of a toilet device according to a fifth embodiment.
Figure 42A:
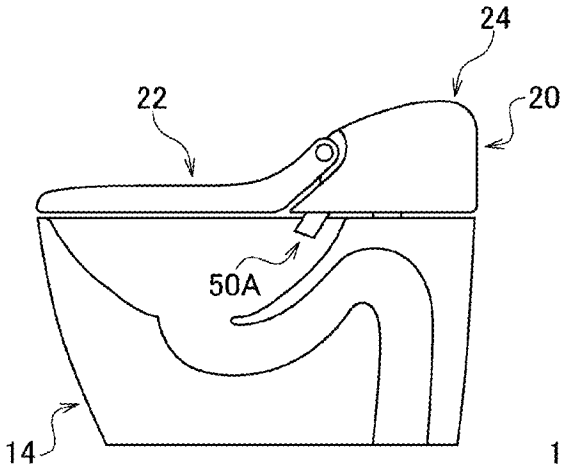
FIG. 42A is a diagram schematically illustrating a part of a toilet device according to a fifth embodiment.

FIG. 42 is a diagram schematically illustrating a part of a toilet device 10 according to a fifth embodiment. FIG. 42A illustrates an example in which a toilet seat 22 is at a lying position and a first casing 24 is at a first position. FIG. 42B illustrates an example in which the toilet seat 22 is at the lying position and the first casing 24 is at a second position. FIG. 42C illustrates an example in which the toilet seat 22 is at an upright position and the first casing 24 is at the second position.

The present embodiment is mainly related to the fifth ingenuity. In providing the discharge part 50A in a function device 20, the discharge part 50A may be provided on the first casing 24 of the function device 20, and the second casing 26 may be omitted.

The first casing 24 may be attached to a toilet body 14 to be movable in an up-and-down direction. Specifically, the first casing 24 is movable between the first position where the first casing 24 is placed on an upper surface portion of the toilet body 14 and the second position where the first casing 24 is separated upward from the upper surface portion of the toilet body 14. Even in this case, the effect described in (E) can be obtained.

Sixth Embodiment

Figure 43:
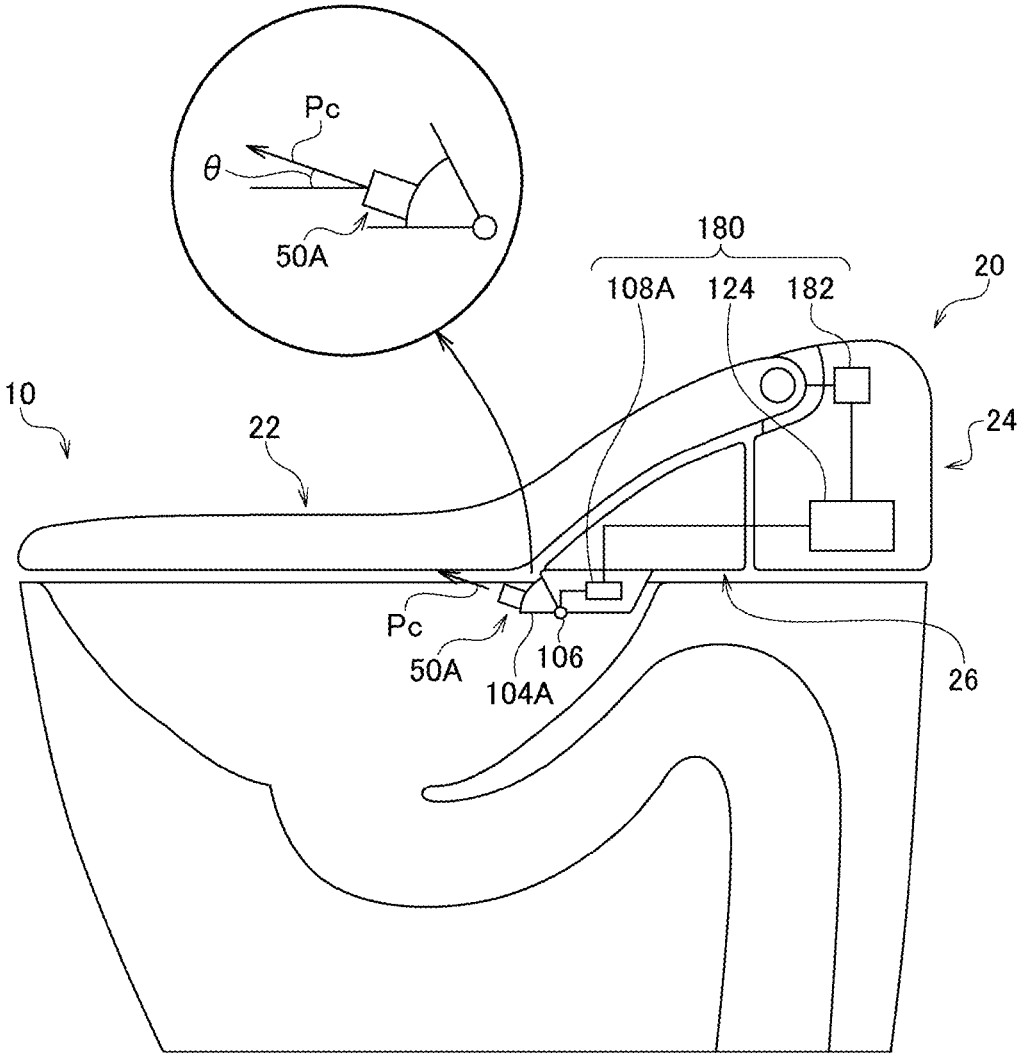
FIG. 43 is a side cross-sectional view schematically illustrating a toilet device according to a sixth embodiment.
Figure 44:
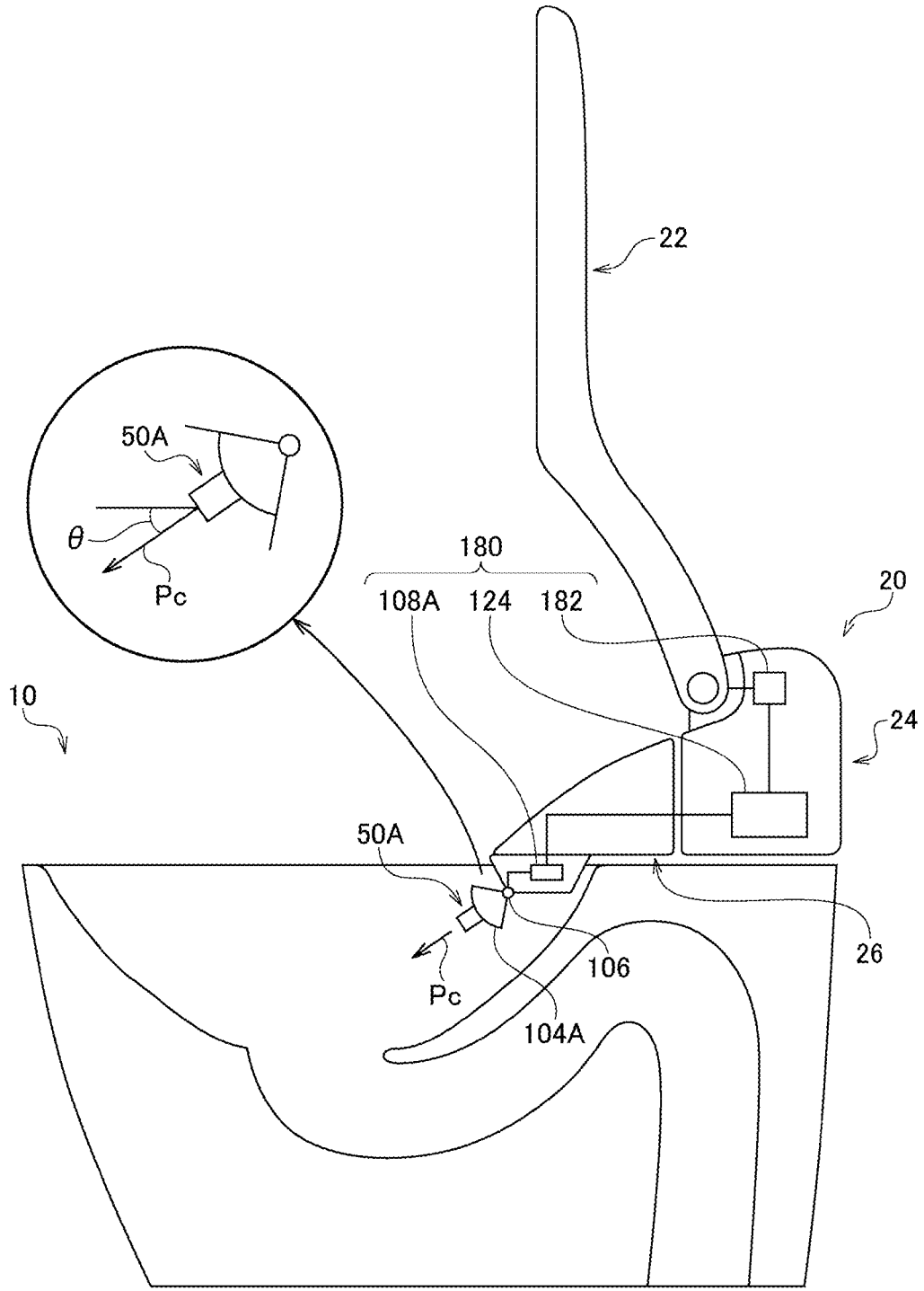
FIG. 44 is another side cross-sectional view schematically illustrating the toilet device according to the sixth embodiment.

FIGS. 43 and 44 are side cross-sectional views schematically illustrating a part of a toilet device 10 according to a sixth embodiment. FIG. 43 illustrates a state in which a toilet seat 22 is at a lying position, and FIG. 44 illustrates a state in which the toilet seat 22 is at an upright position. As described above, the above-described discharge part 50A is rotatably attached to a second casing 26 of a function device 20 via a rotating shaft 106.

An angle formed by an discharge direction Pc of the discharge part 50A with respect to a horizontal plane is referred to as an discharge angle θ. As illustrated in FIG. 43, the discharge angle θ when the discharge direction Pc is upward is a negative angle, and as illustrated in FIG. 44, the discharge angle θ when the discharge direction Pc is downward is a positive angle. At this time, the discharge part 50A can change the discharge angle θ in the range of −90° or more and 90° or less by rotating around the rotating shaft 106.

The toilet device 10 according to the present embodiment includes a changing mechanism 180 that can change the discharge direction Pc in which the discharge part 50A discharges a cleaning liquid according to a rotational position of the toilet seat 22 in a rotational range. The changing mechanism 180 according to the present embodiment includes a toilet seat sensor 182 that can detect the rotational position of the toilet seat 22, a driving mechanism 108A that can drive the discharge part 50A, and a controller 124 that can control the driving mechanism 108A.

The toilet seat sensor 182 is, for example, a combination of a hall IC and a magnet, a micro switch, or the like. The toilet seat sensor 182 according to the present embodiment can detect that the toilet seat 22 is at the lying position and can detect that the toilet seat 22 is at the upright position. When the toilet seat sensor 182 detects the rotational position of the toilet seat 22, the toilet seat sensor 182 outputs a position signal indicating the rotational position to a controller 124.

The driving mechanism 108A is structured using a motor or the like. The driving mechanism 108A according to the present embodiment is connected to a rotating shaft 106, and changes an discharge direction Pc of the discharge part 50A up and down by rotating the discharge part 50A around the rotating shaft 106 integrally with the rotating shaft 106. Note that the driving mechanism 108A can drive the shutter 104A together with the discharge part 50A, as in the first embodiment, but can drive only the discharge part 50A regardless of the shutter 104A.

The controller 124 can change the discharge direction Pc of the discharge part 50A by driving the discharge part 50A through the control of the driving mechanism 108A. The controller 124 according to the present embodiment can change the discharge direction Pc of the discharge part 50A to the up and down by changing the rotational position of the discharge part 50A through the control of the driving mechanism 108A.

As illustrated in FIG. 43, the controller 124 changes the discharge direction Pc of the discharge part 50A so that the cleaning liquid is discharged upward when the position signal indicating that the toilet seat 22 is at the lying position is received from the toilet seat sensor 182. It can be said that the changing mechanism 180 sets the discharge direction Pc of the discharge part 50A so that the cleaning liquid is discharged upward when the toilet seat 22 is at the lying position. At this time, the changing mechanism 180 changes the discharge direction Pc of the discharge part 50A so that the cleaning liquid hits the back surface of the toilet seat 22. The changing mechanism 180 changes the discharge angle θ to a range of −90° or more and less than 0° when the toilet seat 22 is at the lying position. The cleaning liquid discharged from the discharge part 50A in this state hits the back surface of the toilet seat 22 and is then runs along the back surface.

As illustrated in FIG. 44, the controller 124 changes the discharge direction Pc of the discharge part 50A so that the cleaning liquid is discharged downward when the position signal indicating that the toilet seat 22 is at the upright position is received from the toilet seat sensor 182. It can be said that the changing mechanism 180 sets the discharge direction Pc of the discharge part 50A so that the cleaning liquid is discharged downward when the toilet seat 22 is at the upright position. The changing mechanism 180 changes the discharge angle θ to a range of exceeding 0° and 90° or less when the toilet seat 22 is at the upright position. The cleaning liquid discharged from the discharge part 50A in this state is hit to the inner surface of the toilet bowl 12 of the toilet body 14 without hitting the back surface of the toilet seat 22.

According to the above-described toilet device 10, by using the changing mechanism 180, it can be designed so that the discharge direction Pc of the discharge part 50A is a desired condition according to the rotational position of the toilet seat 22, and the degree of freedom in design is increased.

Further, when the toilet seat 22 is at the lying position, the back surface of the toilet seat 22 can be cleaned with the cleaning liquid by changing the discharge direction Pc of the discharge part 50A so that the cleaning liquid is discharged upward. Further, by changing the discharge direction Pc of the discharge part 50A so that the cleaning liquid is discharged downward when the toilet seat 22 is at the upright position, it is possible to prevent the cleaning liquid from scattering outside the toilet bowl 12. Therefore, it is possible to prevent the cleaning liquid from scattering around when the toilet seat 22 is at the upright position and obtain the good usability while cleaning the back surface of the toilet seat 22.

Note that the controller 124 according to the present embodiment changes the discharge direction Pc of the discharge part 50A in response to the position signal when receiving the position signal from the toilet seat sensor 182. In addition to this, when the controller 124 may also change the discharge direction Pc of the discharge part 50A according to the position signal based on the position signal output from the toilet seat sensor 182 when receiving the above-described cleaning start command.

The example has been described in which the changing mechanism 180 according to the present embodiment can change the discharge direction Pc of the discharge part 50A under the control of the controller 124. The changing mechanism 180 only needs to be able to change the discharge direction Pc of the discharge part 50A according to the rotational position of the toilet seat 22, and the control by the controller 124 is not essential.

For example, the changing mechanism 180 may have a power transmission mechanism that mechanically transmits the rotating operation of the toilet seat 22 as the rotating operation of the discharge part 50A. The transmission mechanism is configured by using, for example, gears, links, belts, and the like. The transmission mechanism changes the discharge direction Pc of the discharge part 50A to the upward direction when the toilet seat 22 is at the lying position. In addition, the transmission mechanism changes the discharge direction Pc of the discharge part 50A to the downward direction when the toilet seat 22 is at the upright position.

Further, the changing mechanism 180 may change the discharge range instead of the discharge direction Pc of the discharge part 50A. To achieve this, the changing mechanism 180 has, for example, a restricting member for restricting the discharge range of the discharge part 50A. The discharge part 50A has a wide-angle discharge range so that at least a part of the cleaning liquid is discharged upward. The restricting member is disposed inside the discharge hole 74 of the discharge part 50A or outside the discharge hole 74, and can be operated according to the rotating position of the toilet seat 22 by the driving mechanism or the transmission mechanism described above.

As such an operation mode, the restricting member is moved to a position where the discharge range of the discharge part 50A is not restricted when the toilet seat 22 is at the lying position. As a result, the changing mechanism 180 sets the discharge range in the up-and-down direction of the discharge part 50A so that at least a part of the cleaning liquid is discharged upward. At this time, the discharge part 50A discharges the cleaning liquid both upward and downward.

In addition, as the operation mode described above, the restricting member is moved to the position where the discharge range of the discharge part 50A is restricted when the toilet seat 22 is at the upright position. At this time, the restricting member restricts the discharge range of the discharge part 50A so that the cleaning liquid is discharged downward. As a result, it can be said that the changing mechanism 180 sets the discharge range in the up-and-down direction of the discharge part 50A so that the cleaning liquid is discharged downward. The changing mechanism 180 increases the discharge range in the up-and-down direction of the discharge part 50A when the toilet seat 22 is at the lying position, and reduces the discharge range when the toilet seat 22 is at the upright position. As a result, it is possible to prevent the cleaning liquid from scattering around when the toilet seat 22 is at the upright position and obtain the good usability while cleaning the back surface of the toilet seat 22.

In addition, by using the changing mechanism 180, the discharge range of the discharge part 50A can be designed to be a desired condition according to the rotational position of the toilet seat 22, and the degree of freedom in design is increased.

The present disclosure has been described above based on the embodiments. Next, a modification of each component will be described.

Although the toilet seat 22 has been described as an example of being rotatably attached to the toilet body 14 via the function device 20, the toilet seat 22 may be directly rotatably attached to the toilet body 14. In this case, the toilet seat unit 16 does not have to include the function device 20.

In addition to the first bowl facing surface 34 of the toilet seat 22, the discharge parts 50A and 50B may discharge the cleaning liquid to run along locations other than the first bowl facing surface 34.

The example has been described in which the guides 40 and 42 have been described as being provided on the toilet seat 22, but the example thereof is not limited thereto. For example, in addition to the toilet seat 22, the guides 40 and 42 may be provided on the toilet body 14. The example in which the first guide 40 and the second guide 42 are structured by different parts of the same inner peripheral side protrusion 56 has been described, but the first guide 40 and the second guide 42 may be structured by different parts separated from each other.

The example has been described in which the inner peripheral side protrusion 56 is changed so that the flow direction of the cleaning liquid running along the outer peripheral surface 56*a* in the circumferential direction is bent toward the inside in the radial direction by the Coanda effect, and thus guides the cleaning liquid so that the cleaning liquid runs along the inner peripheral side of the first bowl facing surface 34 of the toilet seat 22. In addition to this, the cleaning liquid may be guided to run along the inner peripheral side portion of the first bowl facing surface 34 so that the flow direction of the cleaning liquid that runs along the "inner peripheral surface of the inner peripheral side protrusion 56" in the circumferential direction is bent to the inside of the radial direction without using the Coanda effect.

The shape of the inner peripheral side protrusion 56 is not particularly limited as long as the inner peripheral side protrusion 56 protrudes downward from the inner peripheral side portion of the first bowl facing surface 34 of the toilet seat 22. The shape of the outer peripheral side protrusion 58 is also not particularly limited as long as the outer peripheral side protrusion 58 protrudes downward from the outer peripheral side portion of the first bowl facing surface 34. It can be said that any of the inner peripheral side protrusion 56 or the outer peripheral side protrusion 58 can be simply a projection, instead of the ridge continuous in the circumferential direction. Further, the inner peripheral side protrusion 56 or the outer peripheral side protrusion 58 may be arranged at an arbitrary position in relation to the pooled water 72 of the toilet body 14.

The shape that satisfies the conditions described in (A-1) and (A-2) above is not particularly limited. As the shape that satisfies this condition, the outer peripheral surface 56*a* of the inner peripheral side protrusion 56 may have a planar shape, a convex curved surface shape, and the like in the vertical cross section passing through the center Cp of the toilet seat 22. Similarly, the inner peripheral surface 58*a* of the outer peripheral side protrusion 58 may also have a planar shape, a convex curved surface shape, or the like in the same vertical cross section.

The specific shape of the discharge hole 74 is not particularly limited. The discharge hole 74 may be formed, for example, so that an inner width of the discharge hole 74 does not increase toward the cleaning liquid outlet 76 but has the same size.

The flow restricting structure 64 is not limited to the upper end edge portion of the toilet bowl 12. The flow restricting structure 64 may be, for example, a seal member sandwiched between the toilet body 14 and the toilet seat 22.

The example has been described in which the first inclined surface 82 is provided in the range from the rear end portion of the right half region 38R to the peripheral end portion 38Ra on the front side. The first inclined surface 82 may be provided in at least a part of the range where the cleaning liquid discharged from the first discharge part 50A reaches. For example, when the cleaning liquid discharged from the first discharge part 50A runs in the range from the central portion 38Rb of the right half region 38R in the front-and-rear direction Y to the peripheral end portion 38Ra on the front side, the first inclined surface 82 is provided over the entire range or may be provided only in a part of the range.

When there is no second discharge part 50B, the second inclined surface 86 corresponding to the second discharge part 50B is not provided and only the first inclined surface 82 corresponding to the first discharge part 50A may be provided. In this case, when the cleaning liquid discharged from the first discharge part 50A runs in the range from the right half region 38R to the left half region 38L, the first inclined surface 82 may be provided in the entire range.

The crest portion 88 may be partially constituted by at least the lower end portion of the first inclined surface 82 and the lower end portion of the second inclined surface 86. For example, the crest portion 88 may be constituted by the lower end portion of the first inclined surface 82 and the lower end portion of the second inclined surface 86 and a flat surface continuous with the lower end portion of the first inclined surface 82 and the lower end portion of the second inclined surface 86.

In the first to third embodiments, the example has been described in which the discharge parts 50A and 50B discharge the cleaning liquid for cleaning the back surface of the toilet seat 22 from the discharge hole 74, and the shutters 104A and 104B conceal or expose the discharge hole 74. In addition to this, the discharge parts 50A and 50B may discharge the cleaning liquid for cleaning the inner surface of the toilet bowl 12 of the toilet body 14 from the discharge hole 74, and the shutters 104A and 104B may conceal or expose the discharge hole 74.

The second casing 26 has been described as an example of a housing member that houses the discharge parts 50A and 50B. The housing member is not limited to the second casing 26 and may be constituted by, for example, the toilet seat 22. In this case, the shutters 104A and 104B are attached to the housing member that is separate from the toilet body 14. Further, the housing member may be constituted by the toilet body 14.

The example has been described in which the discharge parts 50A and 50B and the shutters 104A and 104B are configured as a part of the same member, but may be configured separately. In addition, the example has been described in which the discharge parts 50A and 50B have the closing part 112 that closes the opening portions 102A and 102B of the housing member when the discharge parts 50A and 50B are at the advanced position Ph1, but the closing part 112 may not be necessary.

The example has been described in which the toilet device 10 (toilet seat unit 16) uses the controller 124 that is structured to control the switching mechanism 122 to allow the first discharge part 50A to end the first discharge operation and then the second discharge part 50B to start the second discharge operation. The specific means for satisfying this condition is not particularly limited. For example, it may be realized by changing the path lengths of the first liquid passage 120*a* and the second liquid passage 120*b* of the liquid supplying path 120 in the flow direction.

The example has been described in which the toilet device 10 (toilet seat unit 16) forms the first in-bowl flow Fc by using the cleaning liquid forming the first seat back flow Fa, and forms the second in-bowl flow Fd by using the cleaning liquid forming the second seat back flow Fb. The specific mode of the flow formed on the toilet bowl 12 of the toilet body 14 is not particularly limited. For example, the seat back flows Fa and Fb may be used to form a flow, which flows into the bottom of the toilet bowl 12, in the toilet bowl 12, without swirling in the toilet bowl 12.

The example has been described in which the switching mechanism 122 is constituted by a plurality of open-close valves 126A to 126D, but the specific example thereof is not particularly limited. For example, the switching mechanism 122 may be constituted by a single switching valve. Further, the common open-close valve 126C of the embodiment may not be necessary.

The example has been described in which the third discharge part 50C is provided on the lower surface portion of the function device 20, but the position thereof is not particularly limited. For example, the third discharge part 50C may be provided on the back surface of the toilet seat 22. Further, the third discharge part 50C may include only the liquid discharge hole for bowls 132A and 132B, or may include only the third liquid discharge hole 132C. In addition, the third discharge part 50C may not be necessary.

The example has been described in which the seat back discharge parts 50A and 50B discharge the cleaning liquid for cleaning the back surface of the toilet seat 22 from the discharge hole 74. In addition to this, the discharge parts 50A and 50B may discharge the cleaning liquid for cleaning the inner surface of the toilet bowl 12 of the toilet body 14. In any case, from the viewpoint of obtaining the above-described effect (E), it is premised that the seat back discharge parts 50A and 50B are provided on the function device 20.

The example in which the toilet seat 22 is rotatably attached to the function device 20 has been described. From the viewpoint of obtaining the above-mentioned effect (E), the toilet seat 22 may be movably attached to the function device 20 regardless of the movement mode thereof. Further, from the viewpoint of obtaining the above-described effect (E), the toilet seat 22 may be detachably attached to the function device 20 even when the toilet seat 22 is attached immovably to the function device 20. As a result, when moving the toilet seat 22 separated from the function device 20 for the purpose of maintenance or the like, the weight of the cleaning liquid inside the discharge parts 50A and 50B will not be added to the toilet seat 22, thereby avoiding the case where the load to be applied for moving the toilet seat 22 increases. Note that the toilet seat 22 may be movably and detachably attached to the toilet body 14.

The example has been described in which the seat back discharge parts 50A and 50B can discharge the cleaning liquid having the upward velocity component, but the seat back discharge parts 50A and 50B may discharge the cleaning liquid having only the velocity component in the horizontal direction. In addition, the seat back discharge parts 50A and 50B can discharge the cleaning liquid having only the upward velocity component. In this case, a structure for guiding the flow of the cleaning liquid may be provided on the back surface of the toilet seat so that the cleaning liquid run along the back surface of the toilet seat 22 having the horizontal velocity component.

The example has been described in which the discharge parts 50A, 50B, and 50C are provided behind the front end portion 20*a* of the function device 20, but the discharge parts 50A, 50B, and 50C may be provided on front of the front end portion 20*a*. The example has been described in which the discharge parts 50A, 50B, and 50C are provided in the left-and-right direction Y with respect to the nozzle 142, but the discharge parts 50A, 50B, and 50C may be provided on positions unrelated to the nozzle 142.

The example has been described in which each of the first discharge part 50A and the second discharge part 50B discharge the cleaning liquid so that the cleaning liquid runs in the opposite direction to each other on the back surface of toilet seat 22. The region where the seat back flows Fa and Fb running in the opposite direction to each other are formed is not limited to the front end region 39 of the toilet seat 22. For example, the region may be the central portion 38Rb of the right half region 38R of the toilet seat 22 in the front-and-rear direction Y.

The example has been described in which the second casing 26 of the function device 20 is rotatably attached to the toilet body 14 via the first casing 24, but the second casing 26 may be directly rotatably attached to the toilet body 14. When the second casing 26 is rotatably attached to the toilet body 14, the toilet seat unit 16 does not have to include the discharge parts 50A and 50B. Further, when the second casing 26 is rotatably attached to the toilet body 14, the discharge parts 50A and 50B may be provided not on the second casing 26 but on the toilet seat 22.

The example has been described in which a part of the liquid supplying path 120 inside the second hinge mechanism 166 is constituted by the liquid passage forming surfaces 172A to 172C of the components of the second hinge mechanism 166. The configuration of the part of the liquid supplying path is not limited thereto, and may be constituted by a hose that is inserted inside the second hinge mechanism 166.

The positional relationship between the second hinge shaft 166*a* that rotatably connects the second casing 26 to the toilet body 14 and the first hinge shaft 164*a* that rotatably connects the toilet seat 22 to the toilet body 14 is not particularly limited. For example, the second hinge shaft 166*a* may be arranged at the same position as the first hinge shaft 164*a* in the front-and-rear direction X, or may be arranged behind the first hinge shaft 164*a*. Further, the example has been described in which the first hinge shaft 164*a* and the second hinge shaft 166*a* are configured separately, but the first hinge shaft 164*a* and the second hinge shaft 166*a* may be configured by using the same member.

The example has been described in which the discharge part capable of discharging the cleaning liquid for cleaning the inside of the toilet bowl 12 is not provided on the upper part of the toilet bowl 12 of the toilet body 14, but the discharge part may also be provided.

In order to obtain the effect of (F1), the bottom of the toilet bowl 12 may be provided with the discharge part for discharging the cleaning liquid toward the trap part 70 to form a flow for promoting the discharge of dirt.

The example has been described in which the inlet 70*a* of the trap part 70 is opened on the front inner wall surface of the toilet bowl 12, but the position of the inlet 70*a* is not particularly limited. For example, the inlet 70*a* of the trap part 70 may be opened on the inner wall surface on the rear side of the toilet bowl 12.

Some embodiments and modifications of the disclosures herein have been described above in detail. The above-described embodiments and modifications are merely specific examples for implementing the present disclosures herein. The contents of some embodiments and modifications do not limit the technical scope of the present disclosures herein, and various changes in design such as modifications, additions, and deletions of components can be made without departing from the spirit of the disclosures herein. In the above-described embodiment, the contents such as "of the embodiment" and "in the embodiment" are emphasized with respect to the contents in which such a design change is possible, the change in design is permitted even if the contents are not described in such a notation. The hatching attached to the cross section of the drawing does not limit the material to which the hatching is attached.

Any combination of the above components is also effective as an aspect of the disclosures set out herein. For example, the embodiment may be combined with arbitrary explanations of other embodiments or modifications, or the arbitrary description matter of any embodiment or other modifications may be combined with respect to modifications.

Further, when the one or more of the disclosures embodied by the above-described embodiments and modifications is generalized, it can be said that the one or more disclosures described in the following items is included.

First Item

A toilet seat unit including a discharge part that can discharge a cleaning liquid so that the cleaning liquid runs along a back surface of a toilet seat, in which the discharge part has an discharge hole formed so that an inner width of the discharge hole continuously increases as the discharge hole approaches a cleaning liquid outlet in a back surface view of the toilet seat.

Second Item

A toilet seat unit including a discharge part that can discharge a cleaning liquid so that the cleaning liquid runs along a back surface of a toilet seat, and a changing mechanism that can change an discharge direction or an discharge range in which the discharge part discharges the cleaning liquid according to a rotating position of the toilet seat.

When the disclosure embodied by the above-described embodiments and modifications is generalized, the following technical idea is led. Hereinafter, description will be given using an aspect described in the problems to be solved by the disclosure.

First Disclosure

In a toilet seat unit of a second aspect according to the first aspect, the discharge part can discharge a cleaning liquid so that the cleaning liquid runs along a back surface of the toilet seat, and can discharge the cleaning liquid having an upward velocity component. According to this aspect, it becomes easier to design so that most of the cleaning liquid discharged from the discharge part hits the back surface of the toilet seat, compared with the case where the cleaning liquid without the upward velocity component is discharged from the discharge part. Therefore, it becomes easy to increase the amount of the cleaning liquid running along the back surface of the toilet seat, and it is possible to effectively clean the back surface of the toilet seat.

The toilet seat unit of the third aspect according to the first or second aspect may further include a private part cleaning nozzle that is provided behind a center of a central opening portion of the toilet seat and provided to be movable forward and backward with respect to an opening portion for nozzle formed on a function device, in which the discharge part may be behind the center and may be provided in a left-and-right direction with respect to the private part cleaning nozzle. According to this aspect, compared to the case where the discharge part is provided on front of the center of the central opening portion of the toilet seat, the private part cleaning nozzle or the discharge part can be provided at a location where the function device is integrated, and the compactness of the function device is promoted.

The toilet seat unit of the fourth aspect according to any one of the first to third aspects, the discharge part may include a first discharge part that can discharge the cleaning liquid so that the cleaning liquid runs along the back surface of the toilet seat toward one side of the toilet seat in a circumferential direction, and a second discharge part that can discharge the cleaning liquid so that the cleaning liquid runs along the back surface of the toilet seat toward the other side of the toilet seat in the circumferential direction. According to this aspect, in a partial region of the back surface of the toilet seat, a flow running along one side in the circumferential direction and a flow running along the other side in the circumferential direction can be formed, and the region can be effectively cleaned.

In the toilet seat unit of a fifth aspect according to any one of the first to fourth aspects, the discharge part may be provided behind a front end portion of the function device. According to this aspect, when an inside of a toilet bowl of the toilet body is looked into from the upper side, the discharge part is concealed by the function device and is not easy to see, and therefore the good design is obtained.

In the toilet seat unit of the sixth aspect according to any one of the first to fifth aspects, the toilet seat may be rotatably attached to the function device, and the toilet seat may further include a changing mechanism that can change an discharge direction or an discharge range in which the discharge part discharges the cleaning liquid according to a rotational position of the toilet seat. According to this aspect, by using the changing mechanism, the discharge direction or the discharge range of the discharge part can be designed to be a desired condition according to the rotational position of the toilet seat, and the degree of freedom in design is increased.

In the toilet device of the seventh aspect according to the sixth aspect, the changing mechanism may set the discharge direction or the discharge range so that at least a part of the cleaning liquid is discharged upward when the toilet seat is at a lying position, and may set the discharge direction or the discharge range so that the cleaning liquid is discharged downward when the toilet seat is at an upright position. According to this aspect, when the toilet seat is at the lying position, the back surface of the toilet seat can be cleaned with the cleaning liquid. Further, when the toilet seat is at the upright position, it is possible to prevent the cleaning liquid from scattering outside the toilet bowl.

An eighth aspect is the toilet device that includes a toilet body having a toilet bowl, and the toilet seat unit according to any one of the first to seventh aspects.

In the toilet device of the ninth aspect according to the eighth aspect, the discharge part that can discharge the cleaning liquid for cleaning an inner surface of the toilet bowl may not be provided on an upper portion of the toilet bowl. According to this aspect, the discharge part is not provided on the upper portion of the toilet bowl, so it becomes easier to wipe the inner peripheral surface on the upper portion of the toilet bowl in the circumferential direction without hesitation, and the cleanability of the toilet bowl becomes good.

In the toilet device of the tenth aspect according to the ninth aspect, the toilet body may have a trap part connected to a bottom of the toilet bowl, and an inlet of the trap part may be opened on an inner wall surface on the front side of the toilet bowl. According to this aspect, when the inside of the toilet bowl of the toilet body is looked into from the front side, not only the upper portion of the toilet bowl but also the bottom of the toilet bowl has a clean structure, and therefore the good design can be obtained.

Second Disclosure

In a toilet seat unit of the second aspect according to the first aspect, the toilet seat unit is structured to satisfy the following condition (a), and the condition (a) is to form a first seat back flow that runs along the one side on the back surface by the cleaning liquid discharged from a first discharge part, and is to form a first in-bowl flow swirling toward the one side in a toilet bowl by using the cleaning liquid forming the first seat back flow. According to this aspect, it is possible to form the first in-bowl flow that cleans a wide range in the toilet bowl with less cleaning liquid while cleaning the back surface of the toilet seat with the first seat back flow, and effectively clean the back surface of the toilet seat or the toilet bowl.

In the toilet seat unit of the third aspect according to the second aspect, the toilet seat unit is structured to further satisfy the following condition (b), and the condition (b) is to form a second seat back flow that runs along the other side on the back surface by the cleaning liquid discharged from the second discharge part, and is to form the second in-bowl flow swirling toward the other side in the toilet bowl by using the cleaning liquid forming the second seat back flow. According to this aspect, it is possible to clean the range, which cannot be cleaned with the first bowl back flow can be cleaned, with the second bowl back flow while cleaning the range, which cannot be cleaned with the first seat back flow, with the second seat back flow.

In the toilet seat unit of the fourth aspect according to any of the first to third aspects, the plurality of discharge parts may include a third discharge part that can discharge a cleaning liquid from a liquid discharge hole for bowl into the toilet bowl, and the liquid discharge hole for bowl may discharge the cleaning liquid into the toilet bowl to form the third in-bowl flow swirling to the other side of the toilet bowl in the circumferential direction. According to this aspect, when the in-bowl flow that swirls in the toilet bowl is formed by the cleaning liquid discharged from the second discharge part, the in-bowl flow and the third in-bowl flow are joined, so a swirling flow with a large circumferential velocity component can be formed at the bottom of the toilet bowl. This improves the ability to clean the bottom of the toilet bowl.

In the toilet seat unit of the fifth aspect according to the fourth aspect, the third discharge part may be provided with another liquid discharge hole that can discharge the cleaning liquid in a direction different from the discharge direction of the cleaning liquid of the liquid discharge hole for bowl.

The toilet seat unit of the sixth aspect according to any one of the first to fifth aspects may further include a liquid supplying path that supplies the cleaning liquid to the first discharge part and the second discharge part, a switching mechanism that can switch the supply or not of the cleaning liquid supplied to the first discharge part and the second discharge part through the liquid supplying path, and a controller that can control the switching mechanism to end a first supply state in which the cleaning liquid is supplied to the first discharge part through the liquid supplying path and then start a second supply state in which the cleaning liquid is supplied to the second discharge part through the liquid supplying path.

In the toilet seat unit of the seventh aspect according to any one of the first to sixth aspects, the first discharge part can discharge the cleaning liquid from an discharge hole, and the toilet seat unit may further include a first shutter that can move between a concealed position where the discharge hole is concealed from the outside and an exposed position where the discharge hole is exposed to the outside, a first driving mechanism that can drive the first shutter, and the controller that can control the first driving mechanism so that the first shutter is moved to the concealed position when the second discharge part discharges the cleaning liquid. According to this aspect, when the second discharge part discharges the cleaning liquid, the droplets of the cleaning liquid are less likely to enter the discharge hole of the first discharge part, and therefore the good hygiene can be obtained.

The eighth aspect is a toilet device that includes a toilet body and the toilet seat unit according to any one of the first to seventh aspects.

Third Disclosure

The toilet device of the second aspect according to the first aspect may further include a housing member which has the discharge part housed therein and is provided with the opening portion in which the discharge part can move forward and backward, in which the shutter may close the opening portion when being at the concealed position and open the opening portion when being at the exposed position. According to this aspect, it is possible to prevent the droplets from entering the housing member by the shutter and obtain the better hygiene.

In the toilet device of the third aspect according to the second aspect, the discharge part may be rotatably attached to the housing member via the rotating shaft, and may move forward and backward with respect to the opening portion by rotating around the rotating shaft. According to this aspect, it is possible to reduce the size of the discharge part in the advanced/retreated direction rather than the structure in which the opening portion of the housing member can move forward and backward as the discharge part moves straight. As a result, the space required for housing the discharge part in the housing member can be reduced.

In the toilet device of the fourth aspect according to the second or third aspect, the discharge part may have the closing part that closes the opening portion when being at the advanced position where the discharge part advances from the opening portion. According to this aspect, even when the discharge part is at the advanced position, it is possible to prevent droplets from entering the opening portion of the housing member and obtain the better hygiene.

In the toilet device of the fifth aspect according to any one of the second to fourth aspects, the discharge part may be structured as a part of the same member as the shutter. According to this aspect, the number of components can be reduced by making the discharge part and the shutter as separate members, and the product cost can be reduced by reducing the assembling man-hours.

The sixth aspect is the toilet seat unit. The toilet seat unit of the sixth aspect includes the toilet seat that is rotatably attached to the toilet body, the discharge part that can discharge the cleaning liquid for cleaning the back surface of the toilet seat or the inner surface of the toilet bowl of the toilet body, and the shutter that can move between the concealed position where the discharge hole is concealed from the external space and the exposed position where the discharge hole is exposed to the external space.

Fourth Disclosure

In the toilet device of the second aspect according to the first aspect, the guide may be the inner peripheral side protrusion that protrudes downward from the inner peripheral side portion of the bowl facing surface.

In the toilet device of the third aspect according to the second aspect, the discharge part may discharge the cleaning liquid so that the cleaning liquid runs along the outer peripheral surface of the inner peripheral side protrusion in the circumferential direction. According to this aspect, the cleaning liquid can be guided to a wide range of the inner peripheral side portion of the bowl facing surface of the toilet seat by utilizing the Coanda effect.

In the toilet device of the fourth aspect according to the second or third aspect, an outer peripheral surface of an inner peripheral side protrusion may be formed to extend downward toward the inside in the radial direction. According to this aspect, when a part of the cleaning liquid attempts to run toward the outer peripheral surface of the inner peripheral side protrusion toward the inside in the radial direction, the cleaning liquid easily can reach the lower end portion of the inner peripheral side protrusion without losing its momentum. Therefore, it becomes easy to clean the outer peripheral surface of the inner peripheral side protrusion.

In the toilet device of the fifth aspect according to the second to fourth aspects, the bowl facing surface may have a half region that constitutes one half of the bowl facing surface in the left-and-right direction, the discharge part may discharge the cleaning liquid so that the cleaning liquid runs forward along the half region, and the inner peripheral side protrusion may be provided to be circumferentially continuous in a range including at least the central portion of the half region in the front-and-rear direction to the peripheral end portion on the front side. According to this aspect, the cleaning liquid is discharged to run to the front of the half region of the bowl facing surface, and therefore it is easy for the cleaning liquid to reach the peripheral end portion on the front side of the half region in which the cleaning liquid is difficult to reach.

In the toilet device of the sixth aspect according to any one of the second to fifth aspects, pooled water may accumulate in the bottom of the toilet bowl, the inner peripheral side protrusion may be arranged at a location overlapping the toilet bowl in the up-and-down direction at a location avoiding the pooled water in the range where the cleaning liquid reaches in plan view. According to this aspect, after the toilet seat is cleaned with the cleaning liquid, even after a part of the cleaning liquid drips from the inner peripheral side protrusion of the toilet seat, it is difficult for the cleaning liquid to drop directly into the pooled water, and the noise can be suppressed from occurring.

In the toilet device of the seventh aspect according to any one of the first to sixth aspects, the toilet seat may be provided with the outer peripheral side protrusion protruding downward from the outer peripheral side portion of the bowl facing surface, and the inner peripheral surface of the outer peripheral side protrusion may be provided to extend downward as the inner peripheral surface extends toward an outside in the radial direction. According to this aspect, when a part of the cleaning liquid attempts to run along the inner peripheral surface of the outer peripheral side protrusion toward the outside in the radial direction, the cleaning liquid easily reaches the lower end portion of the outer peripheral side protrusion without losing its momentum. Therefore, it becomes easy to clean the inner peripheral surface of the outer peripheral side protrusion.

In the toilet device of the eighth aspect according to the first to seventh aspects, when in the back surface view of the toilet seat, a line which is a virtual line extending from the discharge part in the discharge direction of the cleaning liquid and circumscribes the contour of the central opening portion of the toilet seat is set as a circumscribing line, and in the bowl facing surface, a region, which is a region closer to the center of the central opening portion from the circumscribing line and is located in the discharge direction from the circumscribing location of the circumscribing line, is set as at specific region, the guide may guide a part of the cleaning liquid so that the cleaning liquid runs along a part of the location overlapping the specific region in the inner peripheral side portion of the bowl facing surface. According to this aspect, it becomes easy to make the cleaning liquid reach the location where it is difficult for the cleaning liquid discharged from the discharge part to reach.

In the toilet device of the ninth aspect according to the first to eighth aspects, the discharge part may have an discharge hole formed so that an inner width of the discharge hole is continuously wide as the discharge part approaches a cleaning liquid outlet, in the back surface view of the toilet seat. According to this aspect, the cleaning liquid easily spreads in the horizontal direction orthogonal to the discharge direction while the cleaning liquid runs along the bowl facing surface of the toilet seat in the discharge direction, and the cleaning liquid easily reaches the wide range of the bowl facing surface.

A tenth aspect is a toilet seat unit. The toilet seat unit of the tenth aspect includes a toilet seat that is attached to the toilet body having the toilet bowl and has a bowl facing surface facing an inner surface of the toilet bowl in the up-and-down direction and provided on a back surface thereof, a discharge part that can discharge a cleaning liquid so that the cleaning liquid can run along the bowl facing surface, and a guide that can guide a part of the cleaning liquid so that the cleaning liquid runs along an inner peripheral side portion of the bowl facing surface.

Fifth Disclosure

In the toilet device of the second aspect according to the first aspect may include a second discharge part that can discharge a cleaning liquid so that the cleaning liquid runs along the back surface of the toilet seat toward the other side of the toilet seat in the circumferential direction, in which the back surface of the toilet seat is provided with a second inclined surface that becomes a downward gradient toward the other side of the toilet seat in the circumferential direction in at least a part of the range in which the cleaning liquid discharged from the second discharge part reaches. According to this aspect, when the cleaning liquid runs along the second inclined surface of the toilet seat, it becomes easy to run the cleaning liquid in the direction in which the second inclined surface becomes the downward gradient by using gravity due to the own weight of the cleaning liquid. Therefore, compared with the case where the toilet seat does not have the second inclined surface, the cleaning liquid can easily reach the wide range of the back surface of the toilet seat.

In the toilet device of the third aspect according to the second aspect, the back surface of the toilet seat may be provided with a crest portion at least a part of which a lower end portion of the first inclined surface and a lower end portion of the second inclined surface are constituted. According to this aspect, the cleaning liquid running in the direction in which the first inclined surface becomes the downward gradient or the cleaning liquid running in the direction in which the second inclined surface becomes the downward gradient is easily drained in the crest portion. As a result, it becomes easier to control the location where the cleaning liquid adheres inside the toilet bowl and it becomes easier to clean the inside of the toilet bowl of the toilet body with the cleaning liquid within the range including the location where the liquid adheres.

In the toilet device of the fourth aspect according to any one of the first to the third aspects, the back surface of the toilet seat is provided with the bowl facing surface facing the inner surface of the toilet bowl in the up-and-down direction, the bowl facing surface has a half region constituting a half portion of the bowl facing surface in the left-and-right direction, the first discharge part discharges a cleaning liquid so that the cleaning liquid runs forward along the half region, and the first inclined surface may be provided in a range including at least the central portion of the half region in the front-and-rear direction to the peripheral end portion on the front side. According to this aspect, the cleaning liquid is discharged to run to the front of the half region of the bowl facing surface, and therefore it is easy for the cleaning liquid to reach the peripheral end portion on the front side of the half region in which the cleaning liquid is difficult to reach.

The fifth aspect is the toilet seat unit. The toilet seat unit of the first aspect includes a toilet seat that is attached to the toilet body and a first discharge part that can discharge a cleaning liquid so that the cleaning liquid runs along a back surface of the toilet seat toward one side of the toilet seat in a circumferential direction, in which the back surface of the toilet seat is provided with a first inclined surface that becomes downward gradient toward one side of the toilet seat in the circumferential direction in at least a part of the range in which the cleaning liquid discharged from the first discharge part reaches.

The present disclosures relate to a toilet device and a toilet seat unit used for the same.

The invention claimed is:

1. A toilet seat unit comprising:

a function device that is provided on a toilet body;

a toilet seat that is at least movably or detachably attached to the function device; and a discharge part structured to discharge a cleaning liquid for cleaning at least a back surface of the toilet seat or an inner surface of a toilet bowl of the toilet body, wherein the discharge part is provided on the function device and wherein the discharge part includes:

a first discharge part structured to discharge the cleaning liquid so that the cleaning liquid runs along the back surface of the toilet seat toward one side in a circumferential direction of the toilet seat; and a second discharge part structured to discharge the cleaning liquid so that the cleaning liquid runs along the back surface of the toilet seat toward an other side in the circumferential direction of the toilet seat.

2. A toilet seat unit comprising:

a function device that is provided on a toilet body;

a toilet seat that is at least movably or detachably attached to the function device; and a discharge part structured to discharge a cleaning liquid for cleaning at least a back surface of the toilet seat or an inner surface of a toilet bowl of the toilet body, wherein the discharge part is provided on the function device and wherein the toilet seat is rotatably attached to the function device, and the toilet seat unit further includes a changing mechanism structured to change at least a discharge direction or a discharge range in which the discharge part discharges the cleaning liquid according to a rotational position of the toilet seat.

3. The toilet seat unit of claim 2, wherein the changing mechanism sets at least the discharge direction or the discharge range so that at least a part of the cleaning liquid is discharged upward when the toilet seat is at a lying position, and sets at least the discharge direction or the discharge range so that the cleaning liquid is discharged downward when the toilet seat is at an upright position.

4. A toilet seat unit comprising:

a function device that is provided on a toilet body;

a toilet seat that is at least movably or detachably attached to the function device; and a discharge part structured to discharge a cleaning liquid for cleaning at least a back surface of the toilet seat or an inner surface of a toilet bowl of the toilet body, wherein the discharge part is provided on the function device; and a plurality of the discharge parts structured to discharge the cleaning liquid, wherein the toilet seat is attached to a toilet body having the toilet bowl via the function device, and the plurality of discharge parts have a first discharge part structured to discharge the cleaning liquid so that the cleaning liquid runs along a back surface of the toilet seat toward one side in a circumferential direction of a toilet seat, and a second discharge part structured to discharge the cleaning liquid so that the cleaning liquid runs along the back surface of the toilet seat toward an other side in the circumferential direction of the toilet seat, and the toilet seat unit ends an operation of discharging, by the first discharge part, the cleaning liquid so that the cleaning liquid runs along the back surface and then start an operation of discharging, by the second discharge part, the cleaning liquid so that the cleaning liquid runs along the back surface.

5. The toilet seat unit of claim 4, further comprising:

a liquid supplying path structured to supply the cleaning liquid to the first discharge part and the second discharge part;

a switching mechanism structured to switch the supply or not of the cleaning liquid supplied to the first discharge part and the second discharge part through the liquid supplying path; and a controller structured to control the switching mechanism to end a first supply state in which the cleaning liquid is supplied to the first discharge part through the liquid supplying path and then start a second supply state in which the cleaning liquid is supplied to the second discharge part through the liquid supplying path.

6. The toilet seat unit of claim 4, wherein the first discharge part discharges the cleaning liquid from an discharge hole, and the toilet seat unit further includes a first shutter structured to move between a concealed position where the discharge hole is concealed from an outside and an exposed position where the discharge hole is exposed to the outside, a first driving mechanism structured to drive the first shutter, and a controller structured to control the first driving mechanism so that the first shutter is moved to the concealed position when the second discharge part discharges the cleaning liquid.

7. A toilet device, comprising:

a toilet body; and the toilet seat unit of claim 4.

8. The toilet seat unit of claim 4, wherein the toilet seat unit is structured to satisfy a following condition (a), and the condition (a) is to form a first seat back flow that runs along the one side on the back surface by the cleaning liquid discharged from the first discharge part, and is to form a first in-bowl flow swirling toward the one side in the toilet bowl by using the cleaning liquid forming the first seat back flow.

9. The toilet seat unit of claim 8, wherein the toilet seat unit is structured to further satisfy a following condition (b), and the condition (b) is to form a second seat back flow that runs along the other side on the back surface by the cleaning liquid discharged from the second discharge part, and is to form a second in-bowl flow swirling toward the other side in the toilet bowl by using the cleaning liquid forming the second seat back flow.

10. The toilet seat unit of claim 4, wherein the plurality of discharge parts include a third discharge part structured to discharge the cleaning liquid from a first liquid discharge hole for bowl in the toilet bowl, and the first liquid discharge hole for bowl discharges the cleaning liquid into the toilet bowl to form a third in-bowl flow that swirls to the other side in the circumferential direction within the toilet bowl.

11. The toilet seat unit of claim 10, wherein the third discharge part is provided with a second liquid discharge hole that discharges the cleaning liquid in a direction different from a discharge direction of the cleaning liquid of the first liquid discharge hole for bowl.

12. A toilet device, comprising:

a toilet body having a toilet bowl; and a toilet seat unit comprising:

a function device that is provided on the toilet body;

a toilet seat that is at least movably or detachably attached to the function device; and a discharge part structured to discharge a cleaning liquid for cleaning at least a back surface of the toilet seat or an inner surface of the toilet bowl of the toilet body, wherein the discharge part is provided on the function device the toilet seat is attached to the toilet body via the function device and has a bowl facing surface facing an inner surface of the toilet bowl in an up-and-down direction and provided on a back surface thereof, and the discharge part discharges the cleaning liquid so that the cleaning liquid runs along the bowl facing surface, and the toilet device further includes a guide structured to guide a part of the cleaning liquid so that the cleaning liquid runs along an inner peripheral side portion of the bowl facing surface.

13. The toilet device of claim 12, wherein the toilet seat is provided with an outer peripheral side protrusion that protrudes downward from an outer peripheral side portion of the bowl facing surface, and an inner peripheral surface of the outer peripheral side protrusion is formed to extend downward toward an outside in a radial direction.

14. The toilet device of claim 12, wherein in a back surface view of the toilet seat, a line which is a virtual line extending from the discharge part in an discharge direction of the cleaning liquid and circumscribes a contour of a central opening portion of the toilet seat is set as a circumscribing line, and in the bowl facing surface, a region, which is a region closer to a center of the central opening portion from the circumscribing line and is located in the discharge direction from the circumscribing location of the circumscribing line, is set as at a specific region, the guide guides a part of the cleaning liquid so that the cleaning liquid runs along a part of a location overlapping the specific region in the inner peripheral side portion of the bowl facing surface.

15. The toilet device of claim 12, wherein the discharge part has an discharge hole formed so that an inner width of the discharge hole continuously increases as the discharge hole approaches a cleaning liquid outlet in a back surface view of the toilet seat.

16. The toilet device of claim 12, wherein the guide is an inner peripheral side protrusion that protrudes downward from an inner peripheral side portion of the bowl facing surface.

17. The toilet device of claim 16, wherein the discharge part discharges the cleaning liquid so that the cleaning liquid runs along an outer peripheral surface of the inner peripheral side protrusion in a circumferential direction.

18. The toilet device of claim 16, wherein an outer peripheral surface of the inner peripheral side protrusion is formed to extend downward toward an inside in a radial direction.

19. The toilet device of claim 16, wherein the bowl facing surface has a half region that constitutes a half portion of one side of the bowl facing surface in a left-and-right direction, the discharge part discharges the cleaning liquid so that the cleaning liquid runs forward along the half region, and the inner peripheral side protrusion is continuously provided in a circumferential direction in a range including at least a central portion of the half region in a front-and-rear direction to a peripheral end portion on a front side of the half region.

20. The toilet device of claim 16, wherein a pooled water accumulates in a bottom of the toilet bowl, and the inner peripheral side protrusion is arranged at a location overlapping the toilet bowl in the up-and-down direction at a location avoiding the pooled water in a range in which the cleaning liquid reaches in plan view.

21. A toilet device, comprising:

a toilet body having a toilet bowl; and a toilet seat unit comprising:

a function device that is provided on the toilet body;

a toilet seat that is at least movably or detachably attached to the function device; and a discharge part structured to discharge a cleaning liquid for cleaning at least a back surface of the toilet seat or an inner surface of the toilet bowl of the toilet body, wherein the discharge part is provided on the function device, the toilet seat is attached to the toilet body via the function device, the discharge part includes a first discharge part structured to discharge the cleaning liquid so that the cleaning liquid runs along the back surface of the toilet seat toward one side of the toilet seat in the circumferential direction, and the back surface of the toilet seat is provided with a first inclined surface that becomes downward gradient toward the one side of the toilet seat in a circumferential direction in at least a part of a range in which the cleaning liquid discharged from the first discharge part reaches.

22. The toilet device of claim 21, wherein the back surface of the toilet seat is provided with a bowl facing surface that faces an inner surface of the toilet bowl in an up-and-down direction, the bowl facing surface has a half region that constitutes a half portion of one side of the bowl facing surface in a left-and-right direction, the first discharge part discharges the cleaning liquid so that the cleaning liquid runs forward along the half region, and the first inclined surface is provided in a range including at least a central portion of the half region in a front-and-rear direction to a peripheral end portion on a front side of the half region.

23. The toilet device of claim 21, wherein the discharge part includes a second discharge part structured to discharge the cleaning liquid so that the cleaning liquid runs along the back surface of the toilet seat toward an other side of the toilet seat in the circumferential direction, and the back surface of the toilet seat is provided with a second inclined surface that becomes downward gradient toward the other side of the toilet seat in the circumferential direction in at least a part of a range in which the cleaning liquid discharged from the second discharge part reaches.

24. The toilet device of claim 23, wherein the back surface of the toilet seat is provided with a crest portion at least a part of which a lower end portion of the first inclined surface and a lower end portion of the second inclined surface are constituted.

* * * * *